US012022953B2

(12) United States Patent
Massman

(10) Patent No.: US 12,022,953 B2
(45) Date of Patent: Jul. 2, 2024

(54) PRAYER AND MEDITATION STAND

(71) Applicant: Edward L Massman, Dallas, TX (US)

(72) Inventor: Edward L Massman, Dallas, TX (US)

( * ) Notice: Subject to any disclaimer, the term of this patent is extended or adjusted under 35 U.S.C. 154(b) by 30 days.

(21) Appl. No.: 17/835,803

(22) Filed: Jun. 8, 2022

(65) Prior Publication Data

US 2023/0397736 A1 Dec. 14, 2023

(51) Int. Cl.
*A47C 16/04* (2006.01)
*A47G 33/00* (2006.01)
*A47G 33/02* (2006.01)

(52) U.S. Cl.
CPC ..... *A47C 16/04* (2013.01); *A47G 33/008* (2013.01); *A47G 33/02* (2013.01)

(58) Field of Classification Search
CPC ..... A47C 16/04; A47G 33/02; A47G 33/008
USPC ..... 297/423.16, 423.12, 187, 143, 423.11, 297/188.01, 188.2, 188.21, 399, 411.23, 297/440.13; 312/235.3, 235.2, 235.5
See application file for complete search history.

(56) References Cited

U.S. PATENT DOCUMENTS 808,169 A * 12/1905 Rhodes ..... A47B 88/497 312/204
1,265,703 A * 5/1918 Dreisoerner ..... A47C 16/04 297/336
1,944,985 A * 1/1934 Koran ..... A47G 33/02 206/19
2,057,944 A * 10/1936 Gallagher ..... A47C 11/02 D6/330
2,242,925 A * 5/1941 Shea, Jr. ..... A47C 11/02 297/187
2,544,415 A * 3/1951 Busam, Sr. ..... A47G 33/02 428/3
2,548,098 A 4/1951 Clarin
3,011,848 A * 12/1961 Hasson ..... A47B 83/00 312/33
3,120,410 A * 2/1964 Berg ..... A47C 11/02 312/277
5,882,095 A * 3/1999 Green ..... A47B 19/02 D6/700
D415,621 S * 10/1999 Queen ..... D6/330
6,206,540 B1 * 3/2001 Vogel ..... F21V 35/00 431/297
6,578,217 B1 6/2003 Roberson
D524,068 S 6/2006 Halley
D528,820 S 9/2006 Whitley, Jr.
D562,017 S 2/2008 Brewer et al.
8,465,099 B2 6/2013 Addy
8,590,974 B2 11/2013 Kalayjian
9,084,492 B2 7/2015 Guillory
(Continued)

*Primary Examiner* — Milton Nelson, Jr.
(74) *Attorney, Agent, or Firm* — Antonio Papageorgiou, Esq.; Lombard Geliebter LLP

(57) ABSTRACT

A prayer and meditation stand is provided that can include a base, a shelf, a prayer and meditation rail, a votive candle holder, votive candles, a kneeler, a kneeler with seat, a meditation platform, an accessory holder, one or more interchangeable icons, accessory shelf, an art/document/tablet holder, electronic communication devices, lighting, decorative panels, and other accoutrements. Combining some or all these elements, into one convenient assembly that is compact in size and can be used in a home environment as an attractive piece of furniture complete and functional in its intended use for prayer, worship, and meditation.

21 Claims, 56 Drawing Sheets

(56) References Cited

U.S. PATENT DOCUMENTS

| | | | | |
|---|---|---|---|---|
| 9,420,893 | B1 | 8/2016 | Clark | |
| D798,609 | S | 10/2017 | Henschel | |
| 10,130,187 | B1 | 11/2018 | Clark | |
| D880,877 | S | 4/2020 | Zavala | |
| 10,925,407 | B1 | 2/2021 | Spencer | |
| D913,709 | S | 3/2021 | Baylor | |
| 2003/0101514 | A1 | 6/2003 | Roberson | |
| 2007/0054595 | A1 | 3/2007 | Pinto | |
| 2007/0205054 | A1 | 9/2007 | Gentles et al. | |
| 2008/0233834 | A1 | 9/2008 | Pinto | |
| 2009/0165400 | A1* | 7/2009 | Booker | E04H 1/125 52/750 |
| 2012/0181836 | A1* | 7/2012 | Maassarani | B60N 2/2839 297/399 |
| 2012/0231401 | A1* | 9/2012 | Hsu | F21V 35/00 431/289 |
| 2023/0117693 | A1* | 4/2023 | Brown | A47C 7/725 297/187 |

* cited by examiner

PRAYER AND MEDITATION STAND

BACKGROUND OF THE INVENTION

The present application relates to an attractive, uniquely styled, and functional piece of furniture, aimed at encouraging and enriching prayer, meditation, and worship at home.

Daily, hundreds of millions of people take the time to pray or meditate. They seek comfort, courage, hope, forgiveness, and peace. They pray for intercession and intentions. They offer praise and give thanks. They seek to reduce stress, improve self-control, and reach a higher level of spiritual awareness. Prayer is an act, by a human, addressing God or a god in thought or auditory sound using a word or ordered set of words. Meditation is a practice of focusing upon a sound, visualization, image, the breath, or other movement to promote relaxation and increase awareness of now or the present moment. Both of these practices enhance personal and spiritual growth.

Kneeling is one of the postures humans can take to pray or meditate. Kneeling is an act that brings humility and obedience to mind. Because mobility in the outer world is surrendered to opening the door to the inner world of reverence to the divine.

Kneelers began to emerge in the western world about the 16th century. First in conjunction with altar rails having a built-in spot to place the knees as well as confessionals and the more modern use of kneelers in front of church pews to accommodate worshipers from kneeling on the floor.

The prie-dieu became known in the early $17^{th}$ century. This is the type of prayer desk primarily intended for private devotional use. The desks were fairly large, had a sloping shelf for books and some had a kneeler.

Votive candles use goes back into antiquity in regard to the symbolism of light and its significance of divine presence. We find this pious practice, in prayer and meditation, continues down to this day in just about all religions. The structure of votive candles takes on many forms.

An icon is a religious work of art considered as a sacred image used in religious devotion. Some of the earliest known pictograms can be considered as icons. At present, just about all religions publish their respective icons and important images, objects and symbols (together "icons") in one form or another.

Turning to the news of the day and the situation of modern day pandemics isolating the population in various ways, until now, persons have experienced full access to their places of worship where these items exist in their respective singular fashion. Confinement to home separates many from these material supports to their religious practices. Confinement and convenience necessitate a need to pray and meditate at home.

Accordingly, there is a need for a prayer and meditation stand that encourages and enriches these experiences and provides the familiarity and essence of places of peace and worship, in a convenient assemblage that is compact in size, easily scalable to suit the user's needs and comfort and can be used in a home environment as an attractive piece of furniture complete and functional in its use also incorporating electrification, including lighting and power outlets and electronic connectivity.

SUMMARY OF THE INVENTION

In one aspect, a prayer and meditation stand is provided that includes: a base forming a general cabinet structure having a top, front and back, and a left side and a right side, and a cavity therein; a prayer and meditation rail at an upper front of the base spanning between the left side and rights side of the base; at least one of each of a votive candle holder and an accessory holder, each extending upward from the top of the base between the front and back of the base; and at least one of a kneeler or meditation platform located at the front of the base.

In one embodiment, the prayer and meditation stand includes a plurality of votive candle holders each extending upward from the top of the base between the front and back of the base, wherein the accessory holder is located on the top of the base distally relative to the plurality of votive candle holders.

In one embodiment, the plurality of votive candle holders vary in height.

In one embodiment, at least one of the votive candle holder and the accessory holder is fixedly attached to the top of the base.

In one embodiment, the prayer and meditation stand includes a kneeler and wherein the kneeler is slidingly coupled to the base, such that the kneeler can be slid into the base so that the kneeler may be contained within the cavity of the base completely and slid out of the base for use.

In one embodiment, the prayer and meditation stand includes an accessory holder frame rail extending laterally across the top of the base, wherein the top of the base has an open structure and wherein the prayer and meditation rail and the votive candle holder define a first opening and the votive candle holder and the accessory holder frame rail define a second opening in the top of the base.

In one embodiment, the prayer and meditation stand includes an accessory holder frame rail extending laterally across the top of the base, the accessory holder is formed as an integral part of the accessory holder frame rail.

In one embodiment, the prayer and meditation stand includes an accessory holder frame rail extending laterally across the top of the base, wherein the accessory holder is removably attached to the accessory holder frame rail.

In one embodiment, the accessory holder includes a channel configured to fit over the accessory holder frame rail.

In one embodiment, the base is made from a plurality of tubes interconnected such that the cabinet structure has openings therein in at least the front, and the left and rights sides of the base.

In one embodiment, the prayer and meditation stand includes decorative panels on at least one of the left and right and front sides of the base.

In one embodiment, the prayer and meditation stand includes an accessory holder frame rail extending laterally across the top of the base and a shelf between the top and a bottom of the base, wherein the top of the base has an open structure and wherein the prayer and meditation rail and the votive candle holder define a first opening and the votive candle holder and the accessory holder frame rail define a second opening in the top of the base, the first and second openings located directly above the shelf.

In one embodiment, the kneeler is pivotally coupled to the base, such that the kneeler can be pivoted into the base so that the kneeler may be contained within the cavity of the base completely and pivoted out of the base for use.

In one embodiment, the prayer and meditation stand includes an accessory holder frame rail extending laterally across the top of the base, wherein the accessory holder is in the form of an art/document/tablet holder removably and, or slidingly coupled to the accessory holder frame rail.

In one embodiment, the prayer and meditation stand includes an accessory holder frame rail extending laterally across the top of the base, wherein the accessory holder has an H-shaped cross section, the H-shaped cross section slidingly attached to the accessory holder frame rail.

In one embodiment, the prayer and meditation stand includes a plurality of accessory holders interchangeably attachable to the prayer and meditation stand.

In one embodiment, the prayer and meditation stand includes a kneeler and seat integrally coupled to the kneeler.

In one embodiment, the seat and kneeler have planer upper surfaces that are other than parallel to the ground.

In one embodiment, the prayer and meditation stand includes a meditation platform configured to be slid into the cavity of the base.

In one embodiment, the prayer and meditation stand includes a fixed-in-place kneeler.

In one embodiment, the prayer and meditation stand includes a kneeler detached from the base.

In one embodiment, the prayer and meditation stand includes an accessory holder frame rail extending laterally across the top of the base, wherein the accessory holder has an open socket, and is attached to the accessory holder frame rail.

Additional aspects of the present invention will be apparent in view of the description which follows.

DETAILED DESCRIPTION OF THE INVENTION

Figure 1:
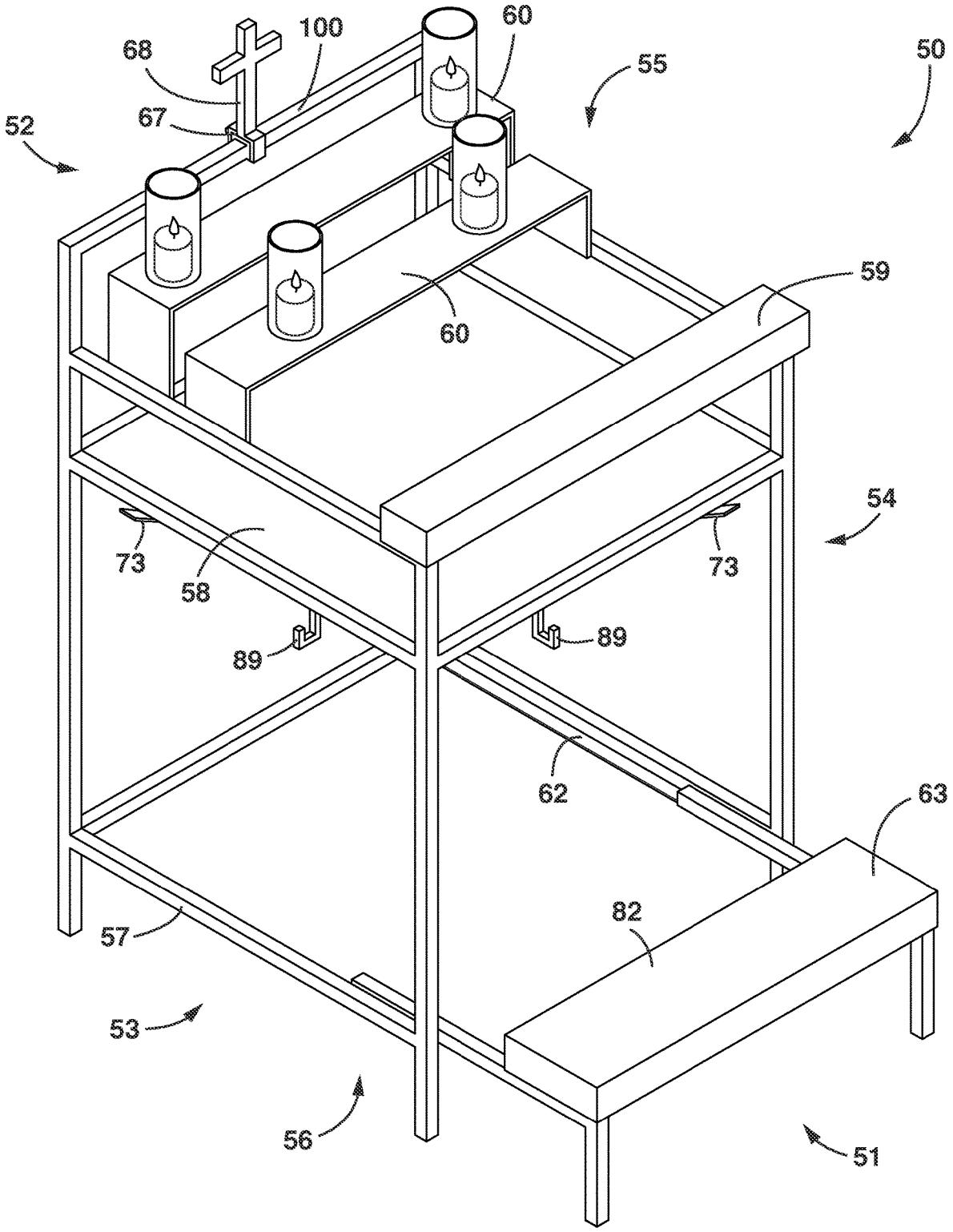
FIG. 1 is a front isometric view of the prayer and meditation stand.
Figure 69:
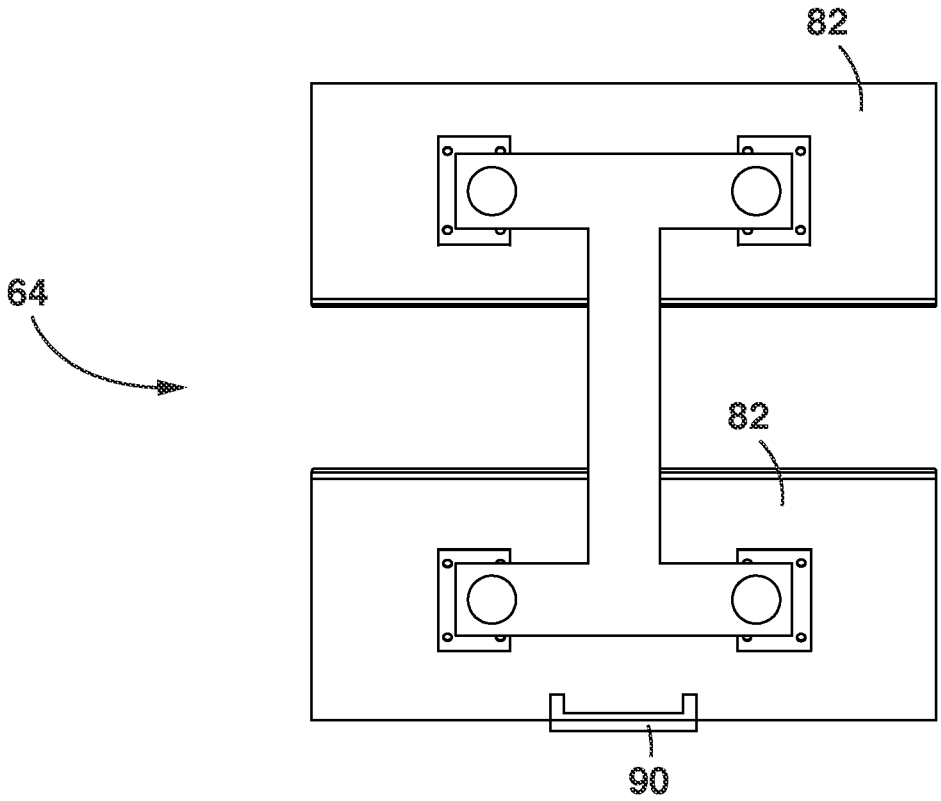
FIG. 69 is a bottom plan view of FIG. 64.

Referring to FIG. 1 through FIG. 69 the prayer and meditation stand 50 is/are provided combining elements, used in prayer and meditation, such as kneeler, meditation platform, votive candle, and an accessory holder system to allow for the exchange of icons and other accessories, into one convenient assembly that is compact in size and can be used in a home environment as an attractive piece of furniture complete and functional in its use. The prayer and meditation stand 50 may also incorporate LED or other type of lighting 81, such as beneath a votive candle holder 60 (e.g., with the light shining downward, rearward, upward, or a combination thereof (toward the icon or other paraphernalia, for example)), a shelf 58, accoutrement 74 or other location as well as electronic communication devices such as phones, tablets, and other computing devices. A prayer and meditation stand 50 has a general cabinet shape with a base 57 having the front 51, the back 52, the left side 53, the right side 54, the top 55 and the bottom 56.

The base 57 of a prayer and meditation stand 50 can be manufactured from material such as wood, steel, aluminum, plastic or other solid or hollow, structurally suitable, material. In at least one embodiment 1.0 inch square material can be used. Members can be fastened together by any means of joining, such as mortise and tenon, dowels, dovetailing, the use of fasteners, adhesives, welding, or other suitable means of fastening the parts of the structure together. Materials up to a 3 inch square or rectangular cross section may be used as is practically and aesthetically pleasing for alternative designs of the prayer and meditation stand 50.

Figure 2:
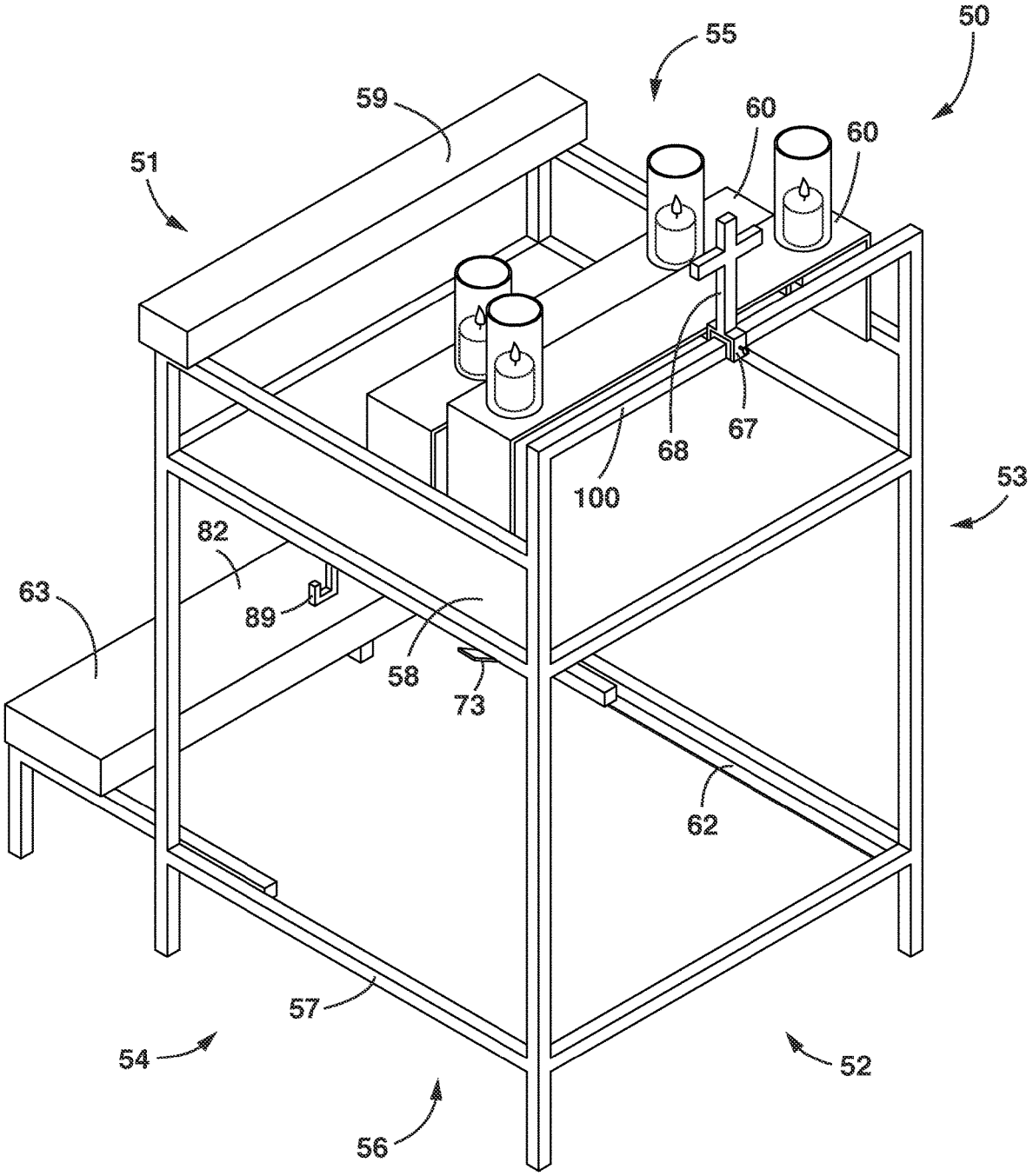
FIG. 2 is a back isometric view of a prayer and meditation stand.
Figure 3:
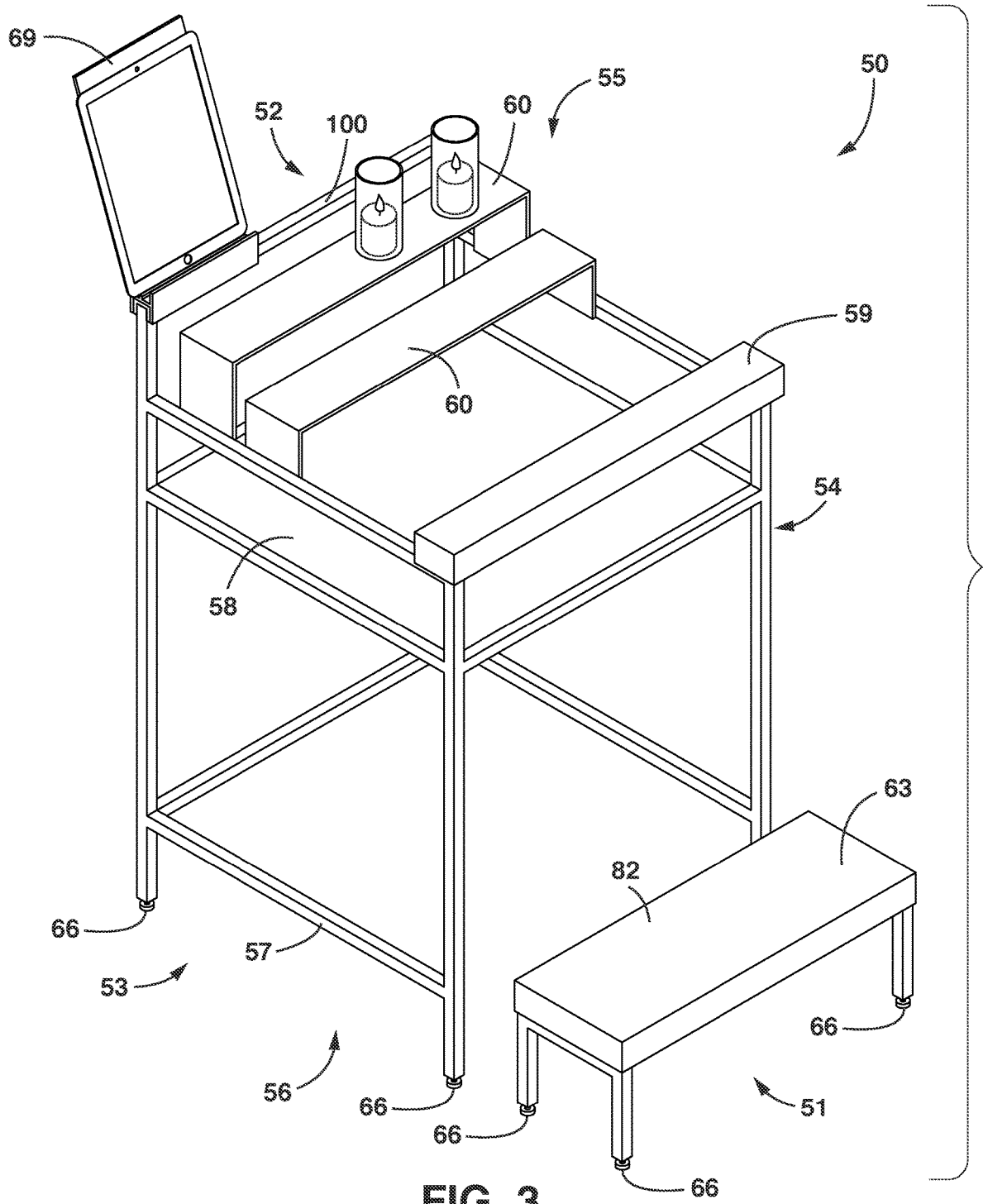
FIG. 3 is a front isometric view of the second embodiment of a prayer and meditation stand.
Figure 11:
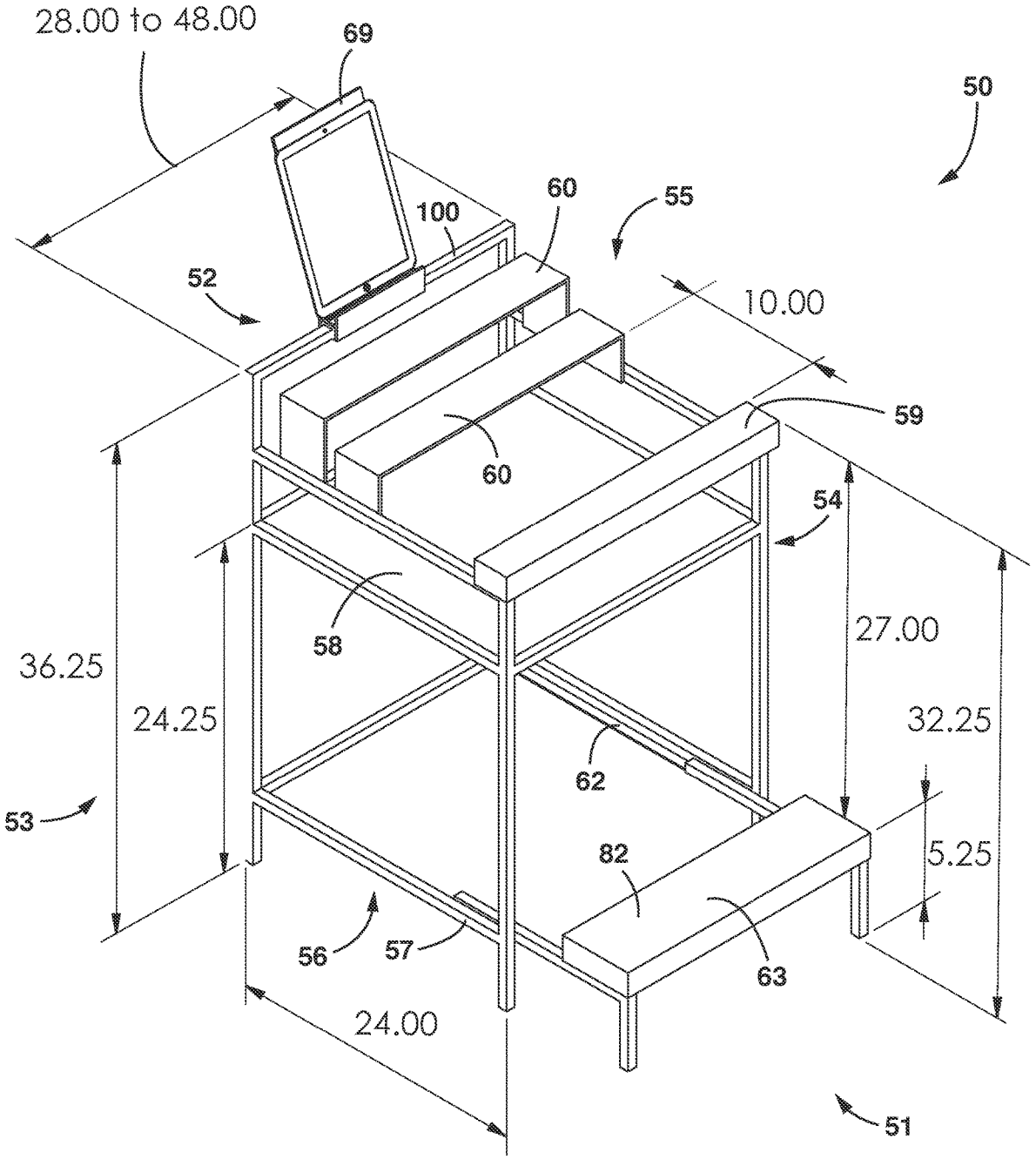
FIG. 11 is a front isometric view of functional features of a prayer and meditation stand.
Figure 12:
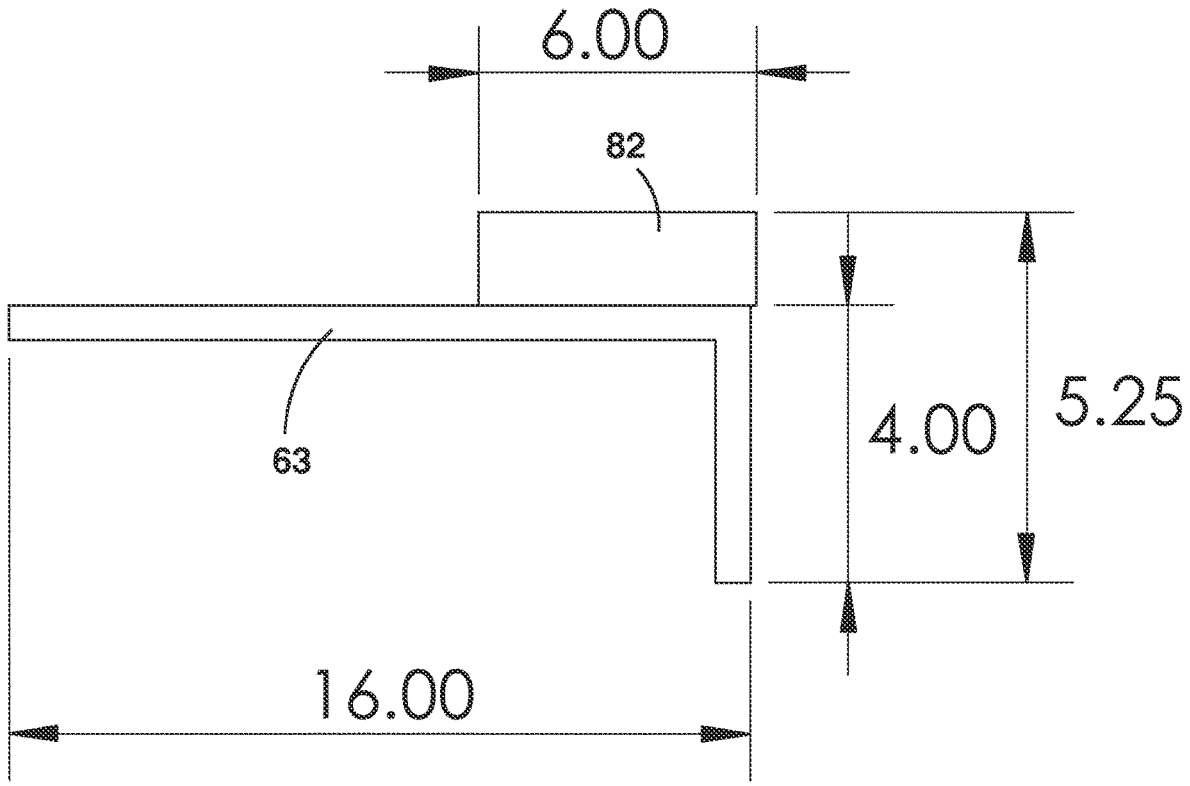
FIG. 12 is a left side elevation view of a prayer and meditation stand.
Figure 13:
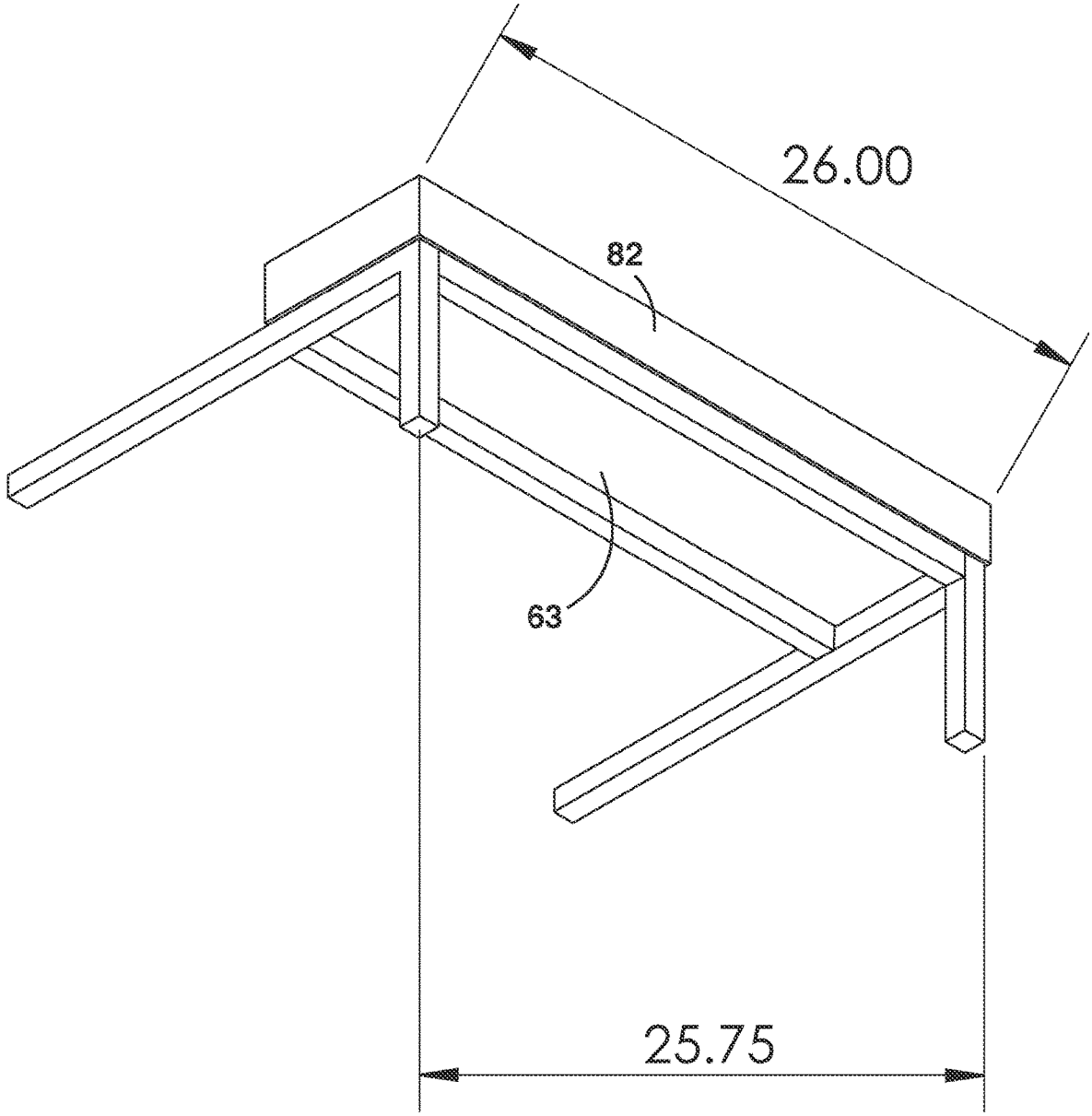
FIG. 13 is a bottom isometric view of a prayer and meditation stand.
Figure 14:
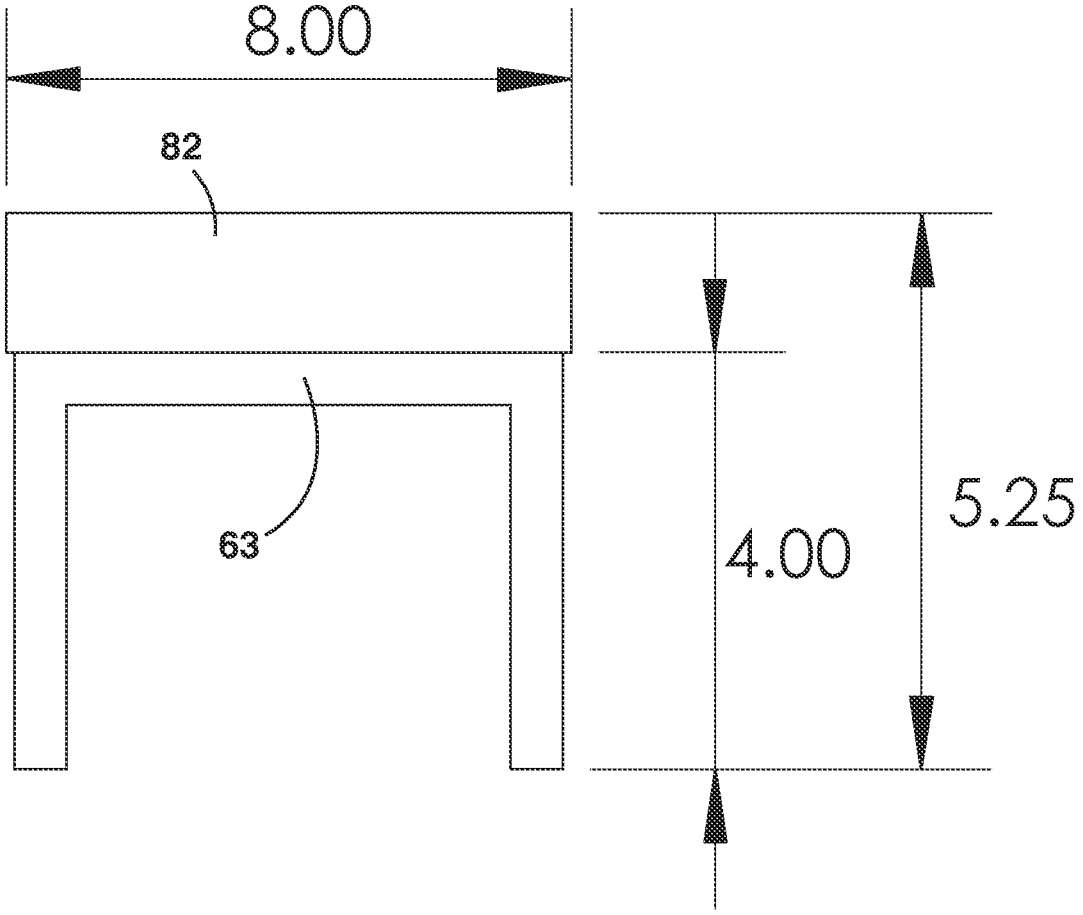
FIG. 14 is a left side elevation of the second embodiment of a prayer and meditation stand.
Figure 15:
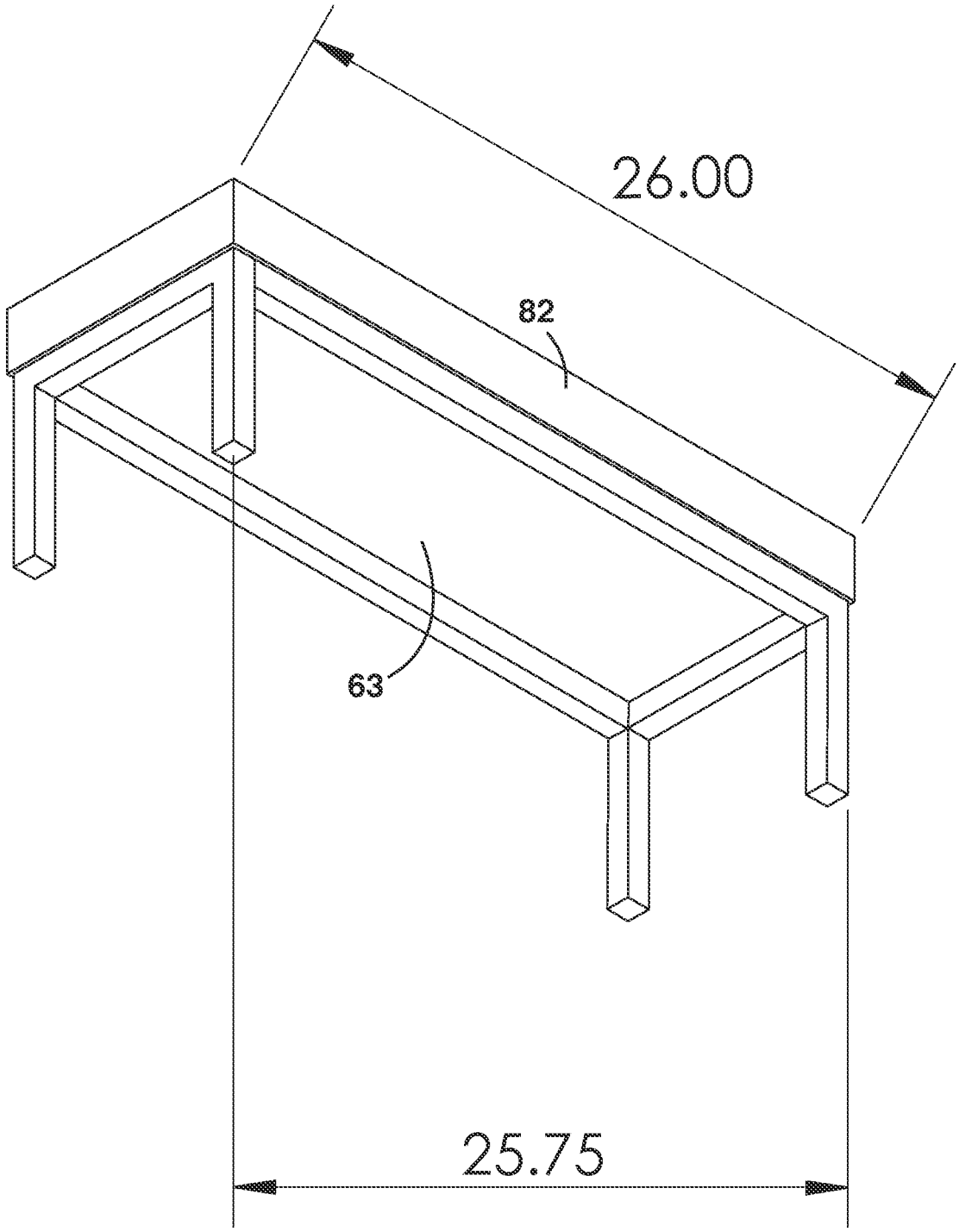
FIG. 15 is a bottom isometric view of a second embodiment of a prayer and meditation stand.
Figure 16:
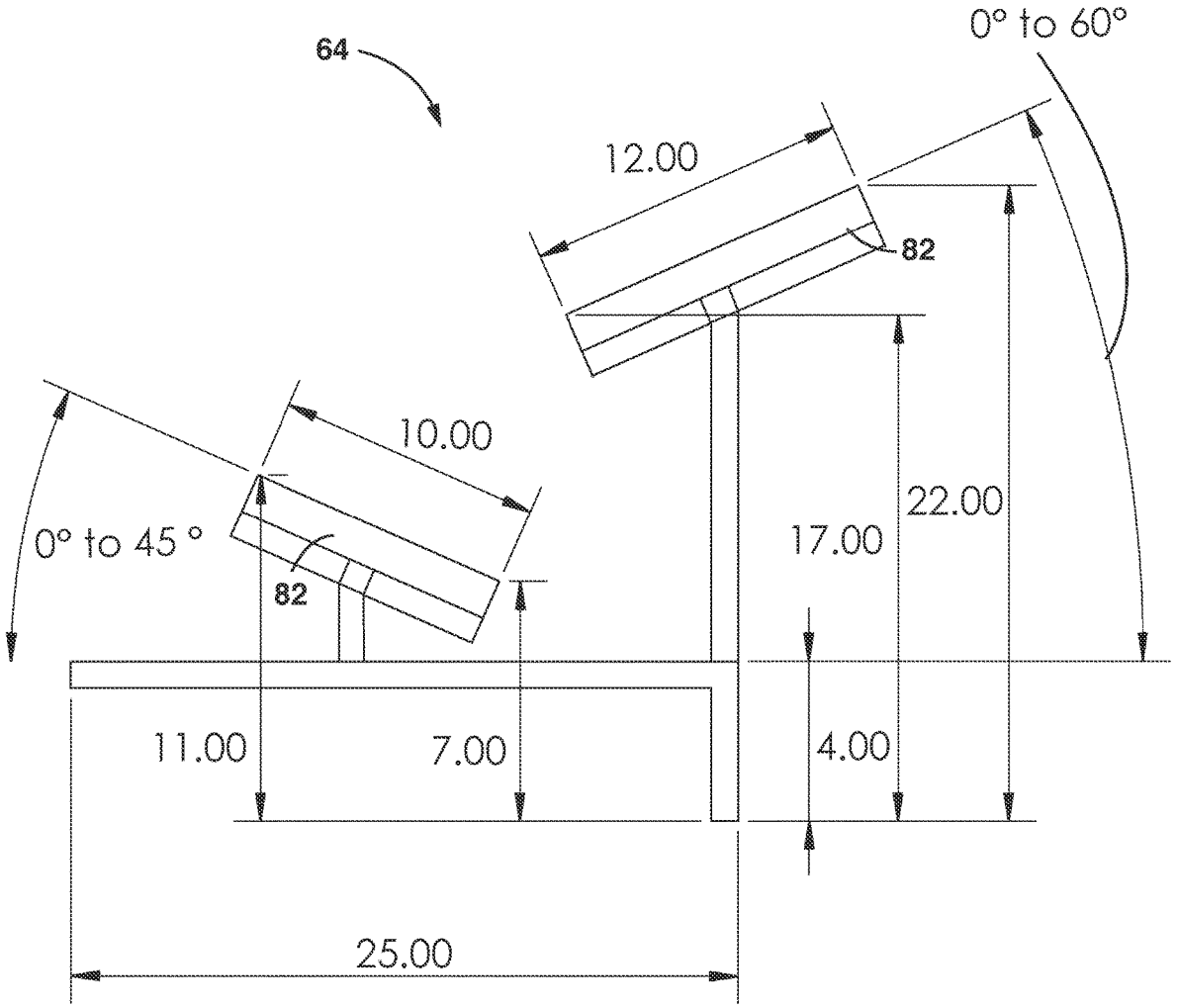
FIG. 16 is a left side elevation of the third embodiment of a prayer and meditation stand with seat.
Figure 17:
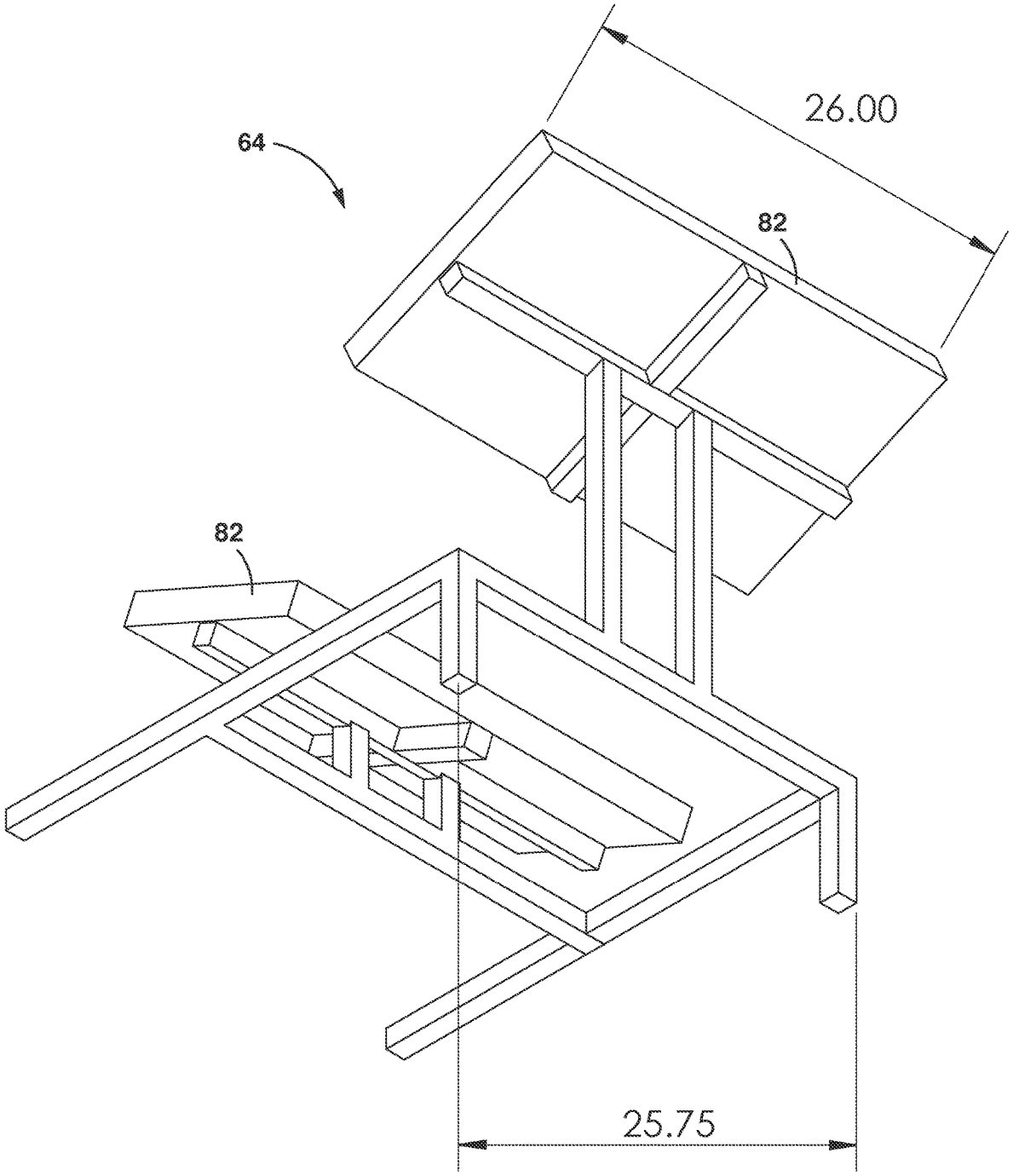
FIG. 17 is a bottom isometric view of a third embodiment of a prayer and meditation stand with seat.
Figure 18:
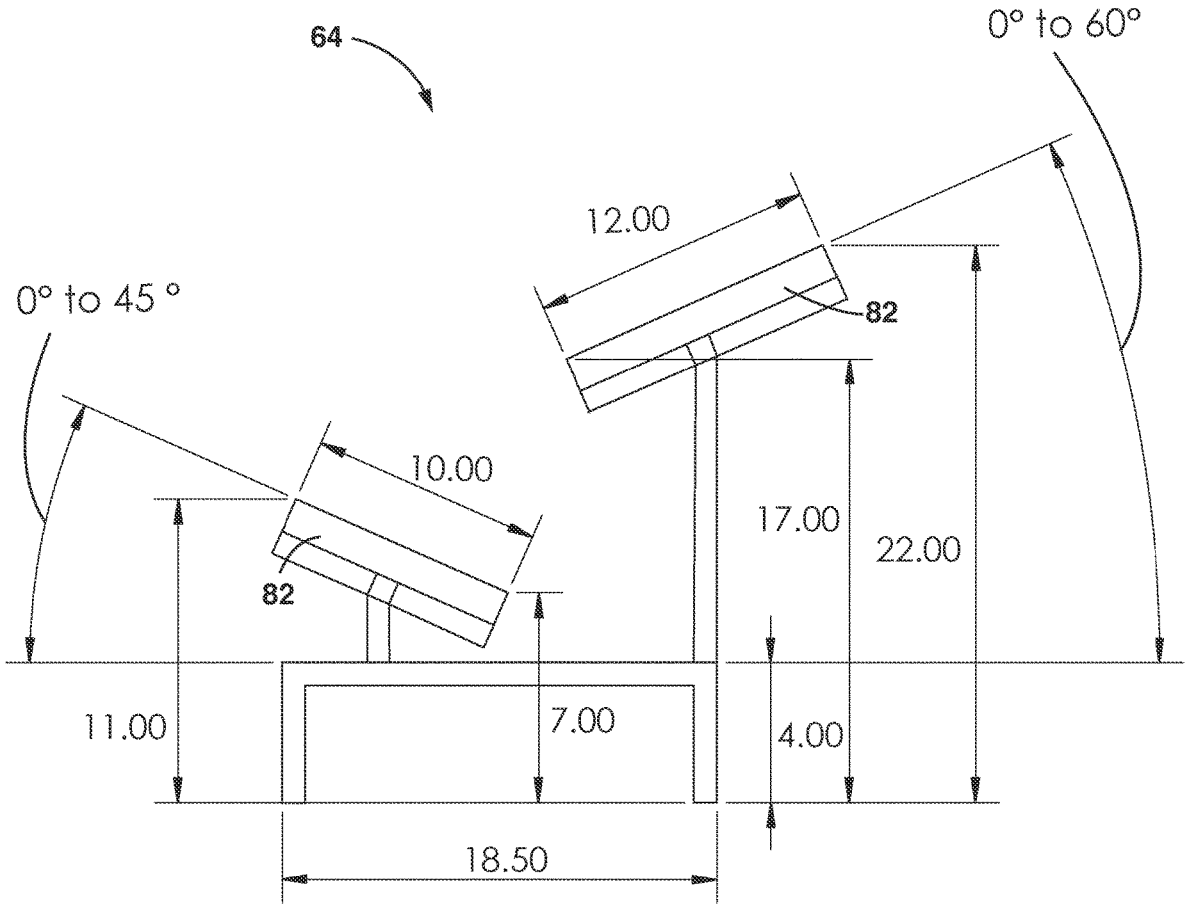
FIG. 18 is a left side elevation of the fourth embodiment of a prayer and meditation stand with seat.
Figure 19:
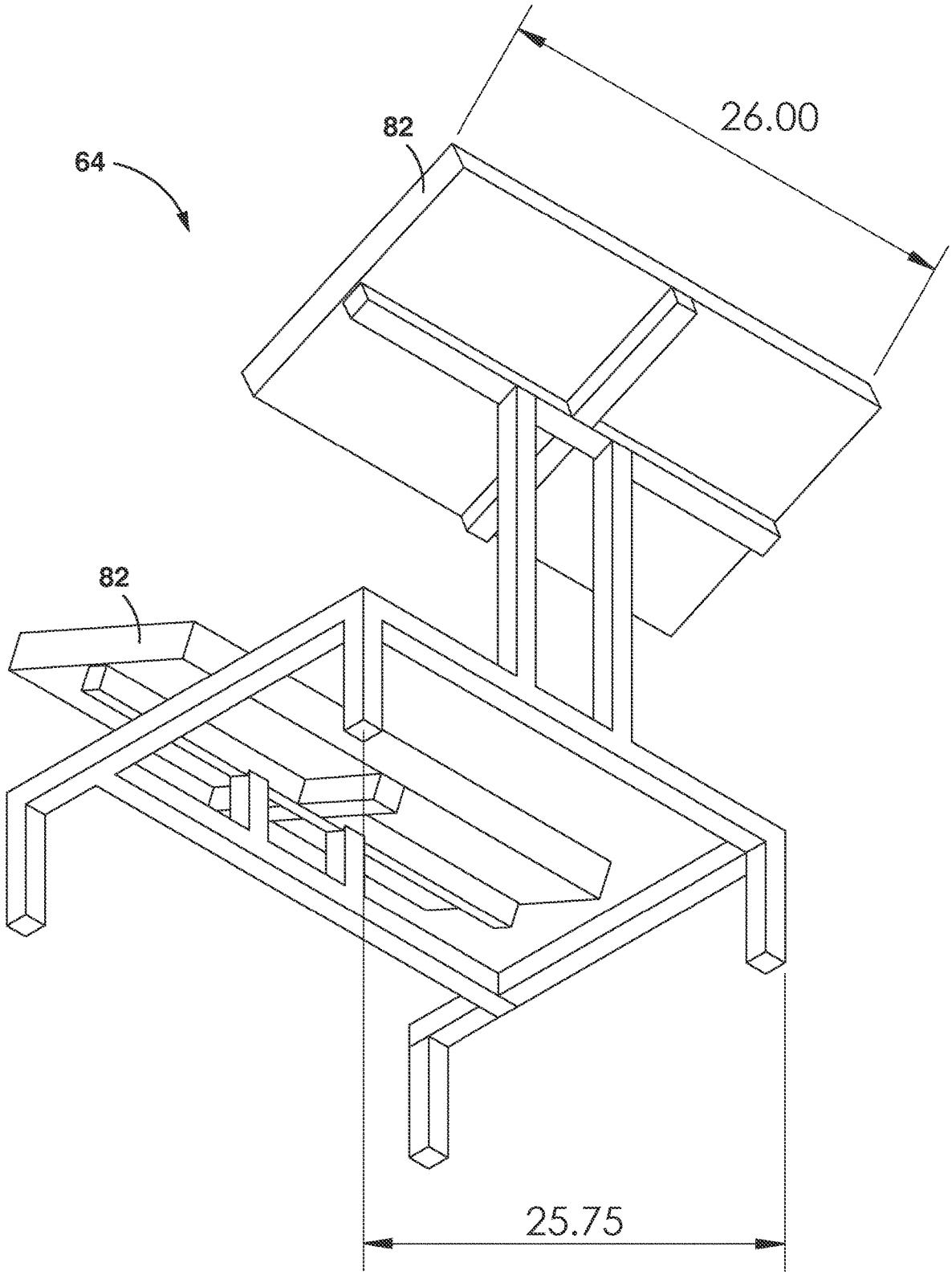
FIG. 19 is a bottom isometric view of a fourth embodiment of a prayer and meditation stand with seat.

Referring in particular to FIG. 11, a prayer and meditation stand 50, base 57, according to one embodiment measures, overall, about 28 to 56 inches wide by about 24 inches deep, not including a kneeler, by about 36.25 inches tall in the back 52 and about 32.25 inches tall in the front 51. The structurally suitable members are preferably affixed in vertical and horizontal fashion as shown and described in the figures. A base 57 may have the kneeler supports 62 affixed to the lower horizontal members thereof, near the bottom 56, on the left side 53 and right side 54, as shown in FIG. 1, kneeler 63 may be separate from the base 57, as shown in FIG. 3. The kneeler 63 may be horizontally slidingly coupled into the base 57 so that the kneeler 63 can be slid into the base 57 so that the kneeler 63 may be contained within the frame completely and slid out of the base 57 for use. A kneeler supports 62, which may be an angle or a channel, measures about 1.5 inches wide by about 24 inches long by about 0.125 inches in depth and serves as support for the kneeler 63 or the kneeler with seat 64. A base 57 may or may not have the shelf 58 affixed to, at least, the upper horizontal members, near the top 55, on the left side 53, right side 54 and or front 51 and back 52. A shelf 58 measures about 26 inches to 54 inches wide by about 22 inches deep and can be manufactured from material such as wood, steel, aluminum, stone, glass, acrylic, plastic or other solid, structurally suitable, material with a variable thickness from 0.1 inches to 1 inch. The tab 73 and the hook 89 as illustrated in FIG. 1 and FIG. 2 may or may not be affixed anywhere on a prayer and meditation stand 50 to serve as a means to store or hold religious paraphernalia such as a rosary, beads or other objects.

A prayer and meditation rail 59 may be provided that spans the front of the prayer and meditation stand 50. The prayer and meditation rail 59 can be manufactured from material such as wood, steel, aluminum, plastic or other solid or hollow, structurally suitable, material. A prayer and meditation rail 59 can also be made from/with padded foam and upholstery material, and measures about 28 inches wide by about 3 inches deep by about 2 inches in height. The prayer and meditation rail 59 is affixed to a base 57 by any means of joining such as channeling with a router, dovetailing, the use of fasteners, welding, or other suitable means of fastening as discussed herein. The purpose of a prayer and meditation rail 59 is to support the fore arms of the user or other user paraphernalia and is preferably fixed in place. Let it be noted the use of various types of material and padding can lead to various adjustments in overall height of a prayer and meditation stand 50.

One or a plurality of variable height votive candle holders 60 may be provided that span between the left and right side of the prayer and meditation stand 50. The votive candle holders 60 can be manufactured from material such as stone, glass, acrylic, wood, steel, aluminum, plastic or other solid, structurally suitable, material. A votive candle holder 60 may or may not have one or more recessed or elevated areas to contain a votive candle, icon, or other paraphernalia. A votive candle holder 60 preferably measures about 26 inches wide by about 4 inches deep and can be about 3 inches to 5 inches in height. A votive candle holder 60 is affixed to a base 57 by any means of joining such as dovetailing, the use of fasteners, welding, or other suitable means of fastening as discussed herein. Alternatively, the holders 60 may be movable fore and aft, to optionally allow the user to configure the location of the items held thereon. This may be achieved in a variety of ways, including, for example coupling the holders to the base 57 with rails or slides. The purpose of a votive candle holder 60 serves as a means to hold votive candles, icons, or other paraphernalia.

Figure 4:
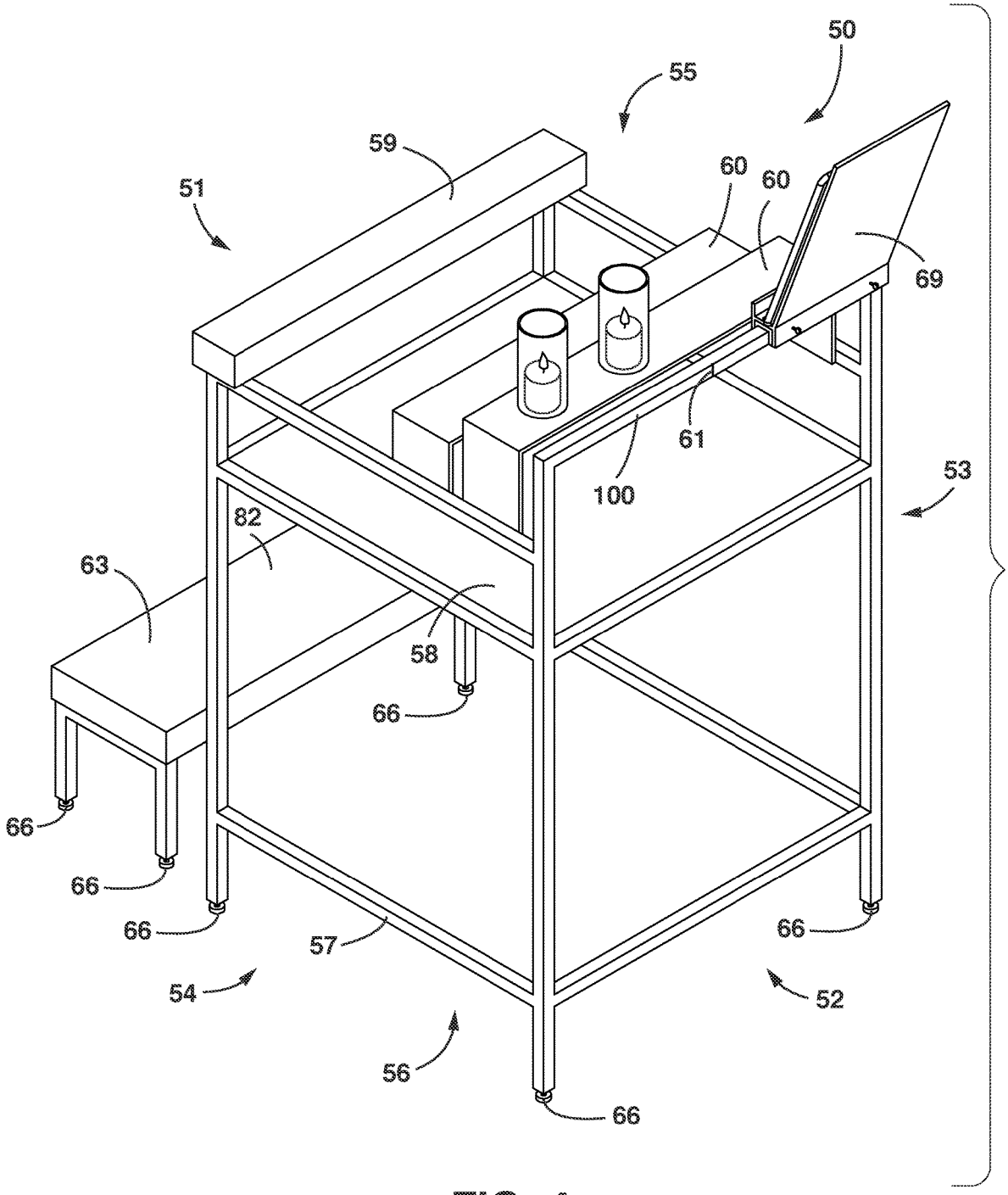
FIG. 4 is a back isometric view of a second embodiment of a prayer and meditation stand.
Figure 5:
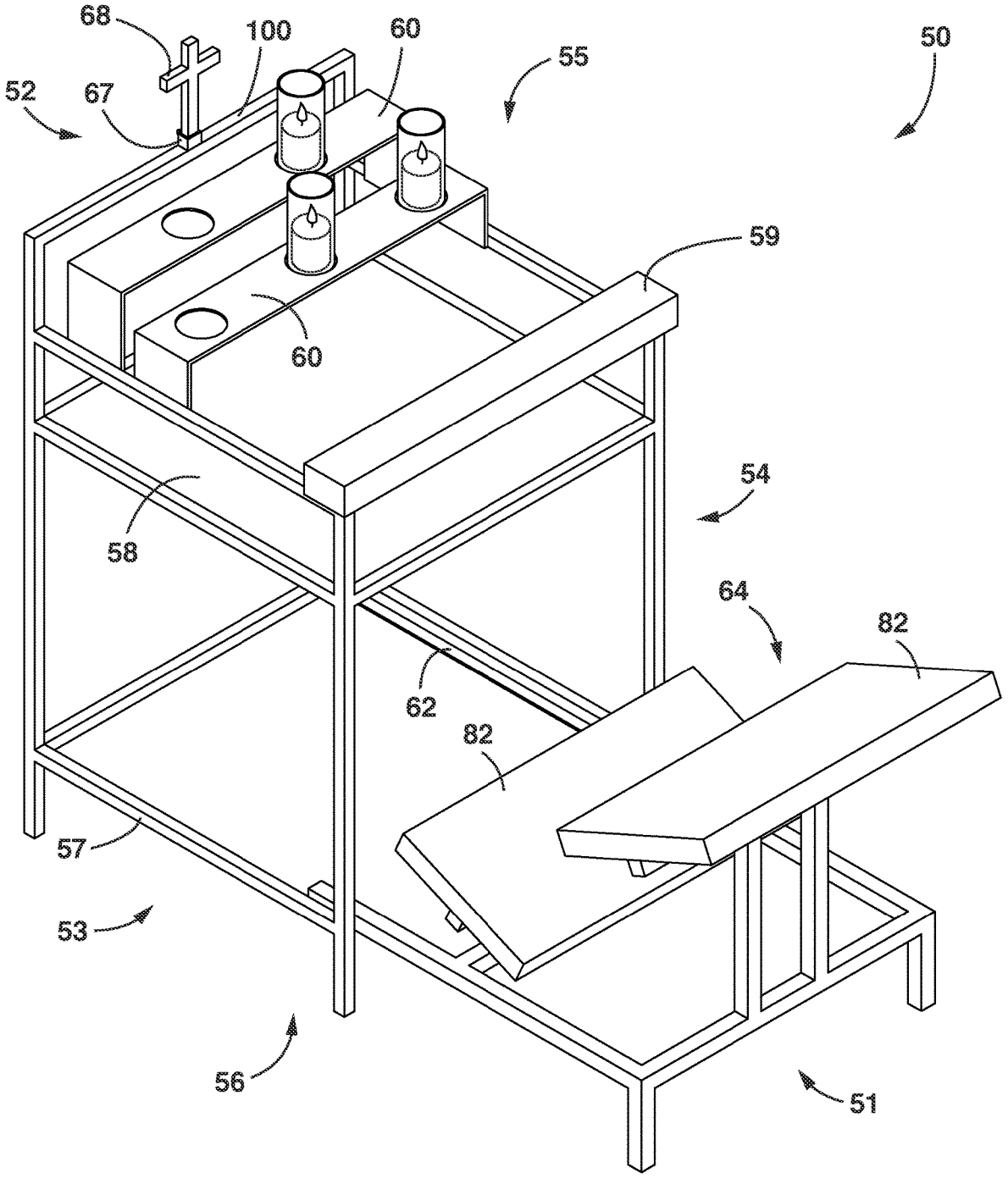
FIG. 5 is a front isometric view of the third embodiment of a prayer and meditation stand.
Figure 6:
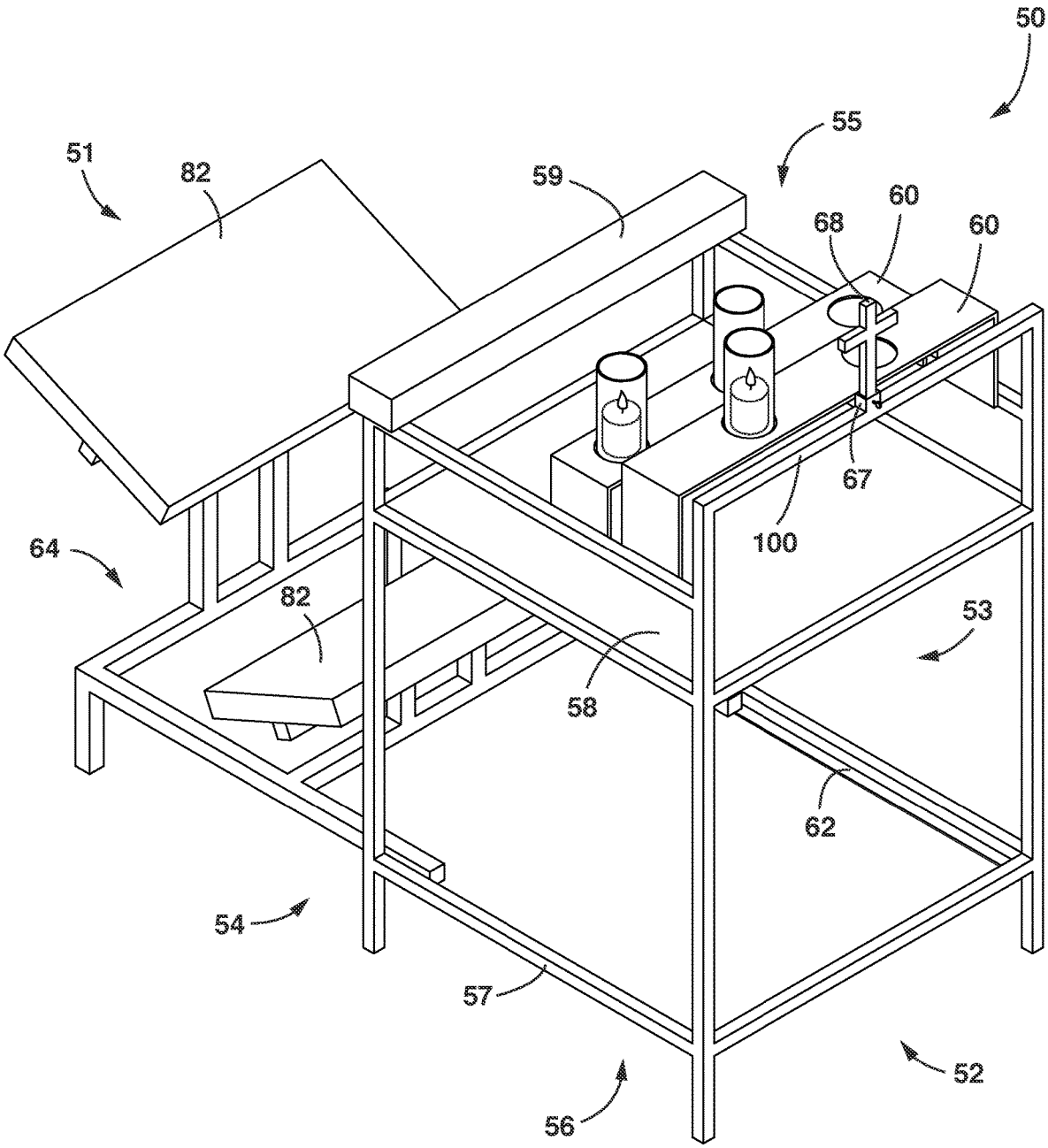
FIG. 6 is a back isometric view of a third embodiment of a prayer and meditation stand.
Figure 7:
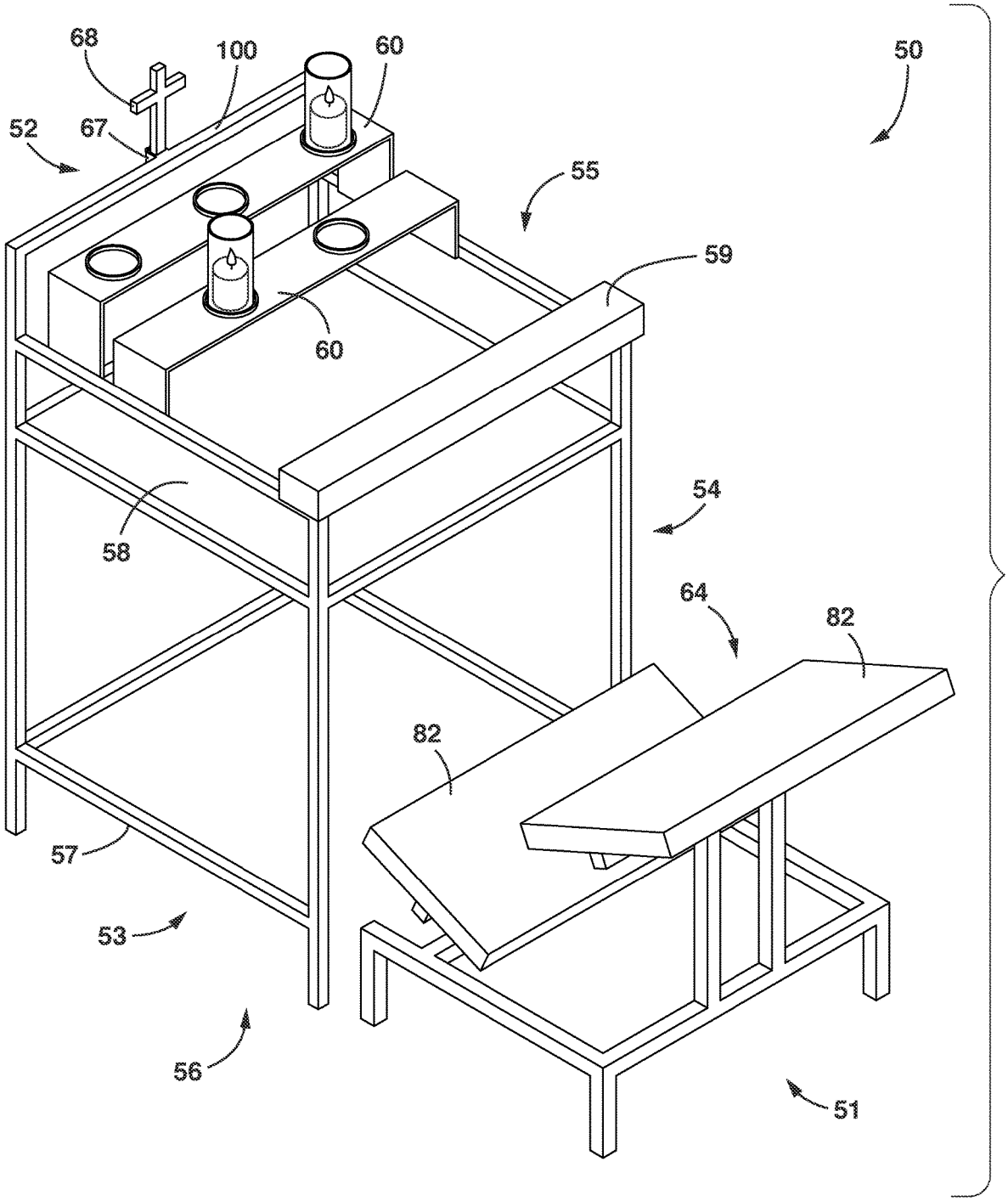
FIG. 7 is a front isometric view of the fourth embodiment of a prayer and meditation stand.
Figure 8:
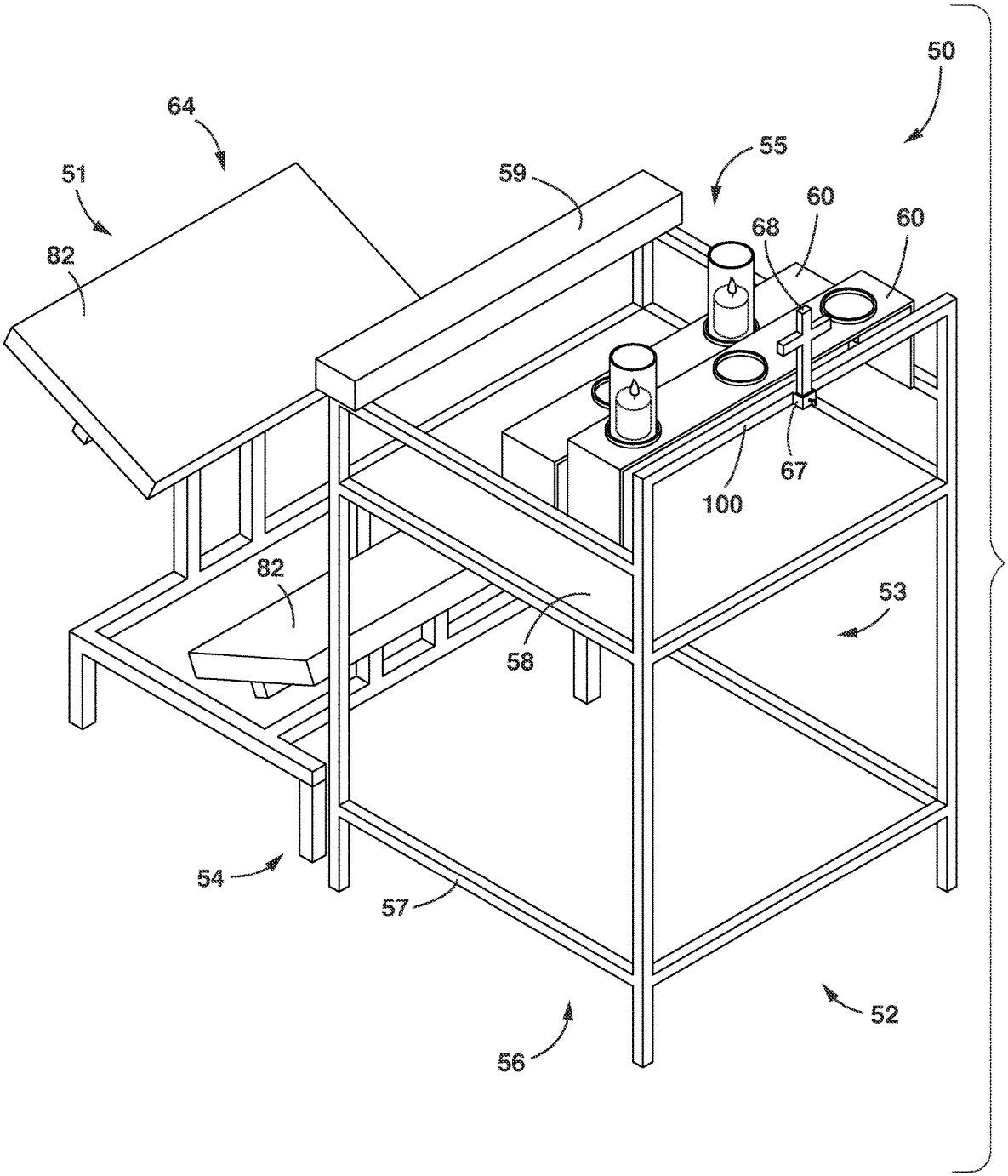
FIG. 8 is a back isometric view of a fourth embodiment of a prayer and meditation stand.
Figure 10:
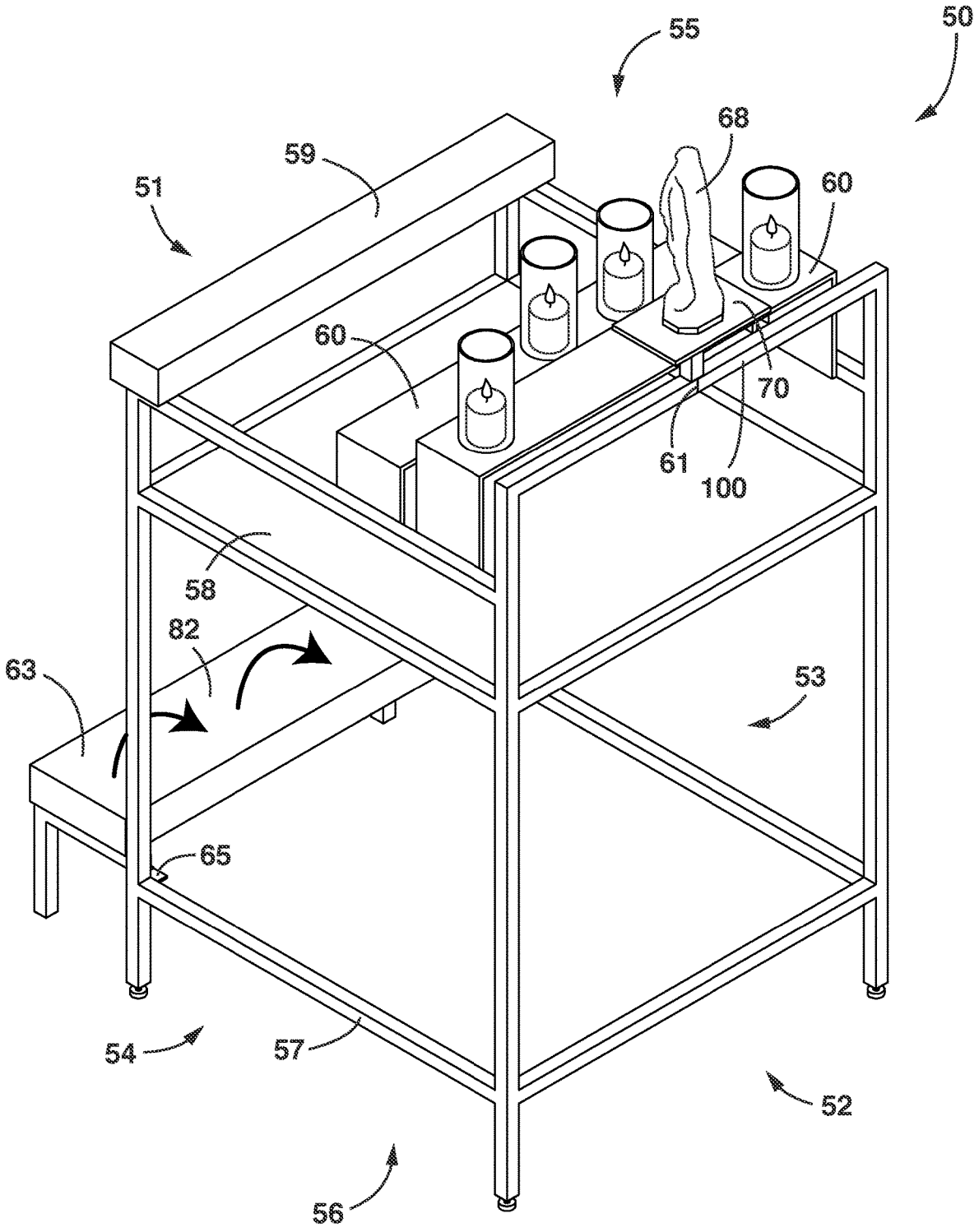
FIG. 10 is a back isometric view of a fifth embodiment of a prayer and meditation stand.

The upper most accessory holder frame rail at rear of the base 57 may include an alignment mark 61 as illustrated on FIG. 4 and FIG. 10, which can be recessed, on the surface or raised in nature to designate the center of a prayer and meditation stand 50 and serves as a means for centrally locating icons or other objects. The alignment mark 61 can be located at any location on a prayer and meditation stand 50 to add to a user experience.

Figure 9:
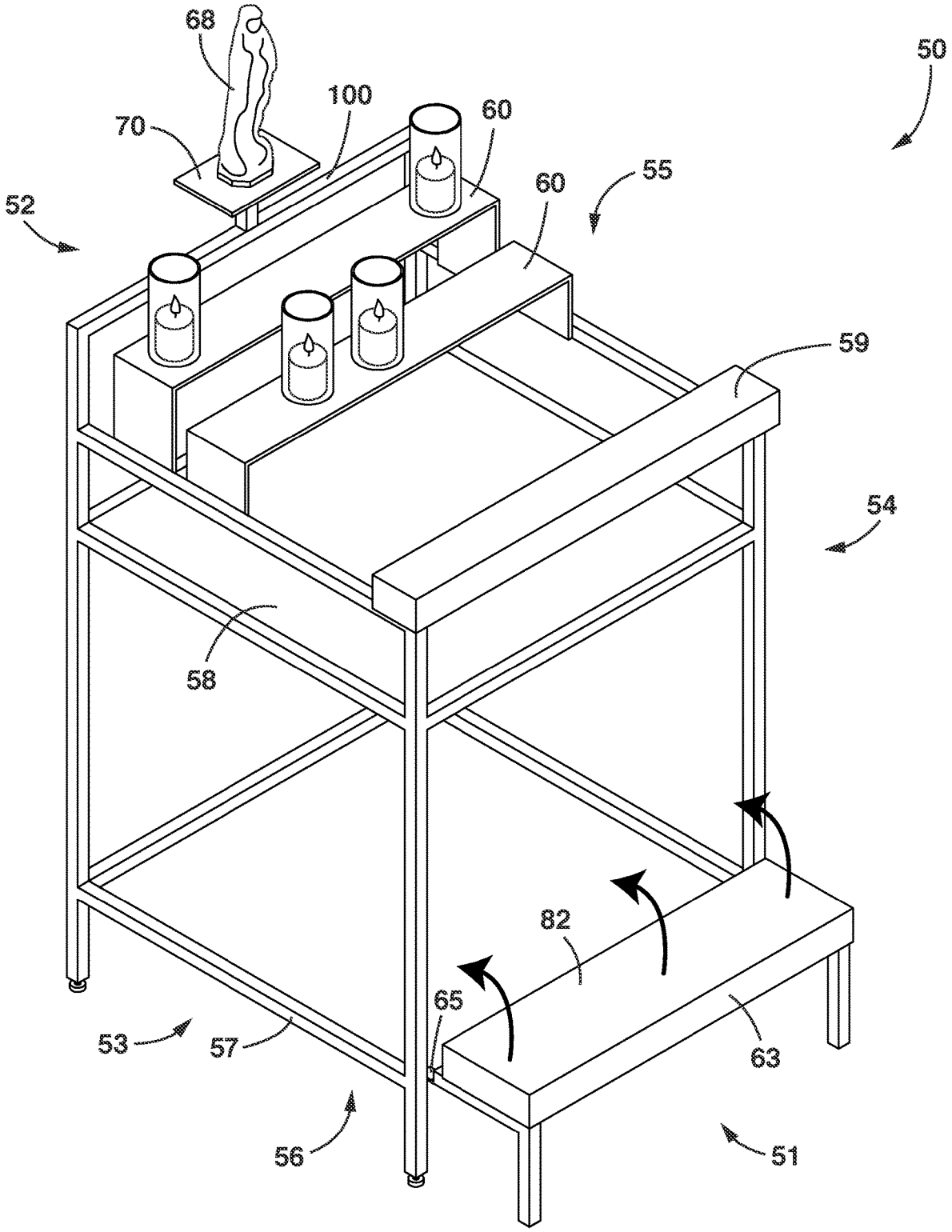
FIG. 9 is a front isometric view of the fifth embodiment of a prayer and meditation stand.
Figure 61:
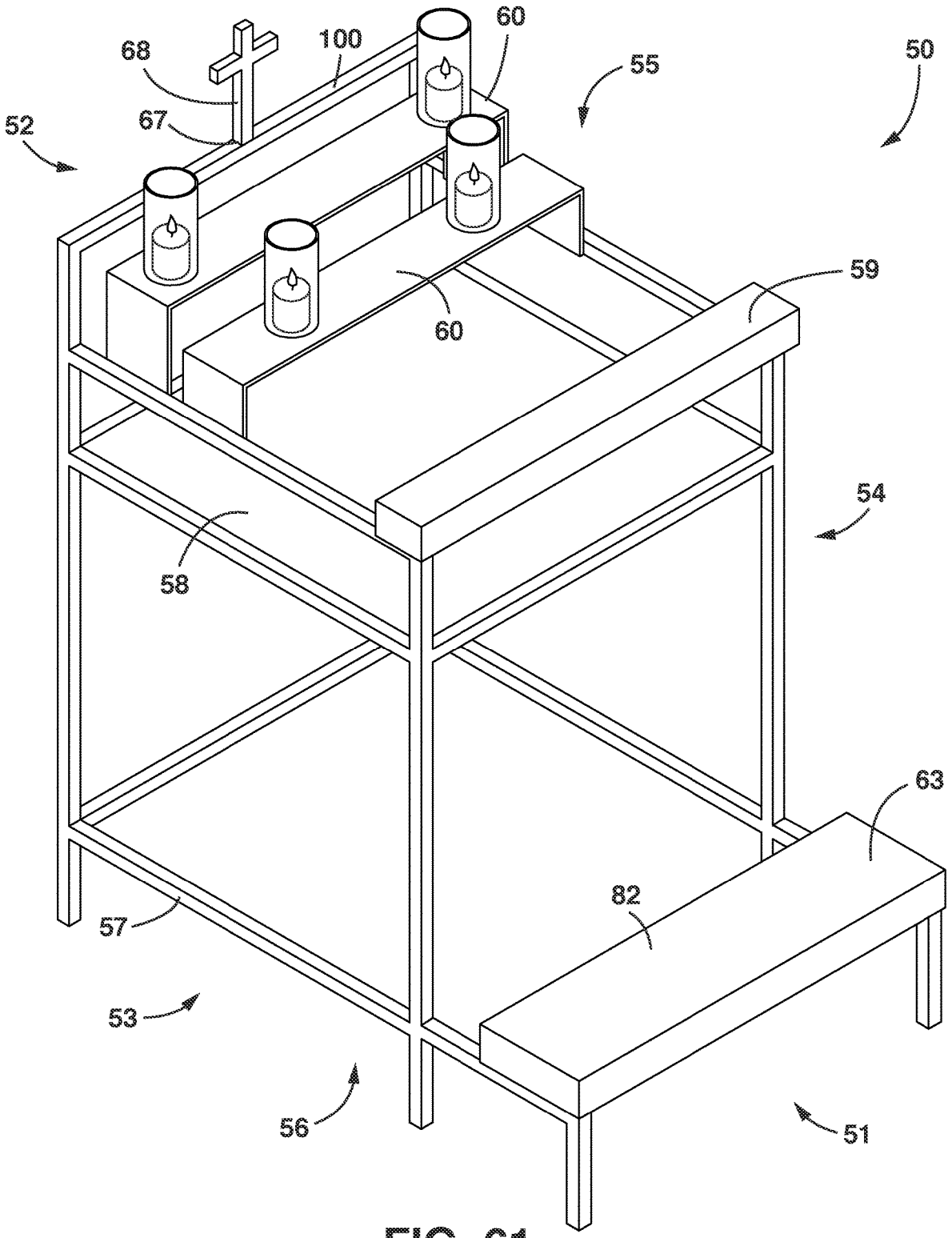
FIG. 61 is a front isometric view of the eighteenth embodiment of a prayer and meditation stand.

The kneeler 63 as illustrated and in particular as illustrated in FIGS. 12 through 15 can be manufactured from material such as wood, steel, aluminum, plastic or other solid or hollow, structurally suitable, material. In at least one embodiment 1.0 inch square material can be used. Members can be fastened together by any means of joining such as dovetailing, the use of fasteners, welding, or other suitable means of fastening as discussed herein. The human contact surfaces of a kneeler 63 can be padded with foam and upholstery material or be of a hard surface material. A kneeler 63 may measure about 26 inches wide by about 16 inches deep by about 5.25 inches in height overall. In one embodiment a kneeler 63 has two support legs to the rear of the human contact surface measuring about 4 inches in height and a horizontal member measuring about 16 inches in length which supports the load of a kneeler 63 and user, by resting and being able to front 51 to back 52 slide on a kneeler support 62 affixed to a base 57 of a prayer and meditation stand 50. In another embodiment a kneeler 63 has four support legs to the fore and rear of the human contact surface measuring about 26 inches in length by about 8 inches in depth by about 4 inches in height. In yet another embodiment the hinge 65 can be employed as illustrated in FIGS. 9 and 10 to support the fore of kneeler 63 and serve as a means to articulate kneeler 63 for storage under base 57. In yet another embodiment a kneeler 63 can be permanently affixed to a base 57 in a suitable fashion as illustrated in FIG. 61 to name one example. Let it be noted the use of various types of material and padding can lead to various adjustments in overall height of a kneeler 63.

Figure 62:
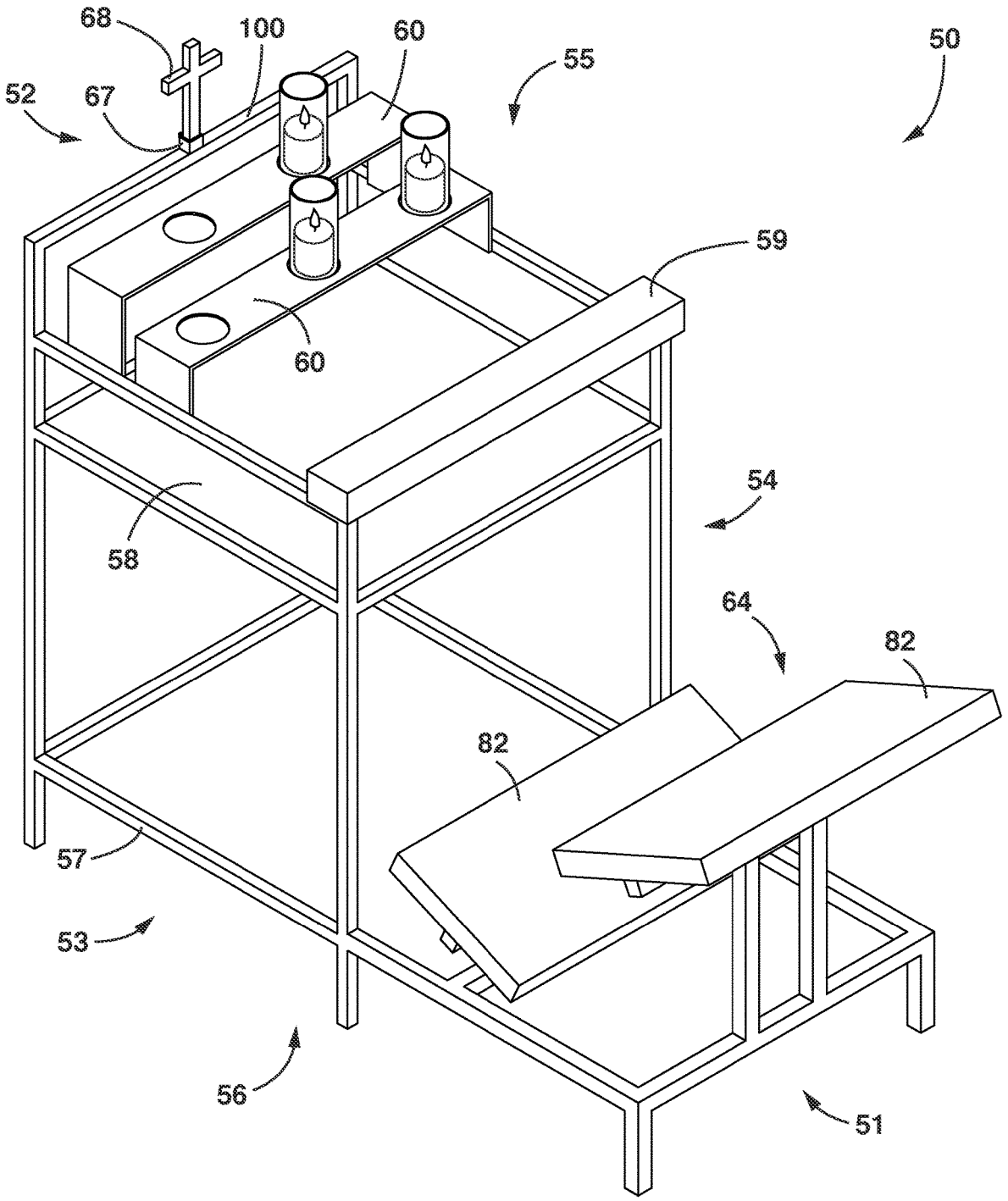
FIG. 62 is a front isometric view of the nineteenth embodiment of a prayer and meditation stand.
Figure 63:
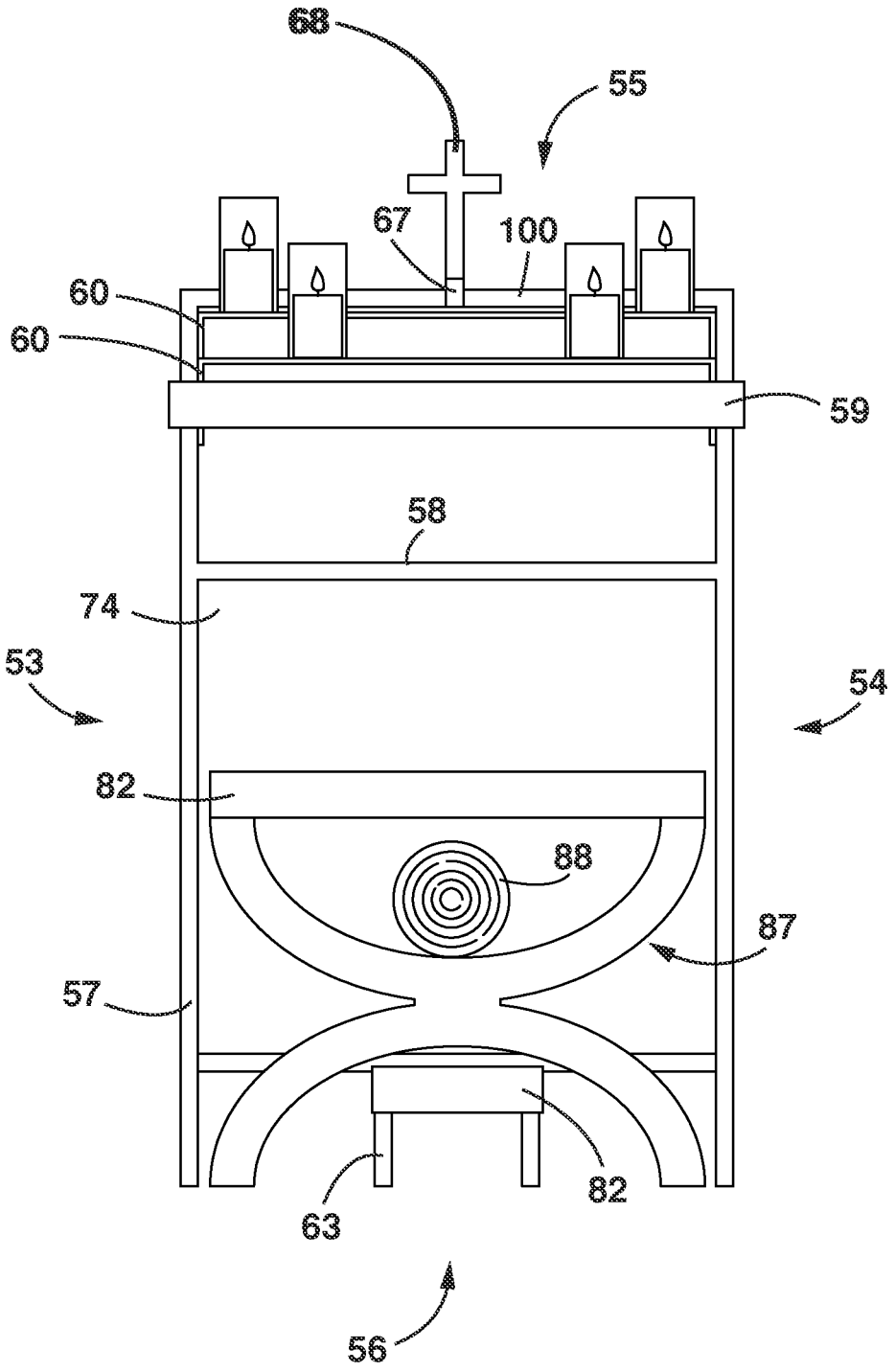
FIG. 63 is a front isometric view of the twentieth embodiment of a prayer and meditation stand.
Figure 64:
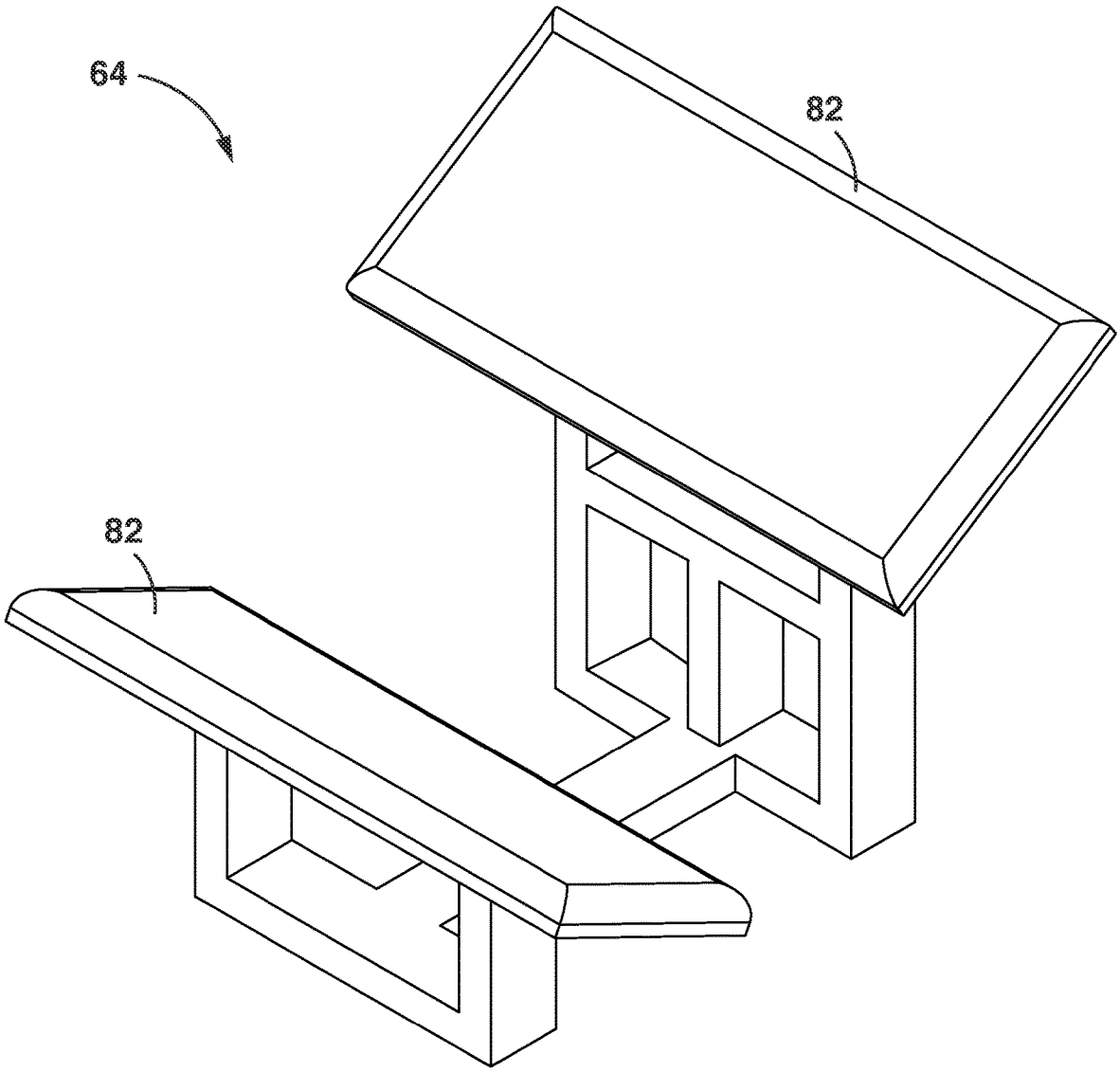
FIG. 64 is a top isometric view of the fifth embodiment of a stand with seat.
Figure 65:
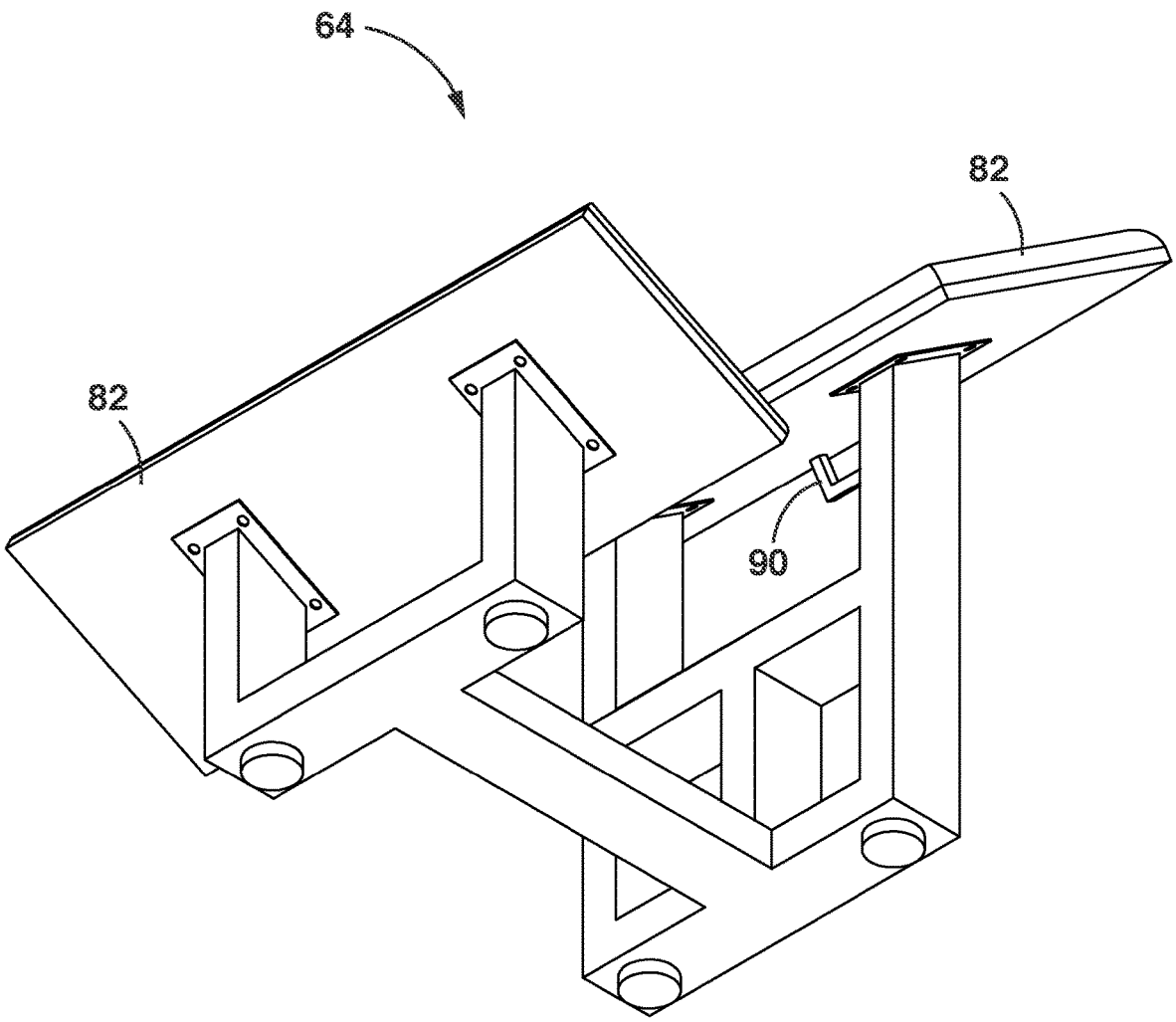
FIG. 65 is a bottom isometric view of a fifth embodiment of a stand with seat.
Figure 66:
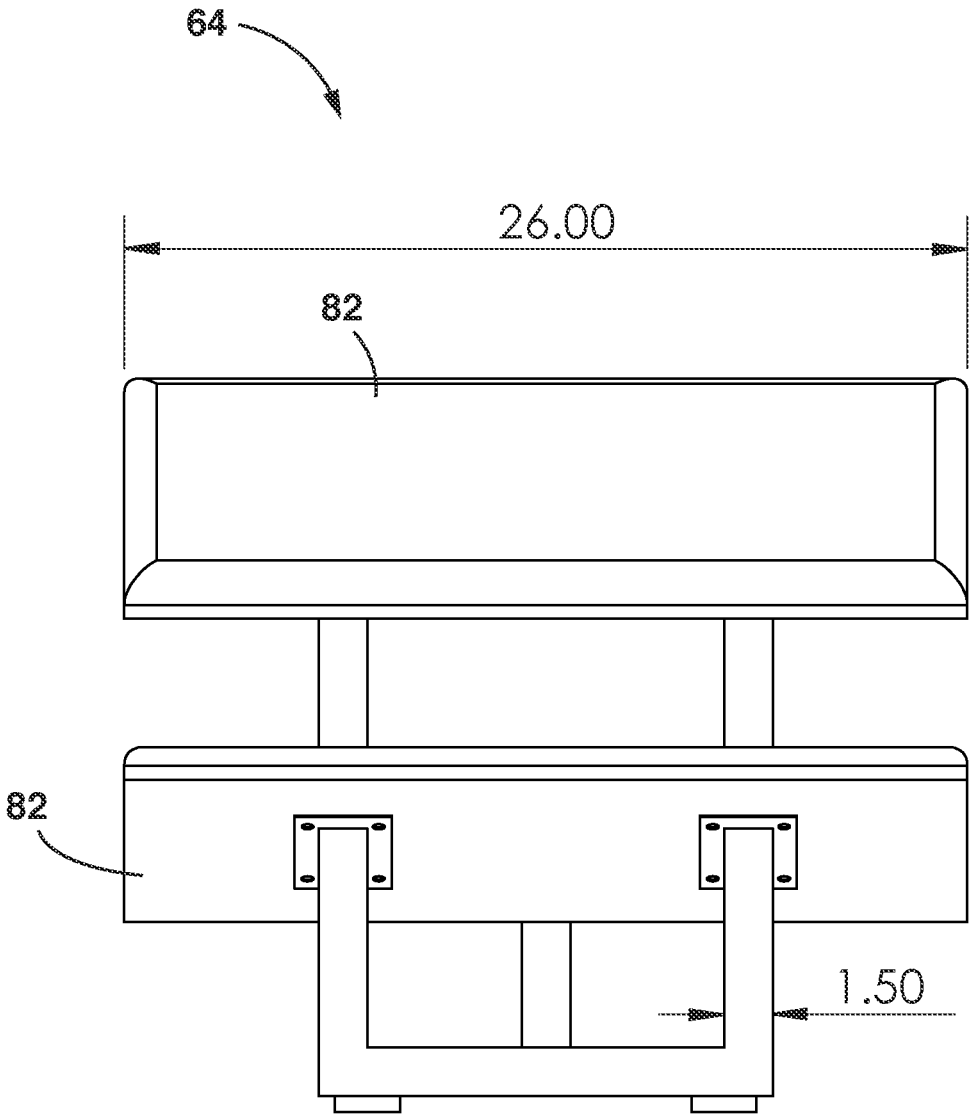
FIG. 66 is a front elevation view of FIG. 64.
Figure 67:
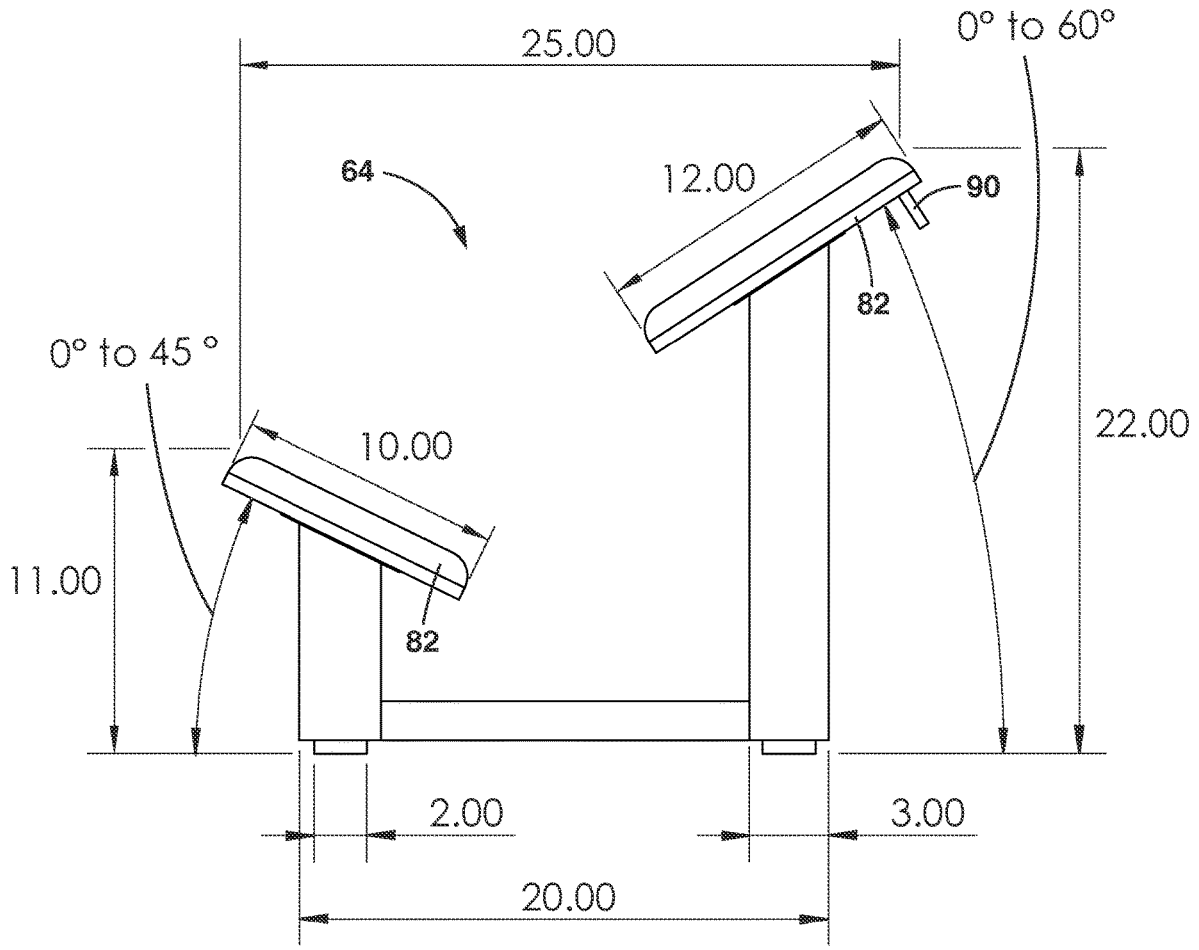
FIG. 67 is a right side elevation view of FIG. 64.
Figure 68:
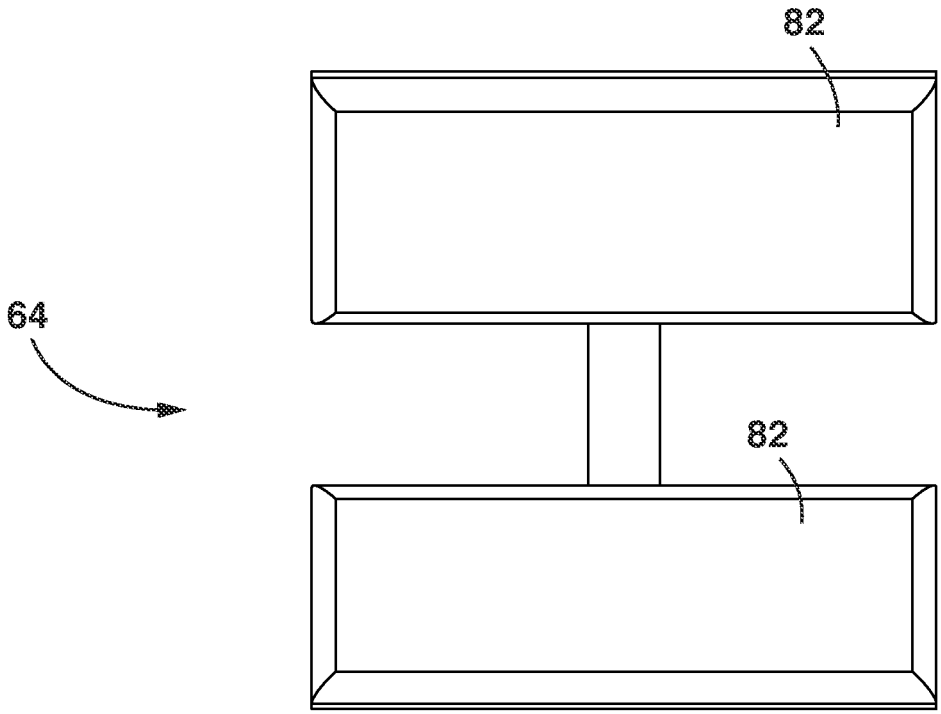
FIG. 68 is a top plan view of FIG. 64.

The kneeler with seat 64 as illustrated in FIGS. 16 through 19 may be provided that can be manufactured from material such as wood, steel, aluminum, plastic or other solid or hollow, structurally suitable, material. In at least one embodiment 1.0 inch square material can be used. Members can be fastened together by any means of joining such as dovetailing, the use of fasteners, welding or other suitable means of fastening as discussed herein. The human contact surfaces of a kneeler with seat 64 can be padded with foam and upholstery material or be of a hard surface material. A kneeler with seat 64 measures about 26 inches wide by about 25 inches deep by about 22 inches in height overall. In one embodiment a kneeler with seat 64 has two support legs to the rear of the human contact surface measuring about 4 inches in length and a horizontal member measuring about 25 inches in depth which supports the load of a kneeler with seat 64 and user by resting and being able to front 51 to back 52 slide on a kneeler support 62 affixed to a base 57 of a prayer and meditation stand 50. In another embodiment a kneeler with seat 64 measures about 26 inches in width by about 18.5 inches in depth, at the base, by about 22 inches in height and has four support legs to the fore and rear of the human contact surfaces measuring about 4 inches in height. The human contact surfaces can have a pitch of about 24 degrees and may or may not be adjustable to accommodate a user's comfort. In yet another embodiment a kneeler with seat 64 can be permanently affixed to a base 57 in a suitable fashion as illustrated in FIG. 62 to name one example. Let it be noted the use of various types of material and padding can lead to various adjustments in overall height of a kneeler with seat 64.

Referring to FIG. 64 through FIG. 69 the fifth embodiment of the kneeler with seat 64 may be provided that can be manufactured from material such as wood, steel, aluminum, plastic or other solid or hollow, structurally suitable, material. In at least one embodiment 1.5 inch by 3 inch rectangular material can be used. Members can be fastened together by any means of joining such as dovetailing, the use of fasteners, welding, or other suitable means of fastening as discussed herein. The human contact surfaces of a kneeler with seat 64 can be padded with foam and upholstery material or be of a hard surface material. A kneeler with seat 64 measures about 26 inches wide by about 25 inches deep by about 22 inches in height overall. The human contact surfaces are attached to the tube frame with plates measuring about 3 inch wide by 5 inch long by about 0.6 inch thick. The lower kneeling surface slopes at about 26 degrees and the upper seat surface slopes at about 33 degrees. Other angles from 0 to 60 degrees can also be used to accommodate a person using a prayer and meditation stand 50. Structural bracing may or may not be present to accommodate types of materials being used and the size of a person using a prayer and meditation stand 50. A handle 90 may be affixed to the back bottom portion of the seat and is reasonably configured at allow a person to use their hand to move a kneeler and seat 64 about a floor area. Support feet made of natural, synthetic, or composite material measure about 2 inches in diameter and are affixed to the bottom of a kneeler with seat 64 to act as a preventative to damaging floor surfaces.

Referring to FIGS. 3 and 4 illustrating the extenders 66 which are a screw type leveling adjuster, with an adjustment range of about 1.25 inches, that can be mounted to the bottom of the legs on the base 57, kneeler 63 and also kneeler with seat 64. The circular pad, of such, being about 1 inch in diameter having a nonabrasive surface on the side facing the floor.

The prayer and meditation stand 50 may include an accessory holder frame rail 100, as shown in the accompanying Figs. The frame rail 100 may extend upward from the top of the stand 50 so that the rail 100 is at or above the elevation of the votive candle holder 60. Preferably, the rail 100 is located distally relative to the votive candle holder 60 and provides a base to which accessories 68 may be connected thereto, such as via accessory holder 67. The lower portion of accessory holder 67 may or may not be configured as an attached open receptacle. That is, the accessory holder 67 may be an open socket that is permanently attached to the accessory holder frame rail as shown in FIGS. 5-8, to receive interchangeable accessories, such as icons or the accessory shelf as shown in FIGS. 9-10 and 22. The accessory holder as illustrated throughout FIGS. 1 through 36, and 61-63 may be configured as an icon holder 67 and can be manufactured from material such as wood, steel, aluminum, stone, glass, acrylic, plastic or other solid, structurally suitable, material. In this form, the accessory/icon holder 67 measures about 1.00 inch wide by about 1.00 inch in depth by about 1 inch tall overall and has a hollow inside space measuring about 0.8 inches wide by about 0.8 inches deep by about 1 inch in height to act as an insert space for the lower portion of the icon 68 or other paraphernalia. An accessory holder 67 may or may not have a fastening means 71, such as a thumb screw to name one example, or a recessed set screw to name another example to secure itself to the lower portion of the icons 68 or other paraphernalia/accessories. An accessory holder 67 can also be a connection means such as a permanent or re-positionable adhesive, of chemical or tape nature, or other means as particularly illustrated in FIG. 9, FIG. 10, and FIG. 61. Such as permanently being affixed to a base 57 and/or the frame rail 100 by welding. The lower portion of an accessory holder 67 may or may not be configured in a "H" configuration, that is, having a channel at the bottom that fits over the frame rail 100 and at least one element extending upward from the channel, as shown. In this instance, the holder 67 preferably measuring about 0.8 inches wide across the base and about 1.5 inches in depth with a height of about 1.0 inch. The inside of its lower opening may or may not be wrapped with the liner 72 affixed with an adhesive or by other means. A liner 72 is made from neoprene rubber measuring about 0.125 in thickness or other flexible type of material suitable for cushioning between component parts. One or more of the fastening means 71 may or may not be present to affix an icon 68 to a base 57 by a mechanical screw type and threaded means or other method suitable for securing components in their respective place. The attachment methods for the accessory holder 67 allows for accessories to be interchangeable.

Figure 23:
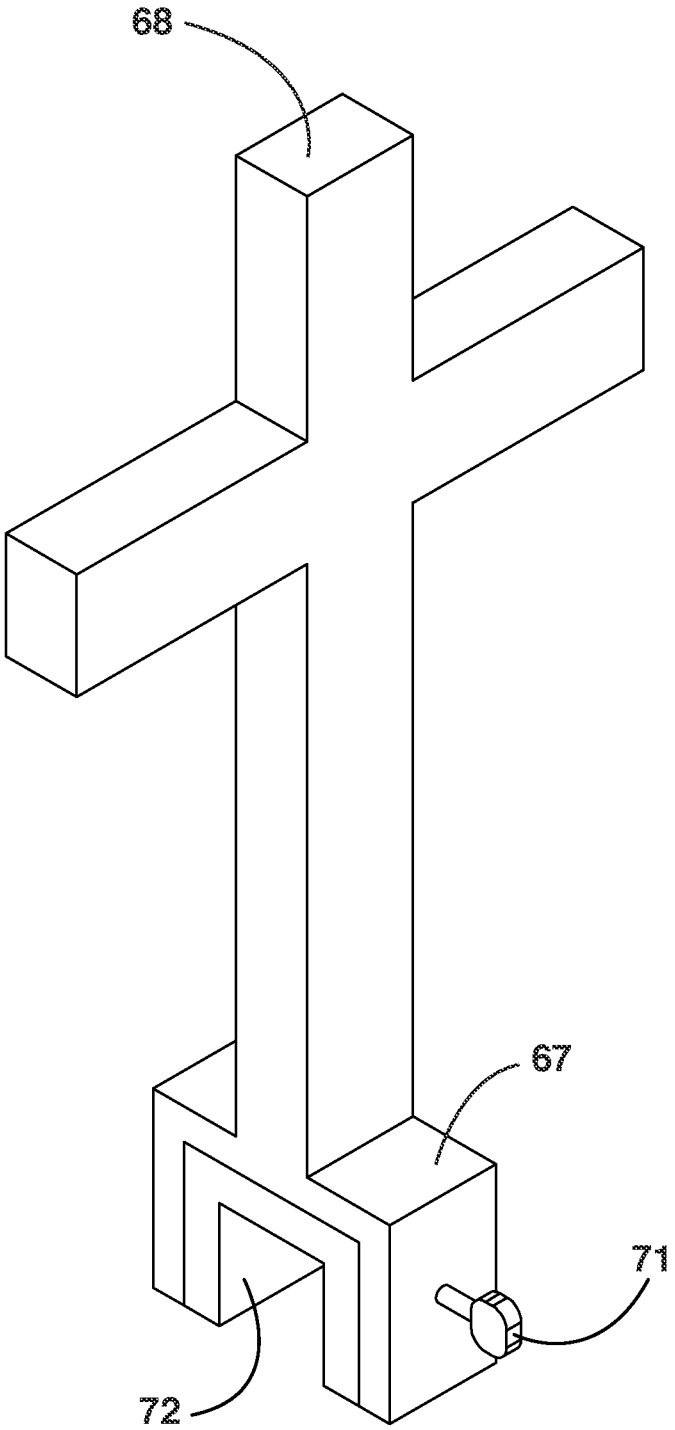
FIG. 23 is the front isometric view of one alternative icon.
Figure 24:
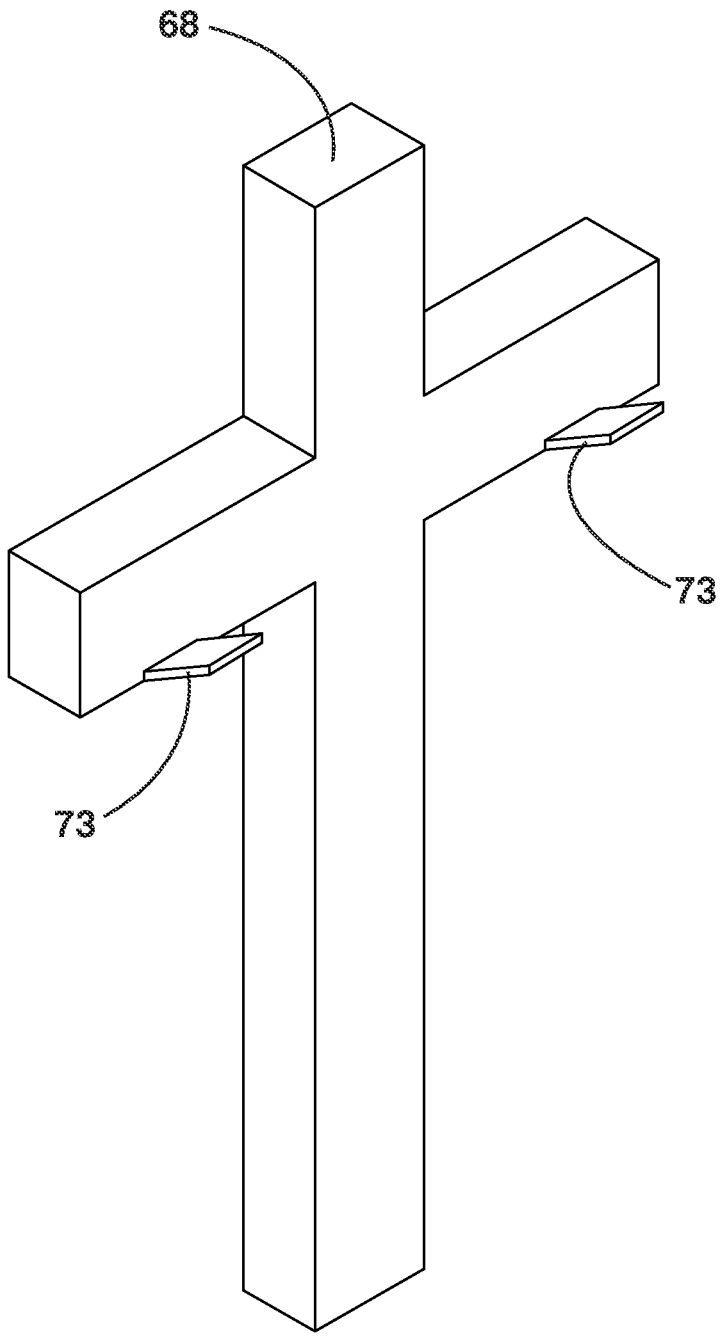
FIG. 24 is a front isometric view of the second embodiment of an alternative icon.
Figure 25:
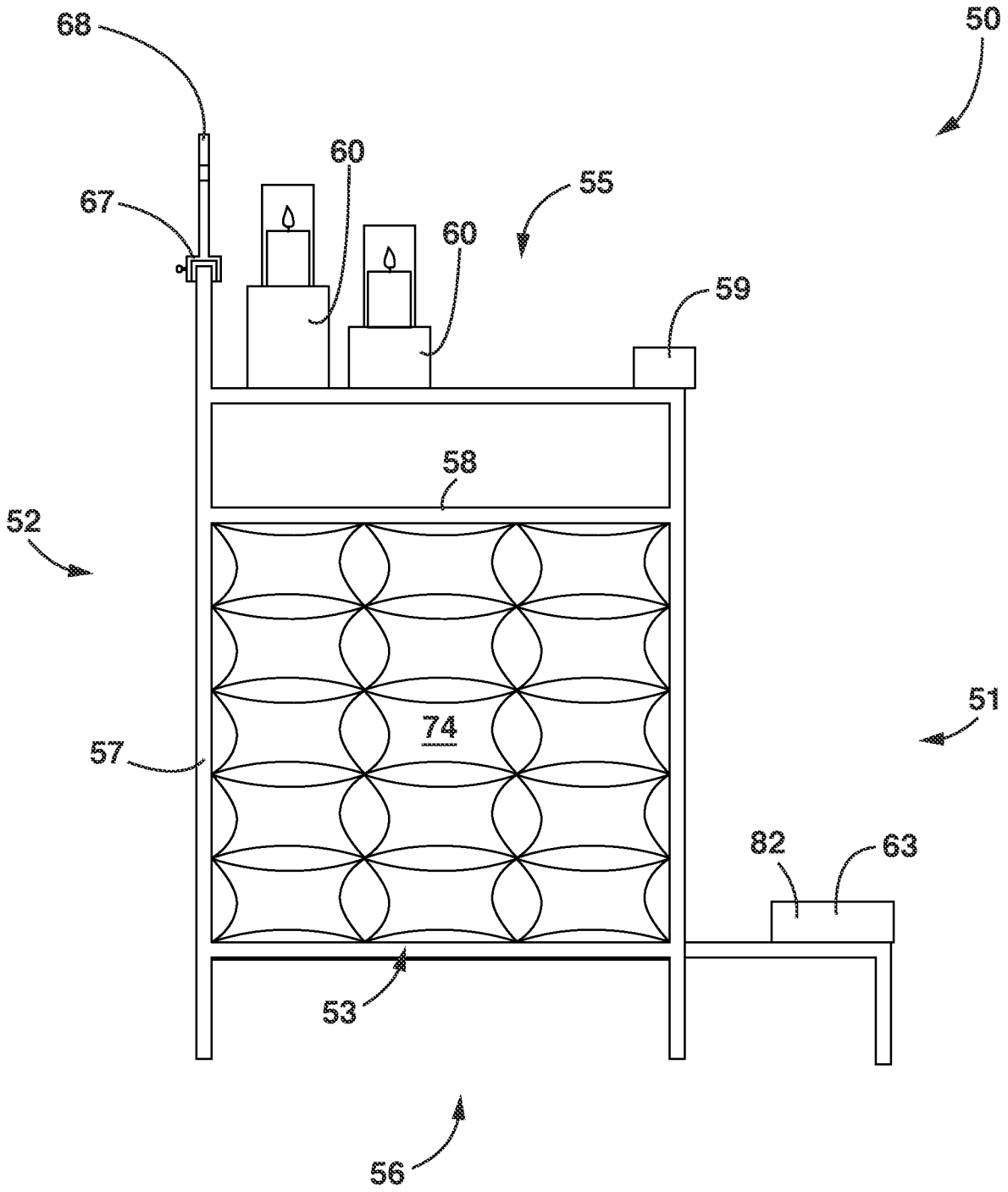
FIG. 25 is a left side elevation of the sixth embodiment of a prayer and meditation stand.
Figure 26:
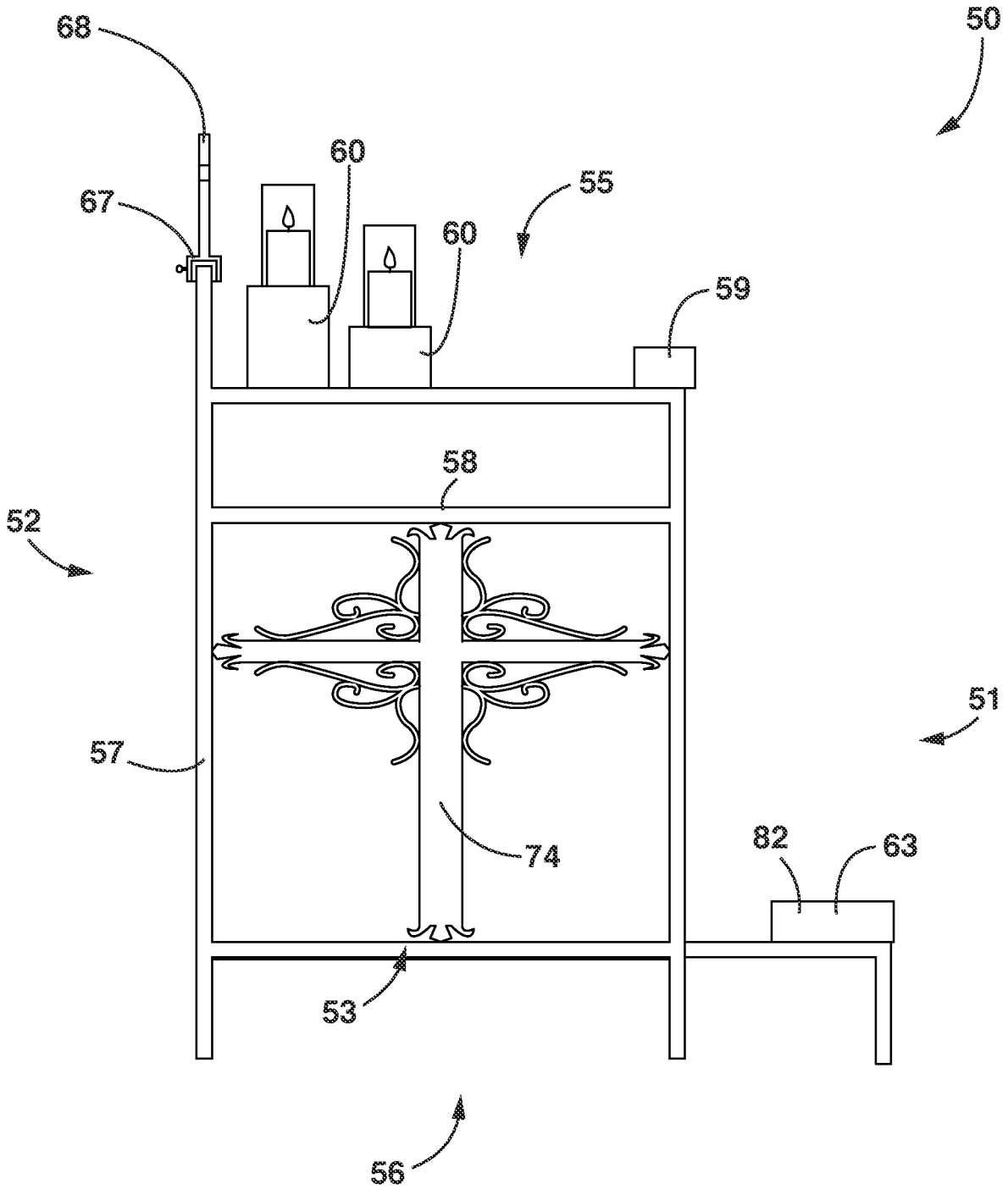
FIG. 26 is a left side elevation of the seventh embodiment of a prayer and meditation stand.
Figure 27:
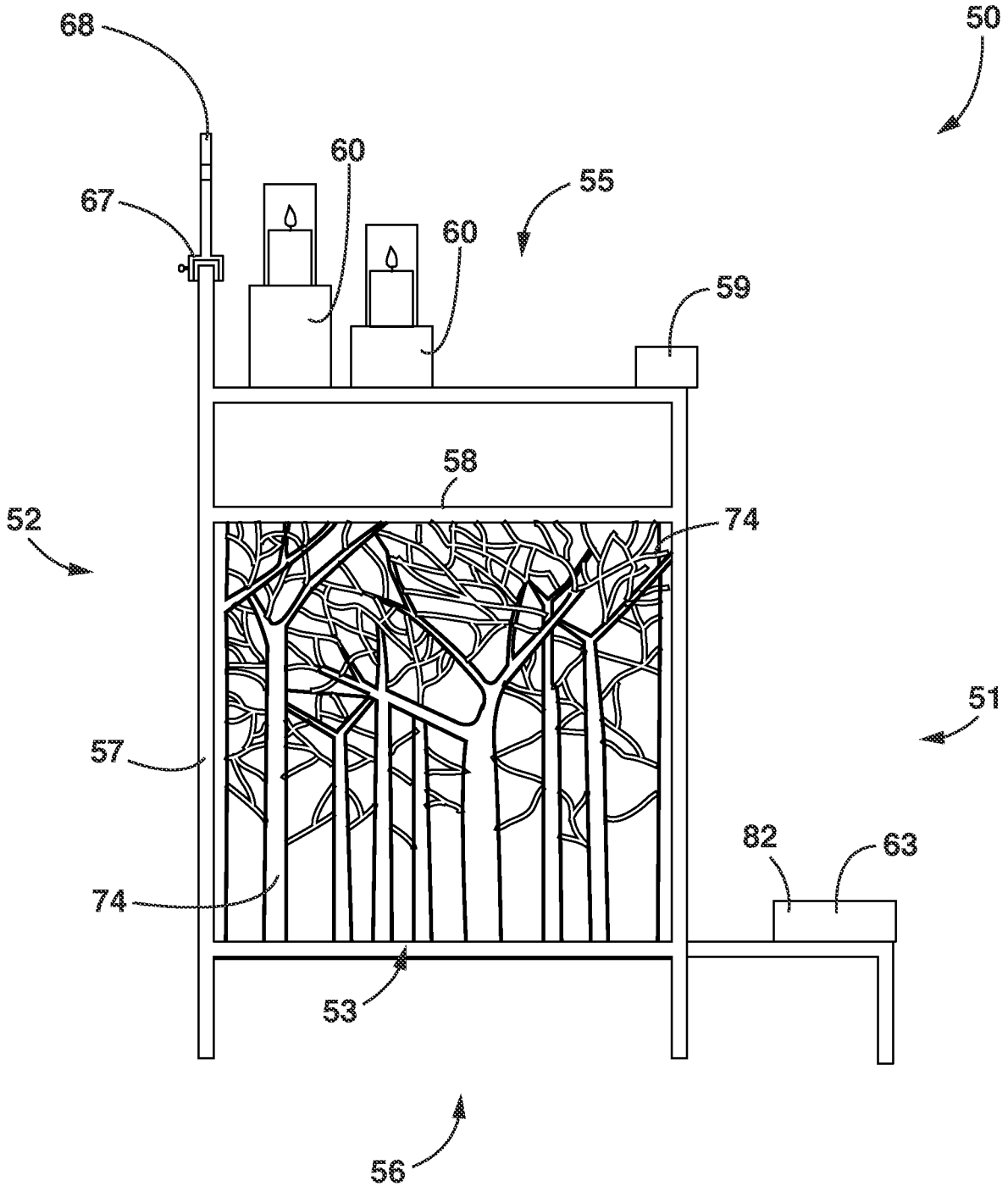
FIG. 27 is a left side elevation of the eighth embodiment of a prayer and meditation stand.
Figure 28:
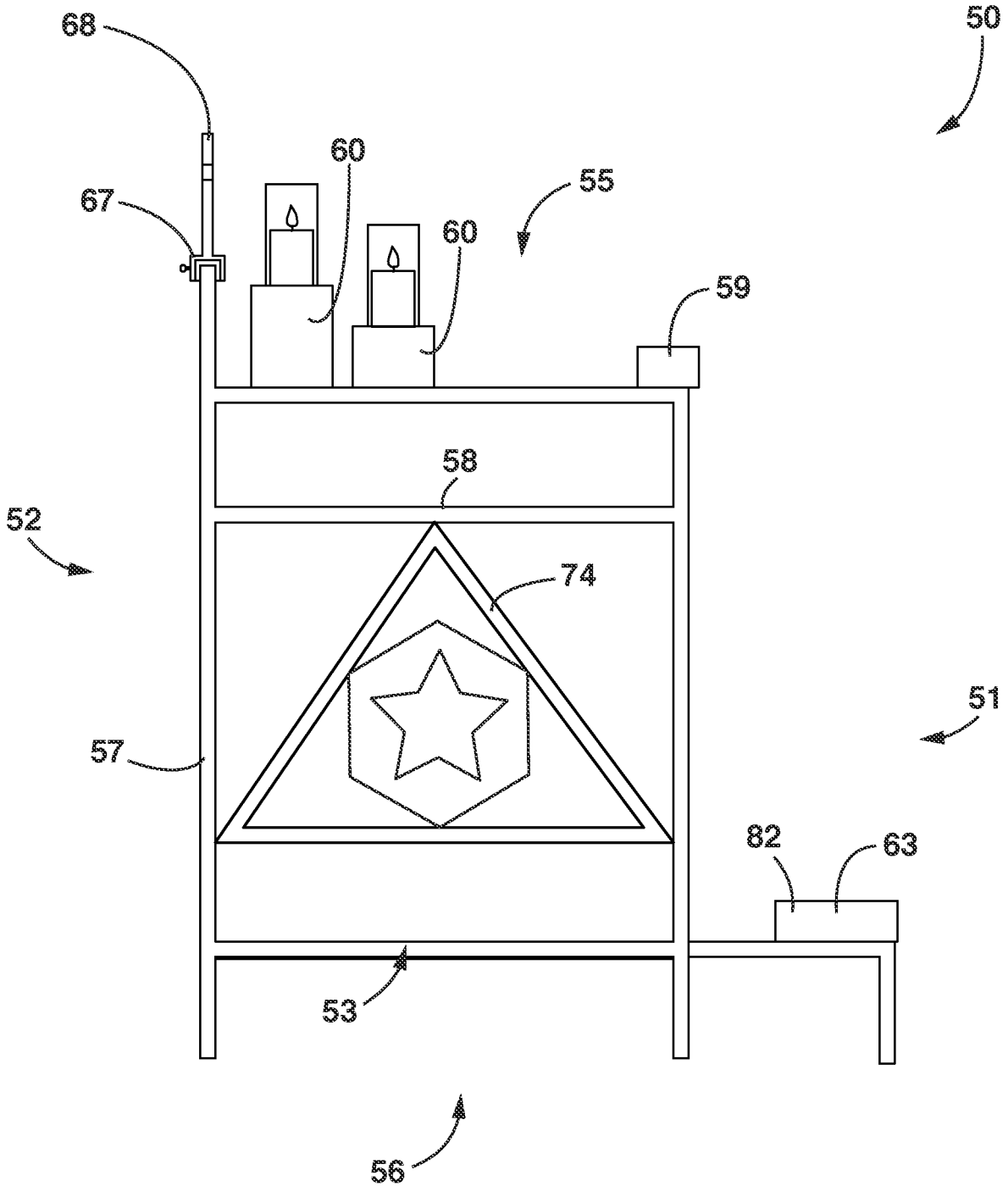
FIG. 28 is a left side elevation of the ninth embodiment of a prayer and meditation stand.
Figure 29:
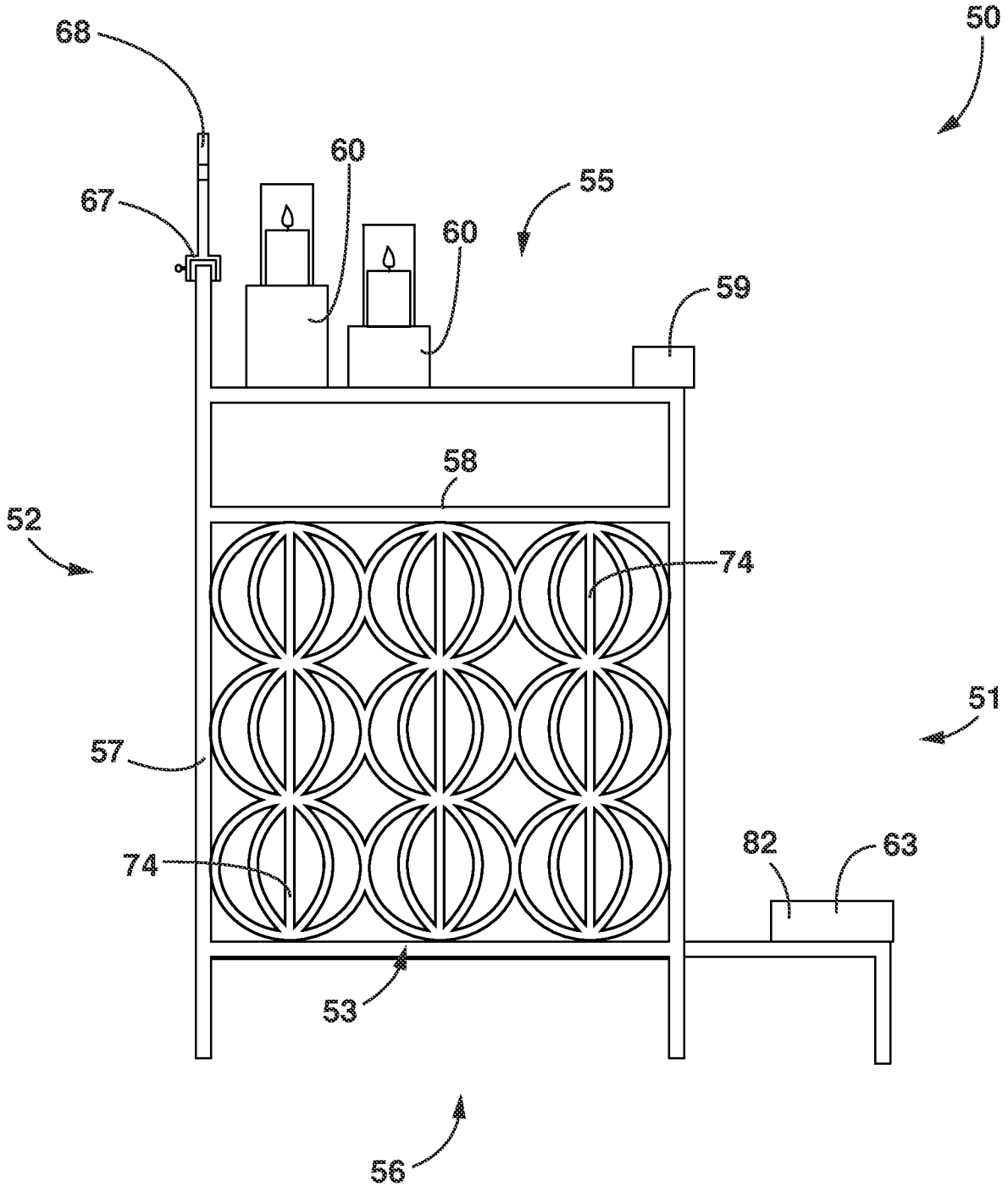
FIG. 29 is a left side elevation of the tenth embodiment of a prayer and meditation stand.
Figure 30:
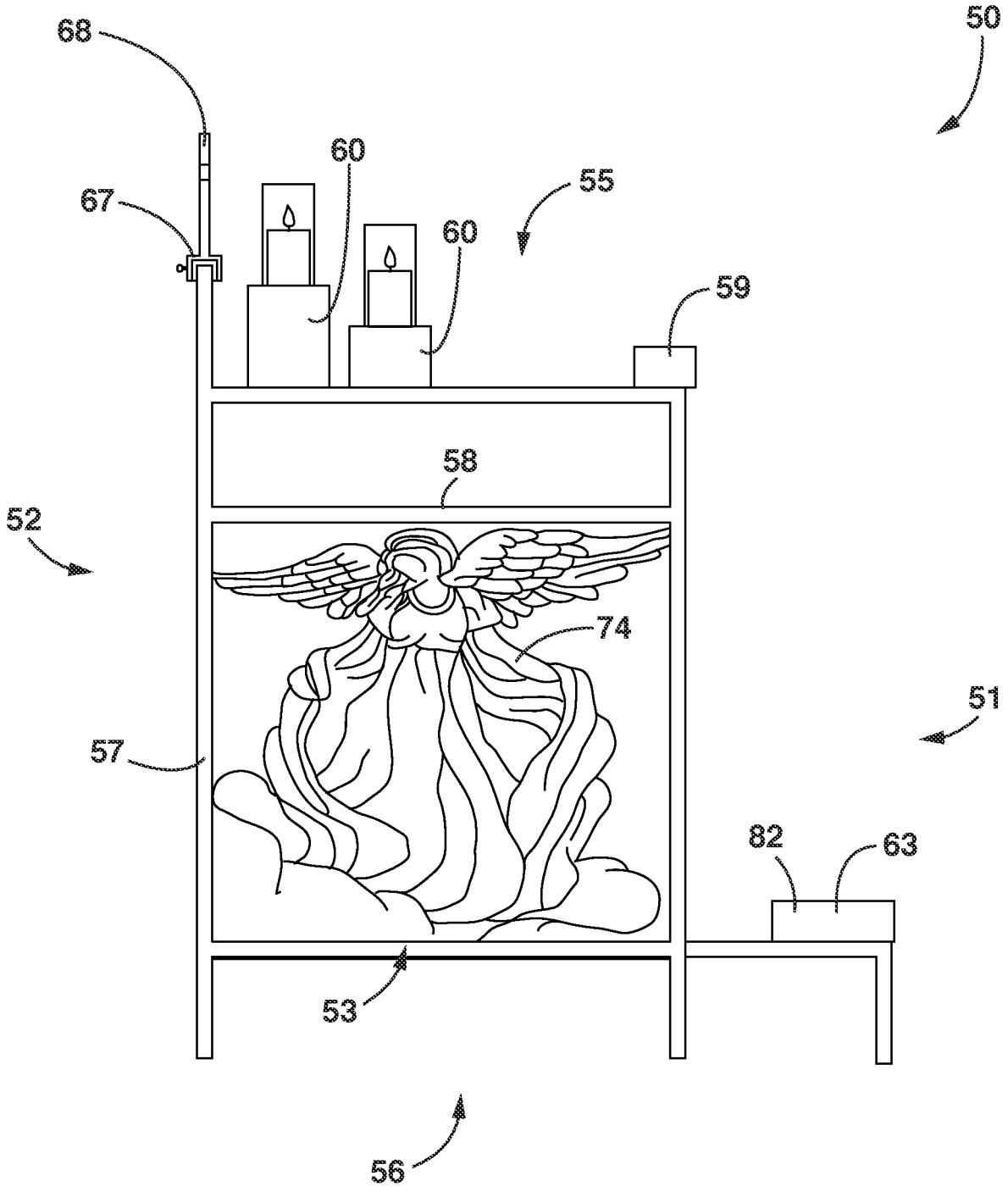
FIG. 30 is a left side elevation of the eleventh embodiment of a prayer and meditation stand.
Figure 31:
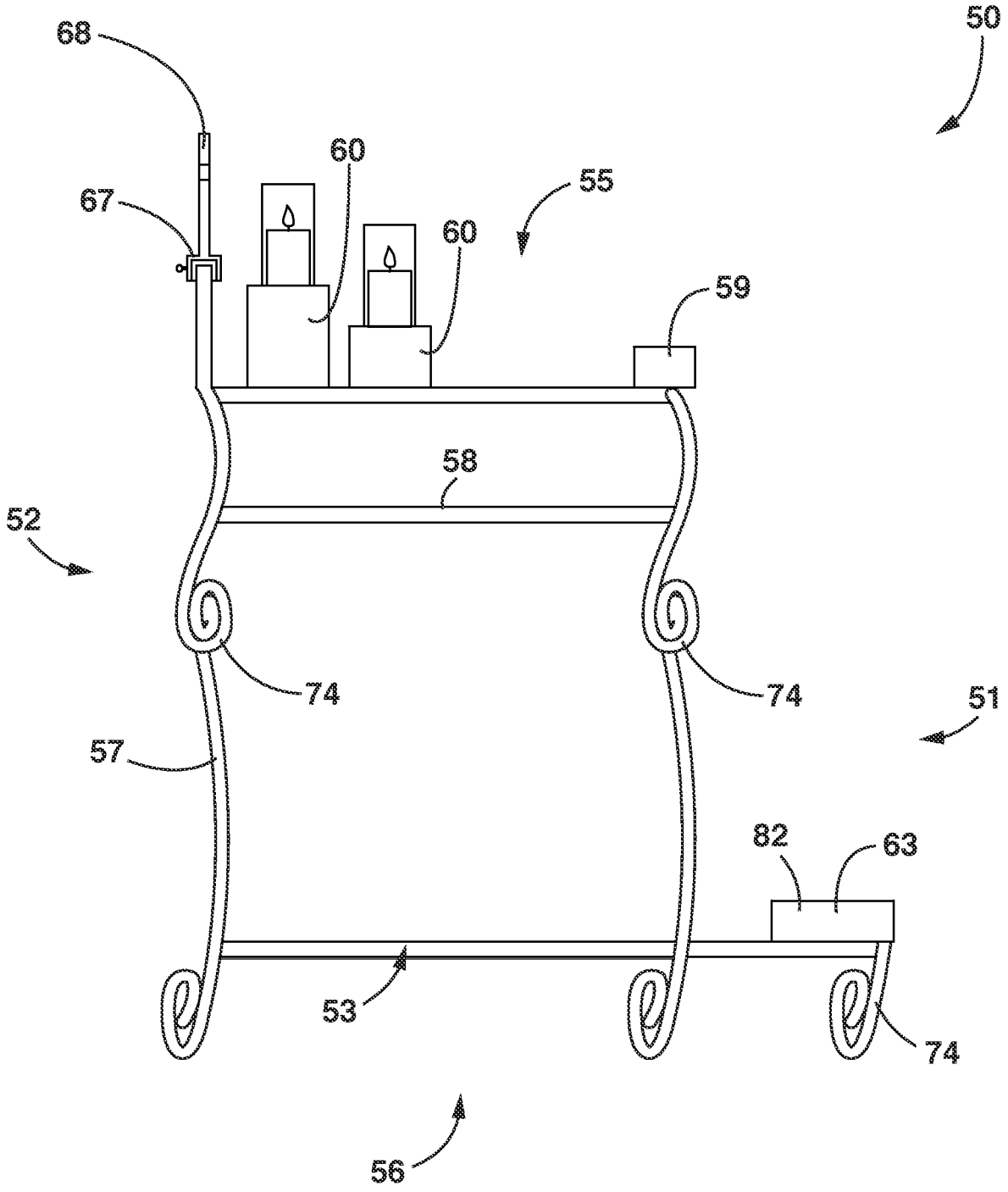
FIG. 31 is a left side elevation of the twelfth embodiment of a prayer and meditation stand.
Figure 32:
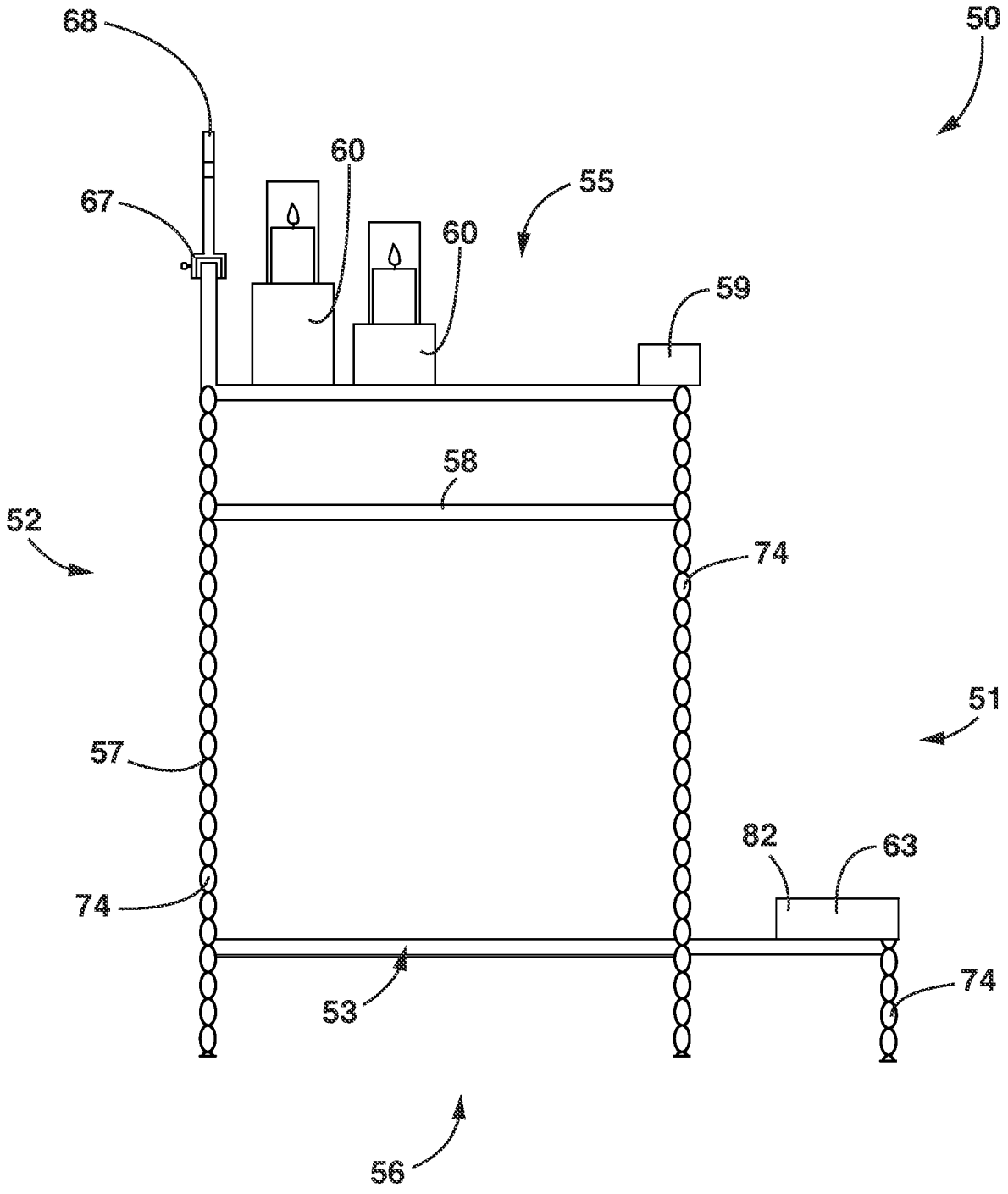
FIG. 32 is a left side elevation of the thirteenth embodiment of a prayer and meditation stand.
Figure 33:
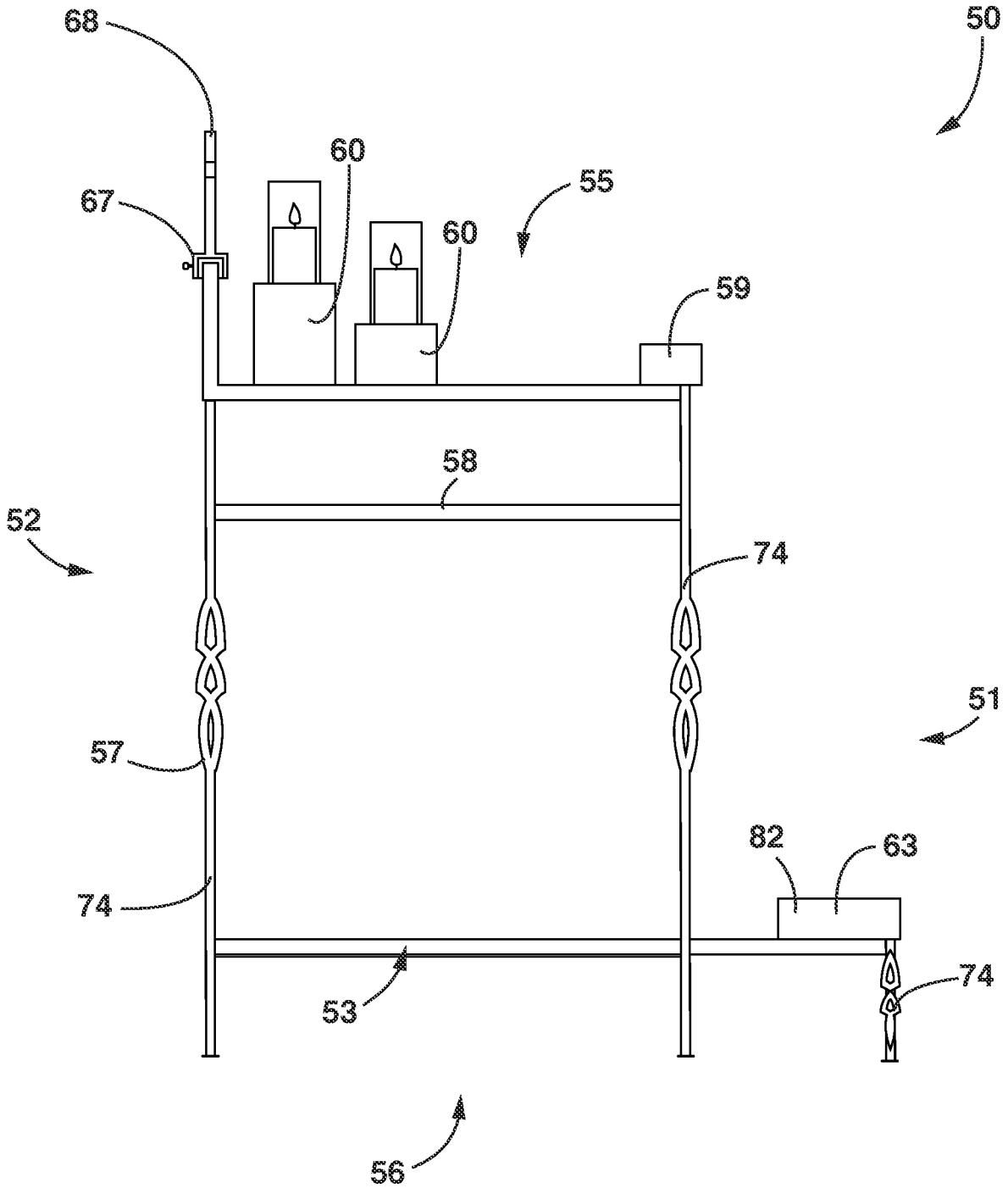
FIG. 33 is a left side elevation of the fourteenth embodiment of a prayer and meditation stand.
Figure 34:
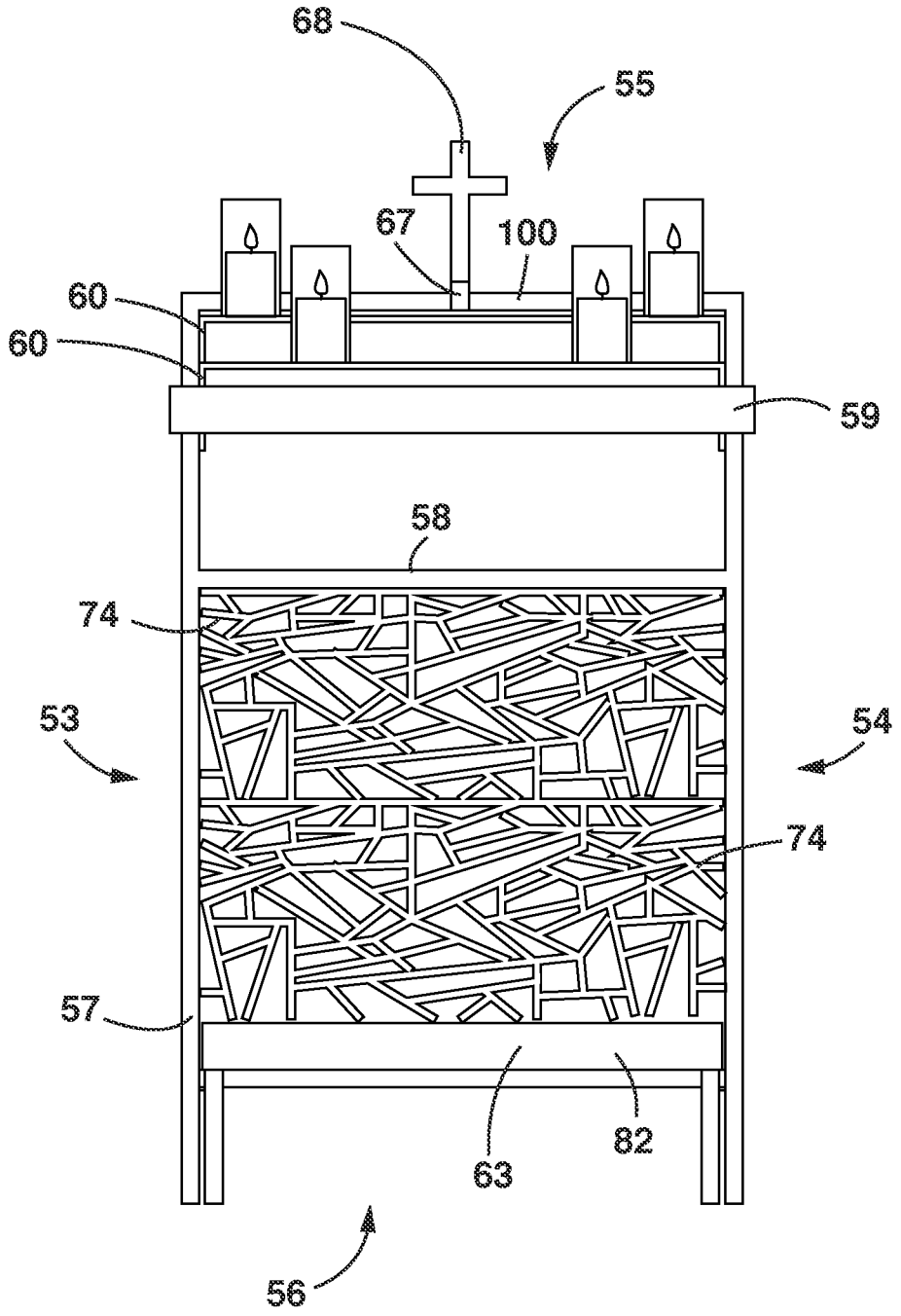
FIG. 34 is a front elevation of the fifteenth embodiment of a prayer and meditation stand.
Figure 35:
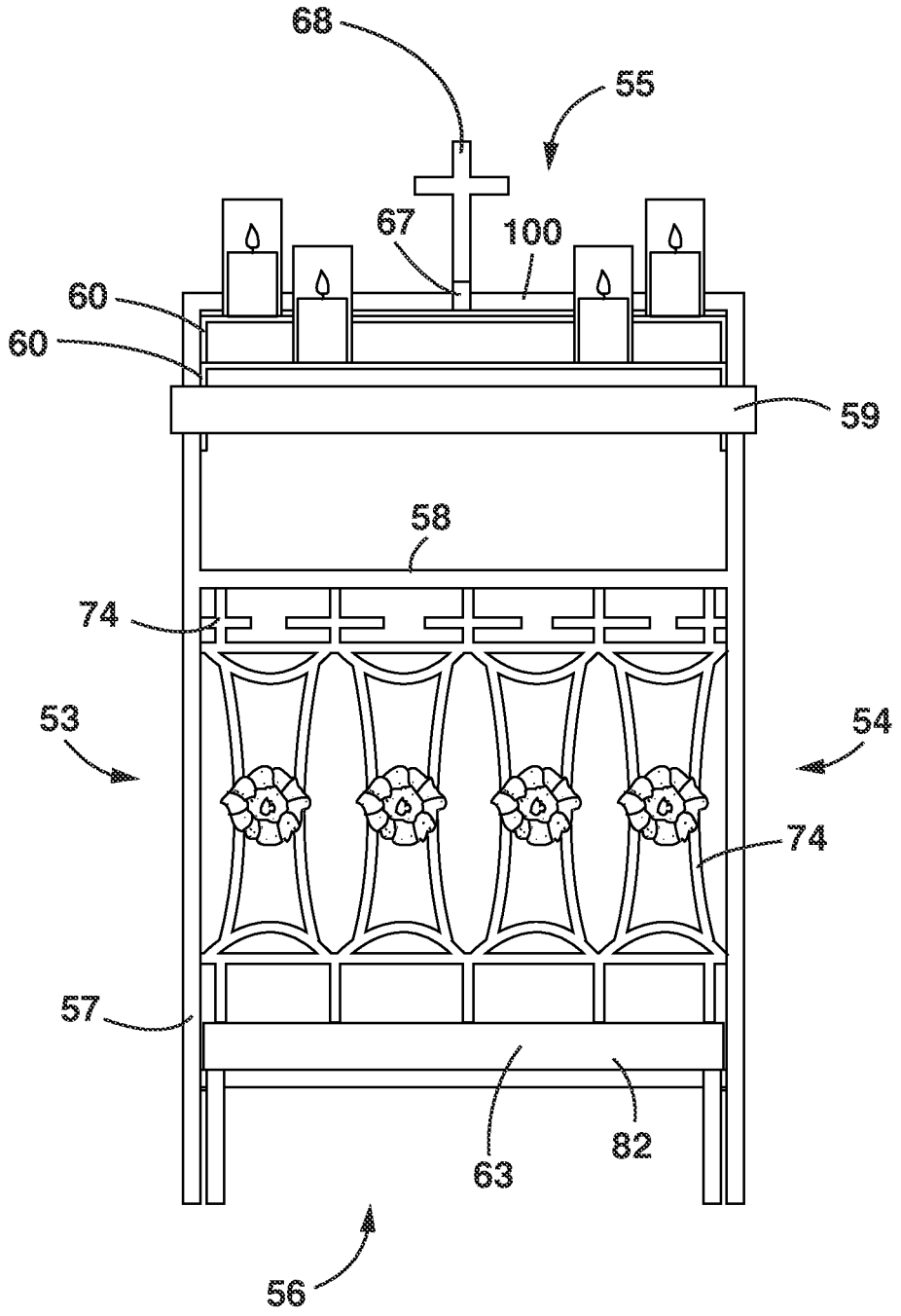
FIG. 35 is a front elevation of the sixteenth embodiment of a prayer and meditation stand.
Figure 36:
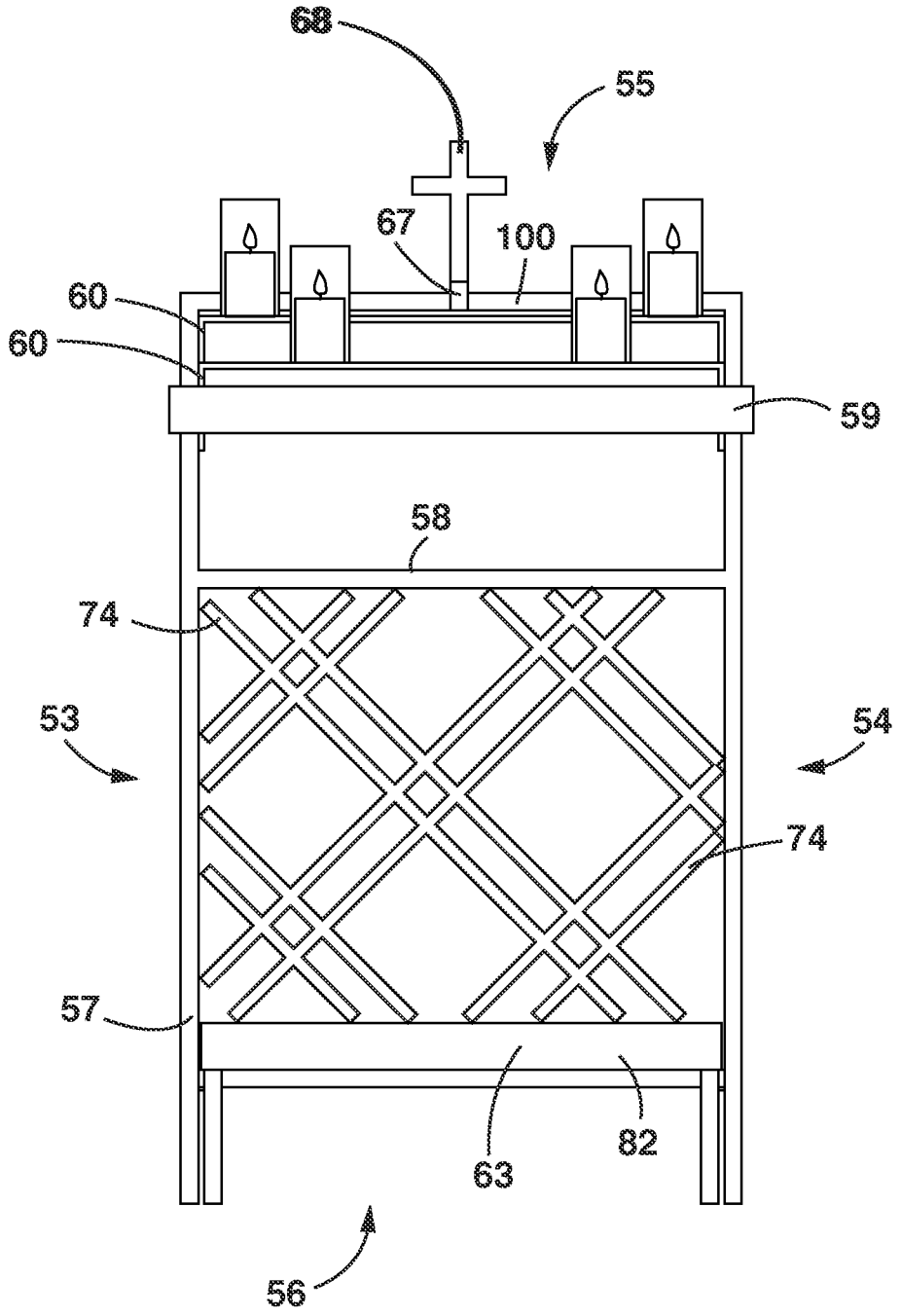
FIG. 36 is a front elevation of the seventeenth embodiment of a prayer and meditation stand.
Figure 37:
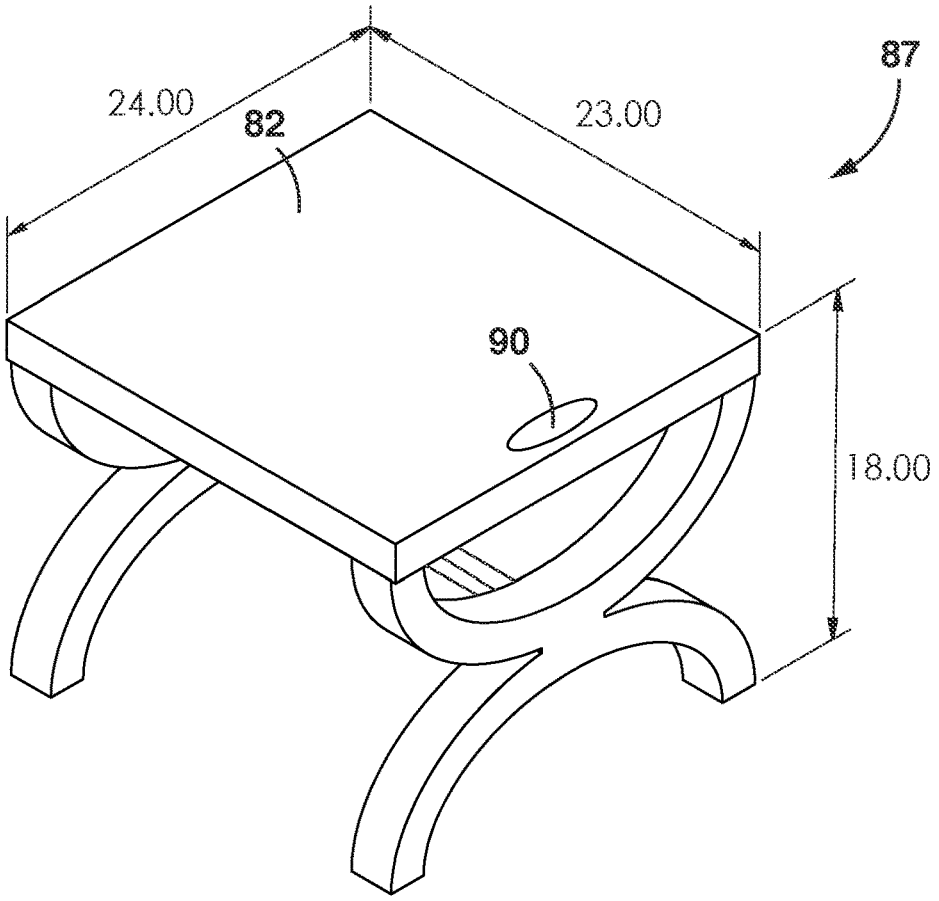
FIG. 37 is a top isometric view of the meditation platform.
Figure 38:
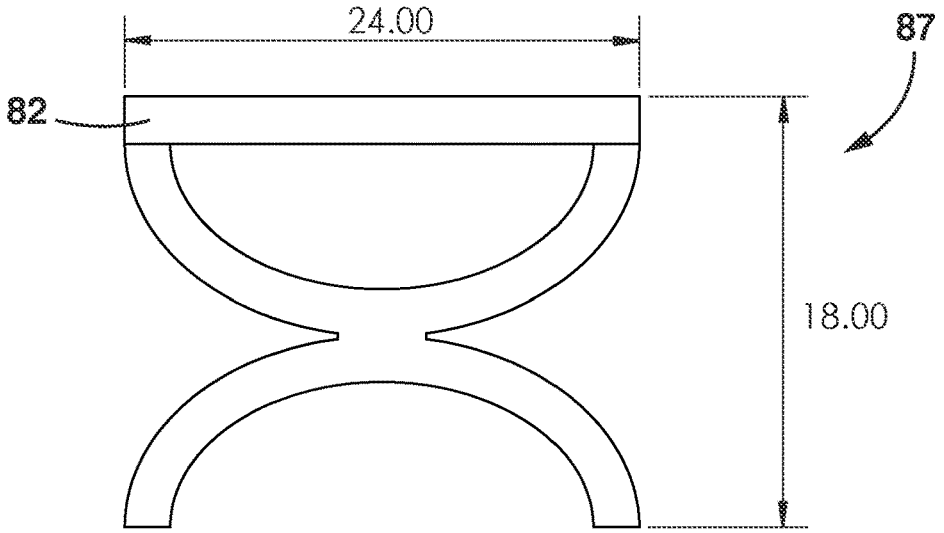
FIG. 38 is a front elevation view of FIG. 37.
Figure 39:
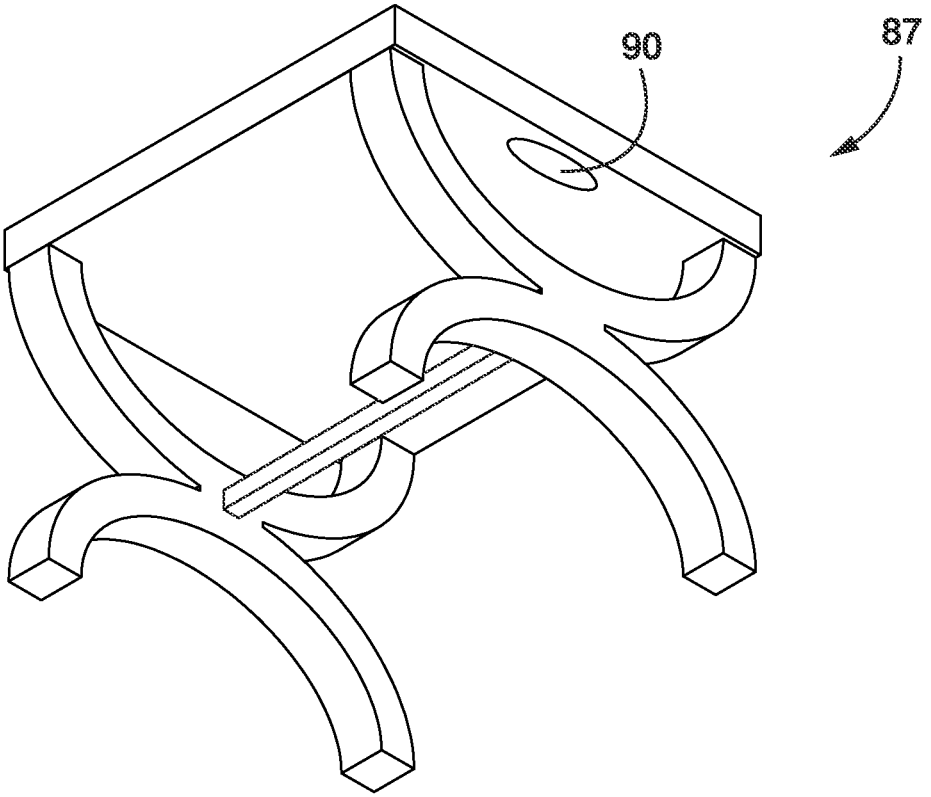
FIG. 39 is a bottom isometric view of FIG. 37.
Figure 40:
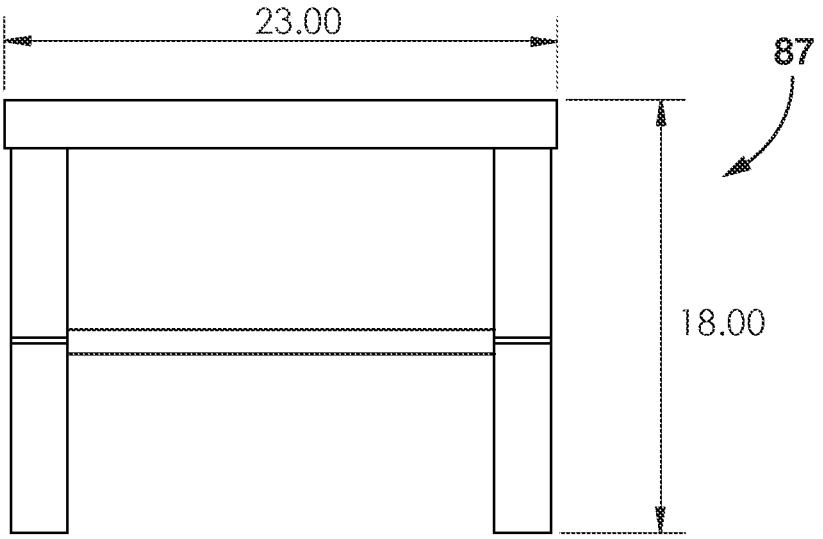
FIG. 40 is a side elevation view of FIG. 37.
Figure 41:
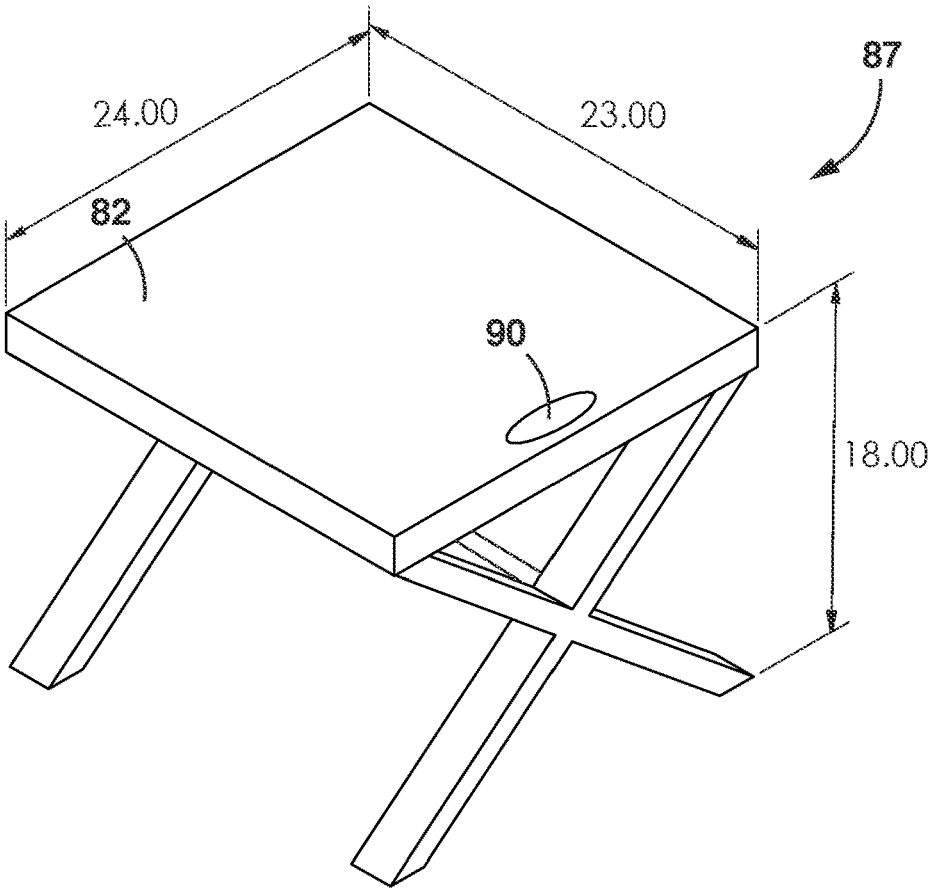
FIG. 41 is a top isometric view of the second embodiment of a meditation platform.
Figure 42:
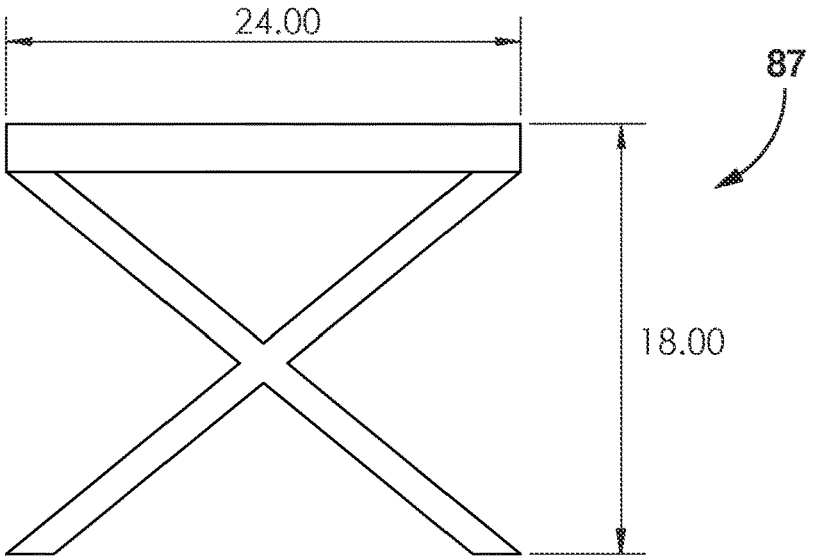
FIG. 42 is a front elevation view of FIG. 41.
Figure 43:
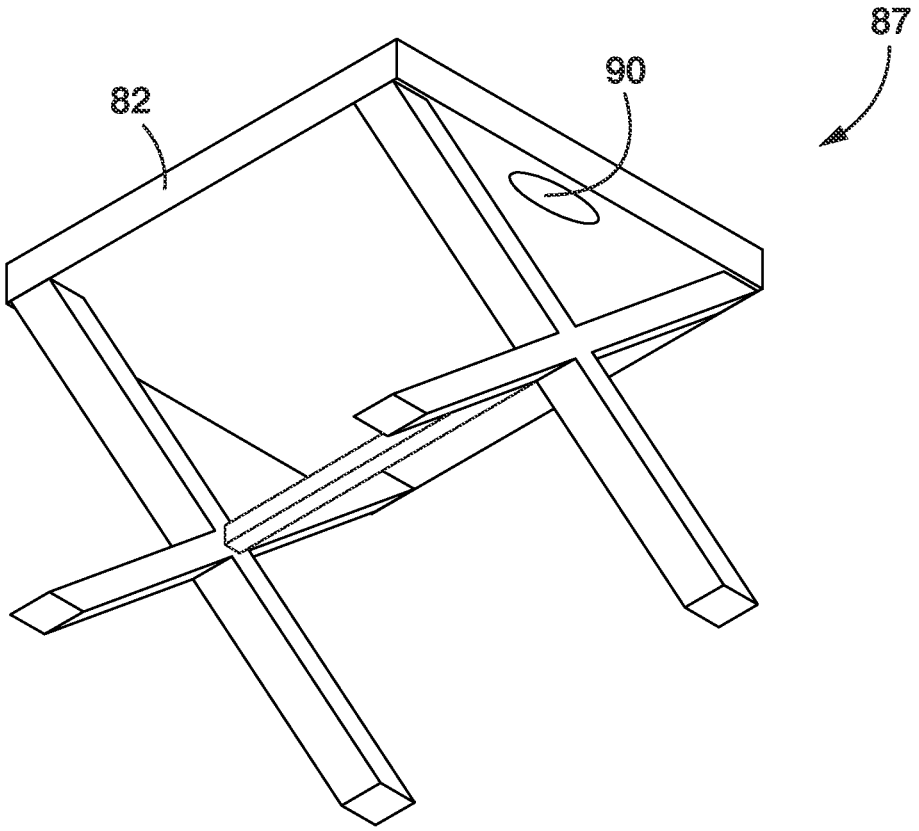
FIG. 43 is a bottom isometric view of FIG. 41.
Figure 44:
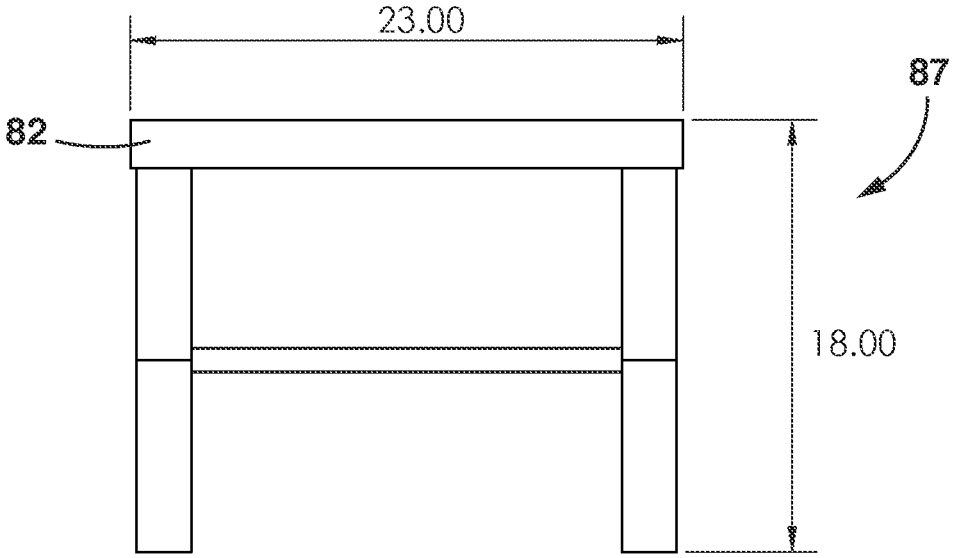
FIG. 44 is a side elevation view of FIG. 41.
Figure 45:
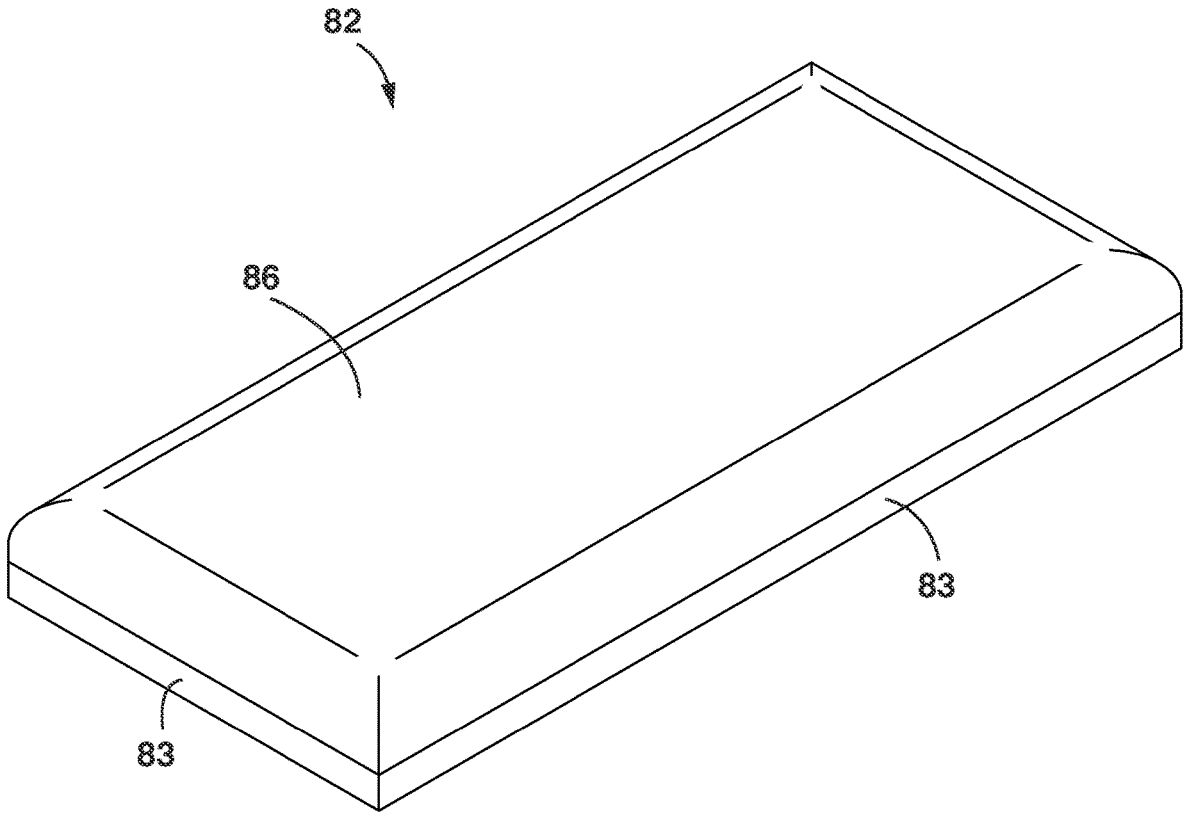
FIG. 45 is a top isometric view of the embodiment of the rest.
Figure 46:
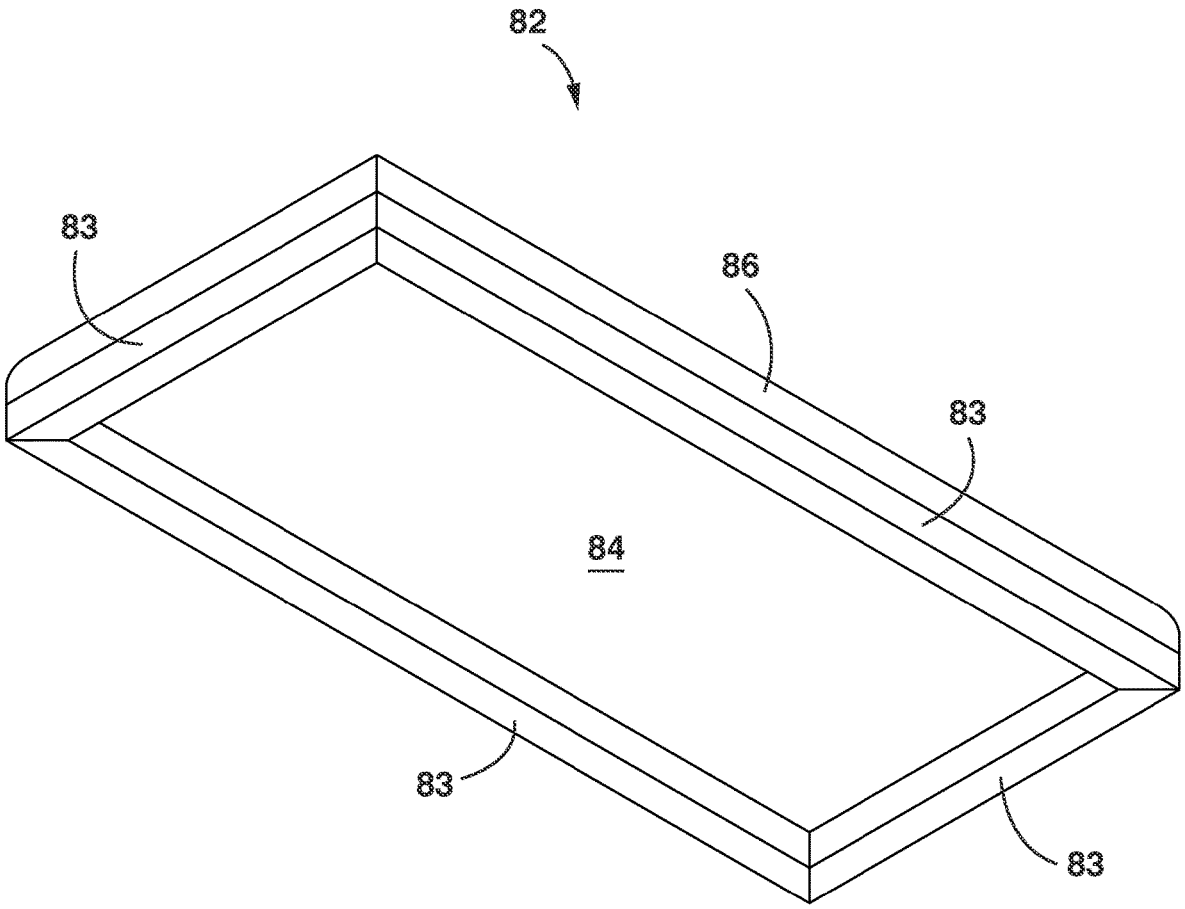
FIG. 46 is a bottom isometric view of FIG. 45.
Figure 47:
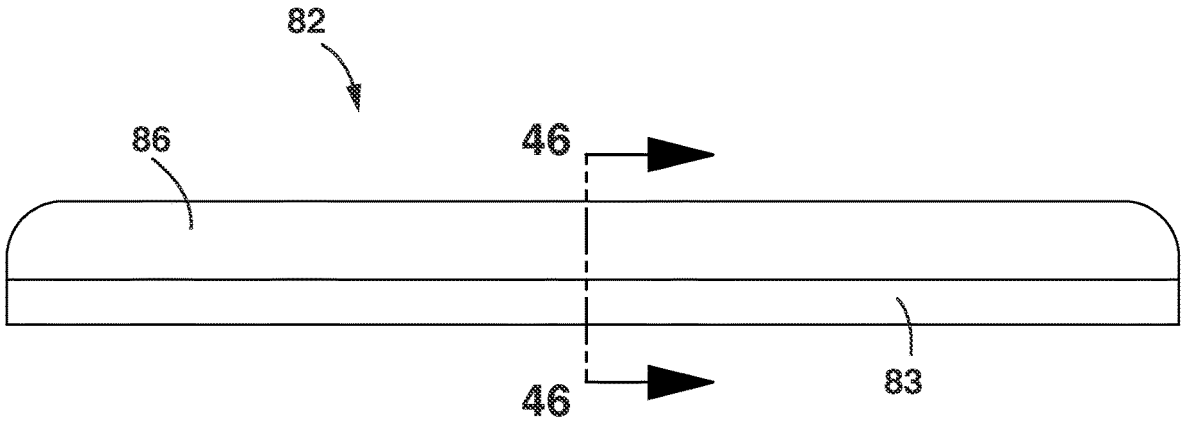
FIG. 47 is a side elevation view of FIG. 45.
Figure 48:
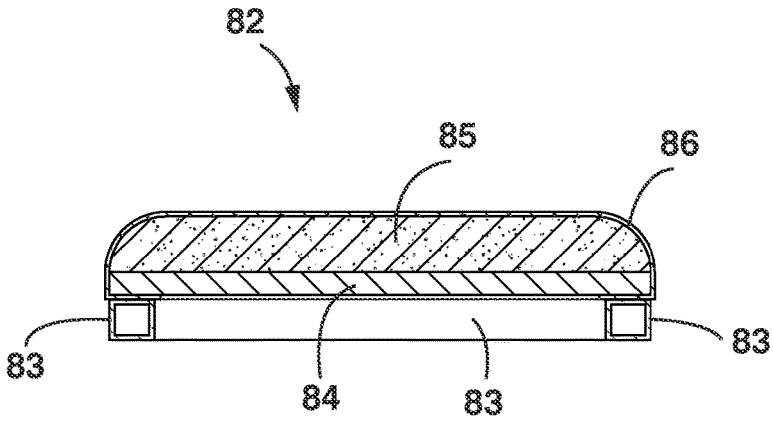
FIG. 48 is a center sectional view of FIG. 45.
Figure 49:
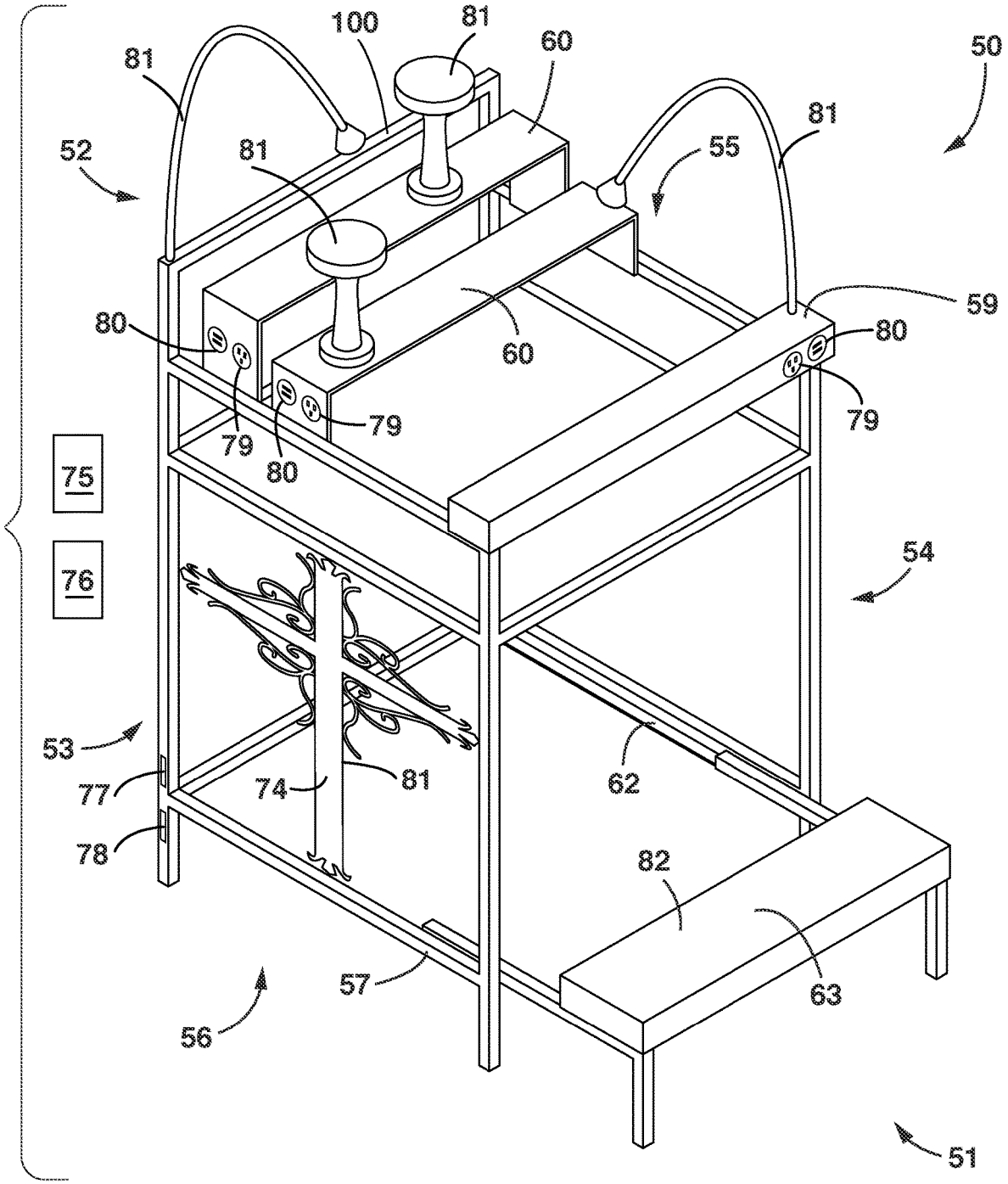
FIG. 49 is a top isometric view of a prayer and meditation stand disclosing optional power, data and lighting features.
Figure 50:
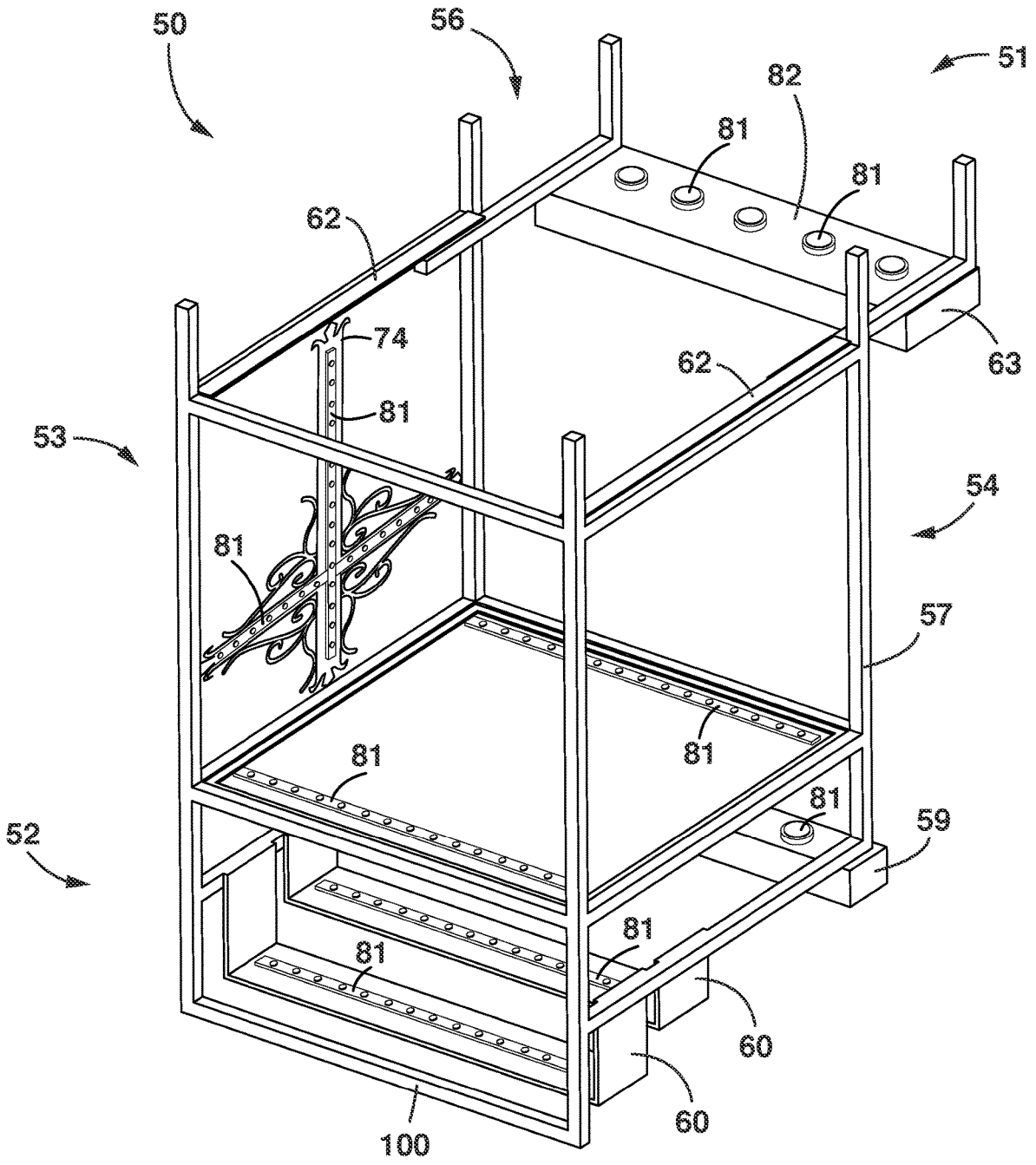
FIG. 50 is a bottom isometric view of a prayer and meditation stand disclosing more optional lighting features.
Figure 51:
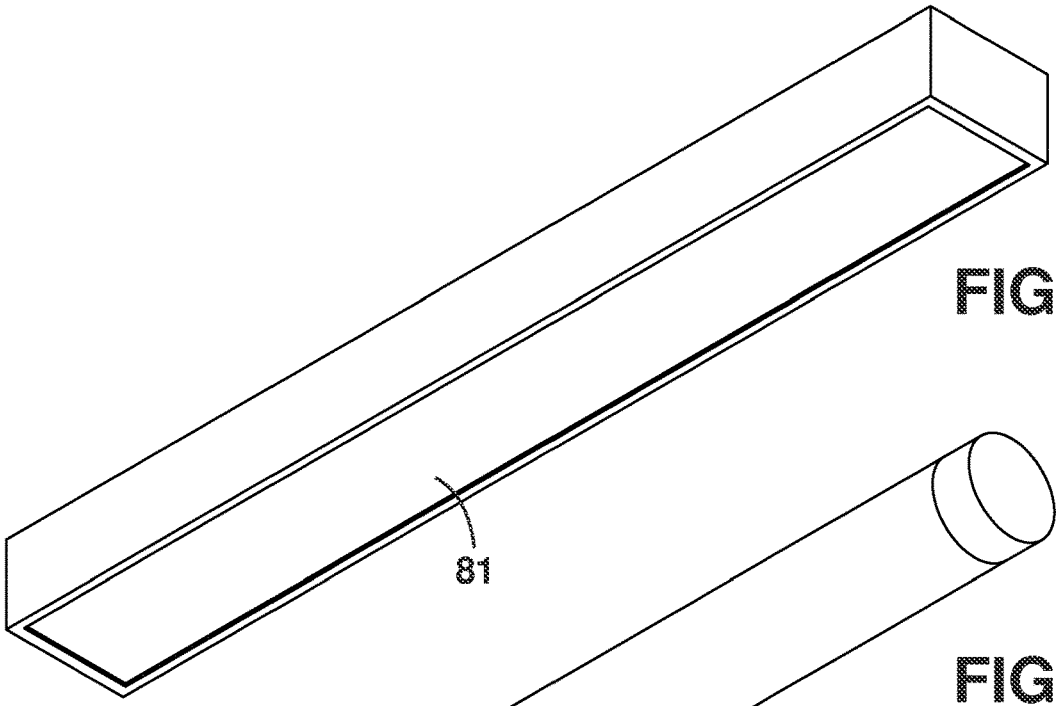
FIG. 51 is a bottom isometric view of the lighting.
Figure 52:
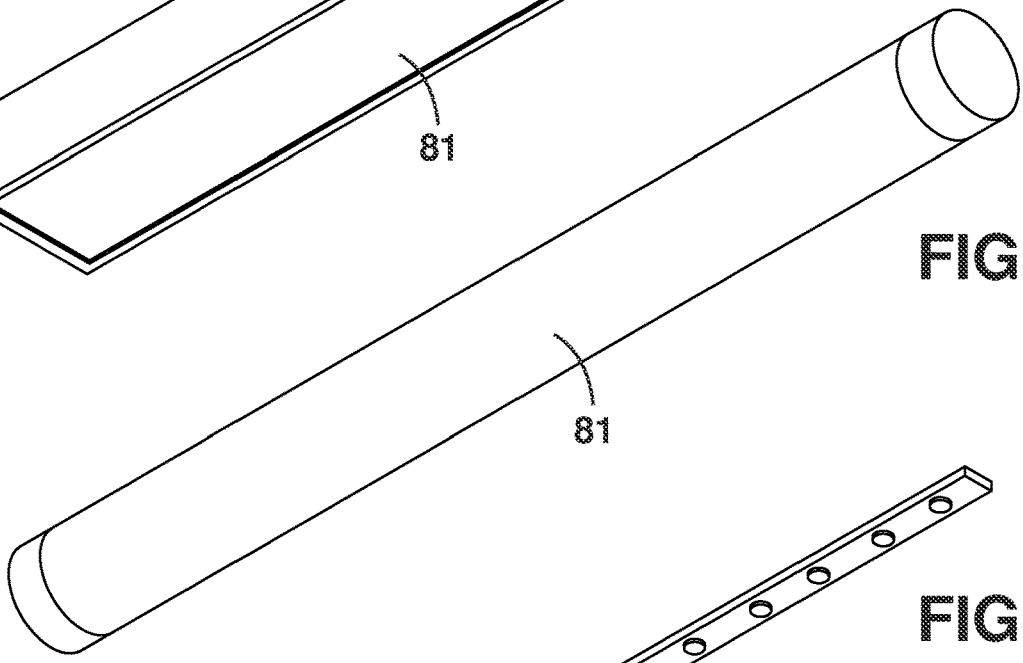
FIG. 52 is a bottom isometric view of the second embodiment of lighting.
Figure 53:
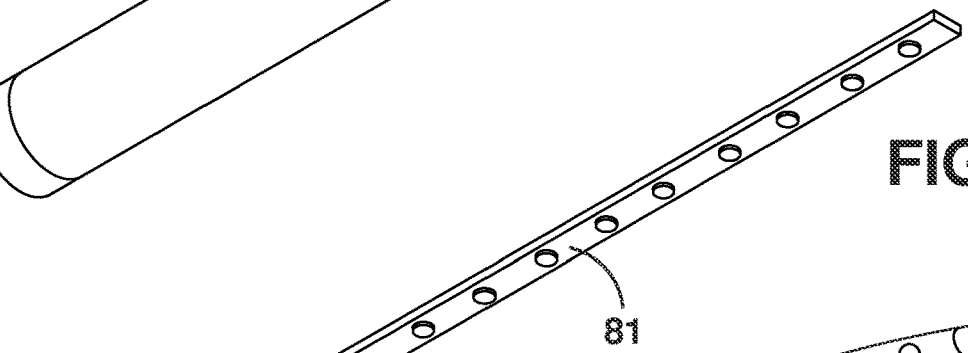
FIG. 53 is a bottom isometric view of the third embodiment of lighting.
Figure 54:
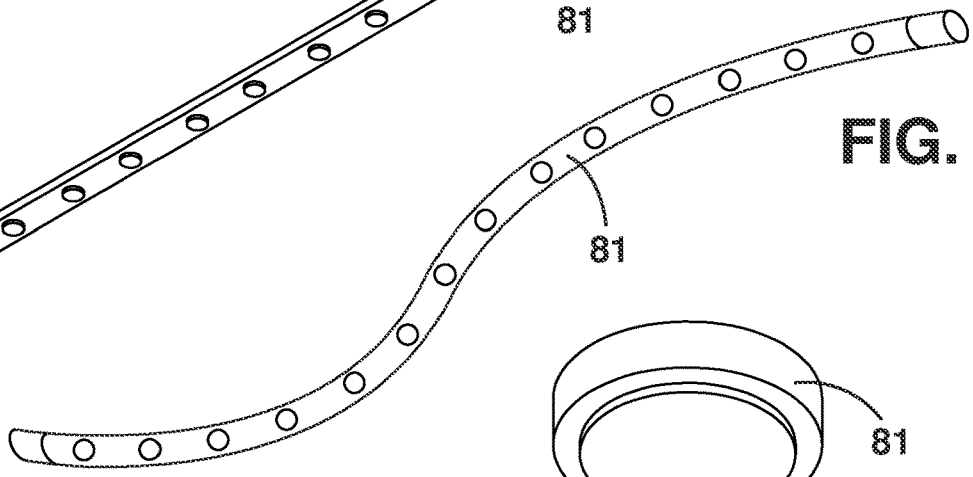
FIG. 54 is a bottom isometric view of a fourth embodiment of lighting.
Figure 55:
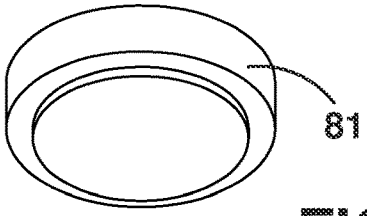
FIG. 55 is a bottom isometric view of the fifth embodiment of lighting.
Figure 56:
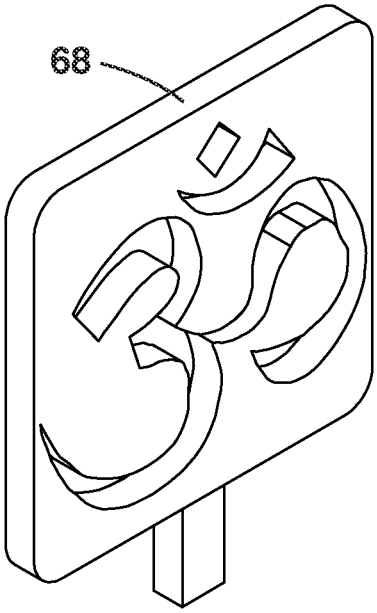
FIG. 56 is a front isometric view of the third embodiment of an icon.
Figure 57:
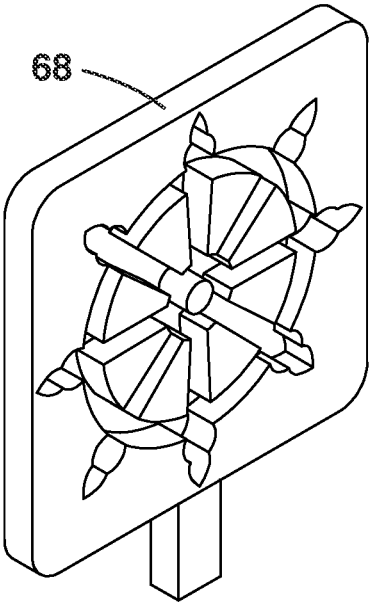
FIG. 57 is a front isometric view of the fourth embodiment of an icon.
Figure 58:
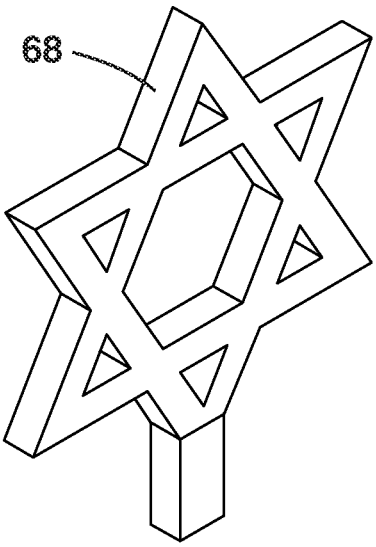
FIG. 58 is a front isometric view of the fifth embodiment of an icon.
Figure 59:
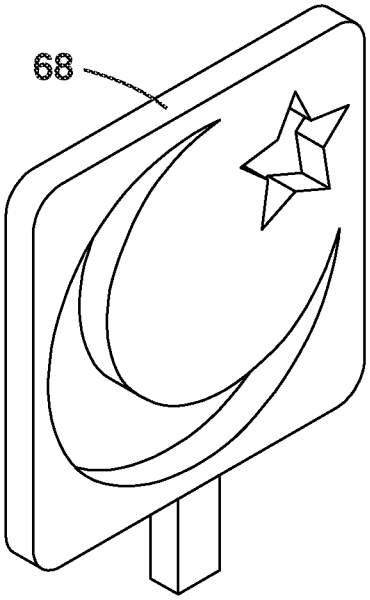
FIG. 59 is a front isometric view of the sixth embodiment of an icon.
Figure 60:
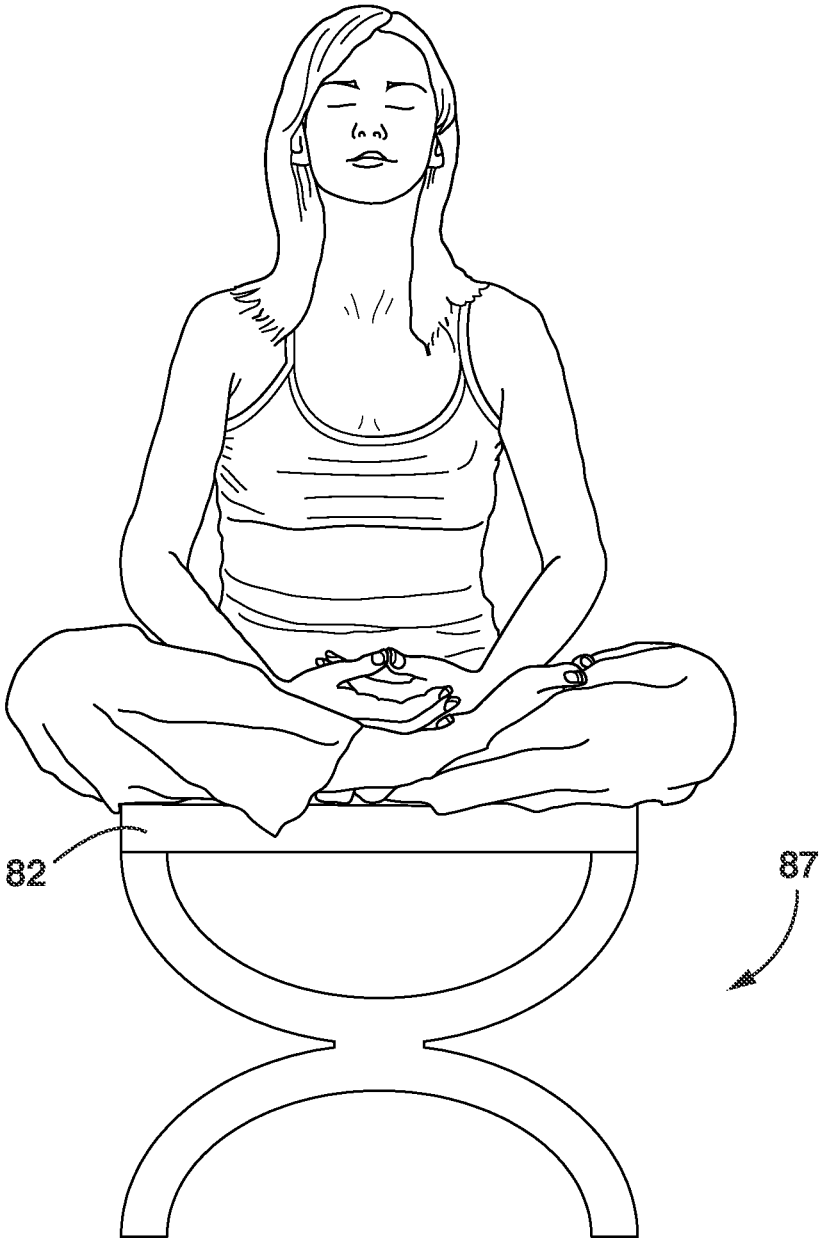
FIG. 60 is a front elevation view of a meditation platform in use by a person.

The icon 68 as illustrated in FIGS. 23 and 24 may be provided that can be manufactured from material such as wood, steel, aluminum, stone, glass, acrylic, plastic or other, structurally suitable, material. An icon 68 can be any size or nature suitable for its purpose as a focus point for reverence. In at least one embodiment an icon 68 can measure about 6 inches wide by about 0.8 inches deep by about 10.0 inches in height and have a vertical lower portion to be held in an accessory holder 67. An icon 68 can contain an image, symbol or be in the configuration of a symbol such as a cross to name one example. An icon 68 of a cross may contain tabs 73 upon which one might hang a personal crucifix. The examples of icons and symbols included herein are Christian and used in the way of a possible example only. Icons and symbols of many faiths, beliefs, religions, and practices would all be available as options to display utilizing the exchangeable accessory holder system 67, a few examples which are illustrated in FIG. 56 through FIG. 59.

Figure 20:
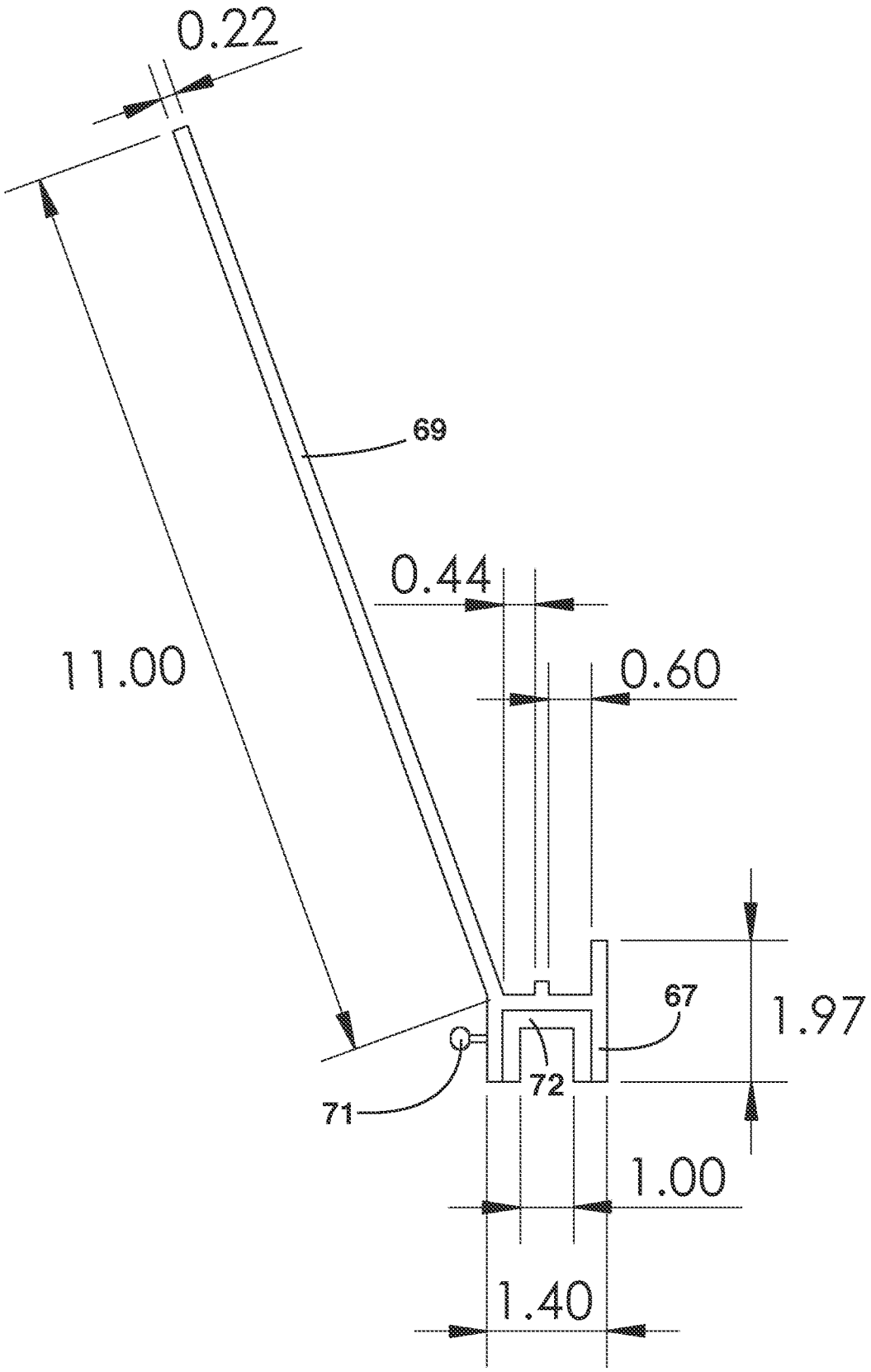
FIG. 20 is a left side elevation of the art/document/tablet holder.
Figure 21:
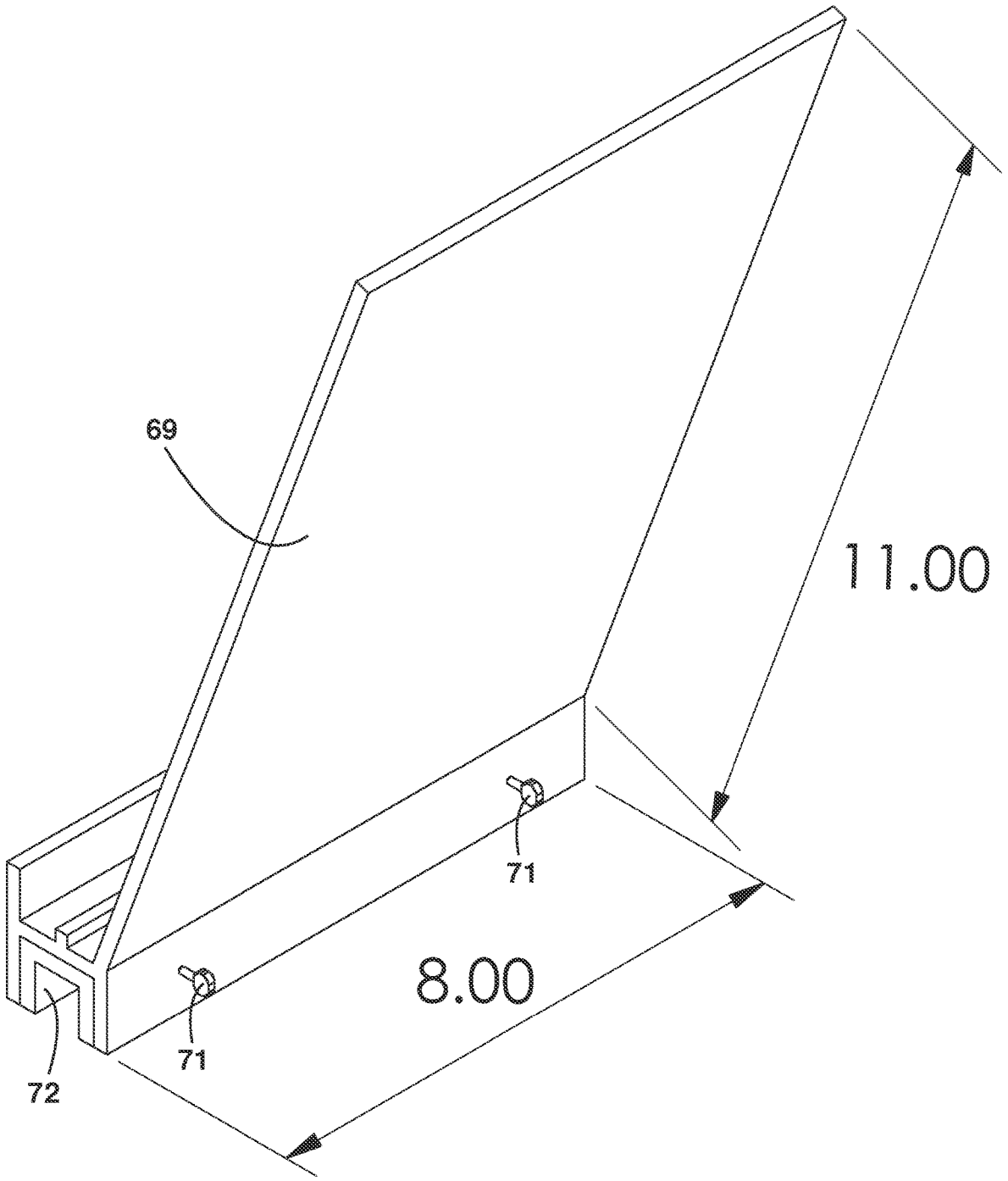
FIG. 21 is a back isometric view of an art/document/tablet holder.
Figure 22:
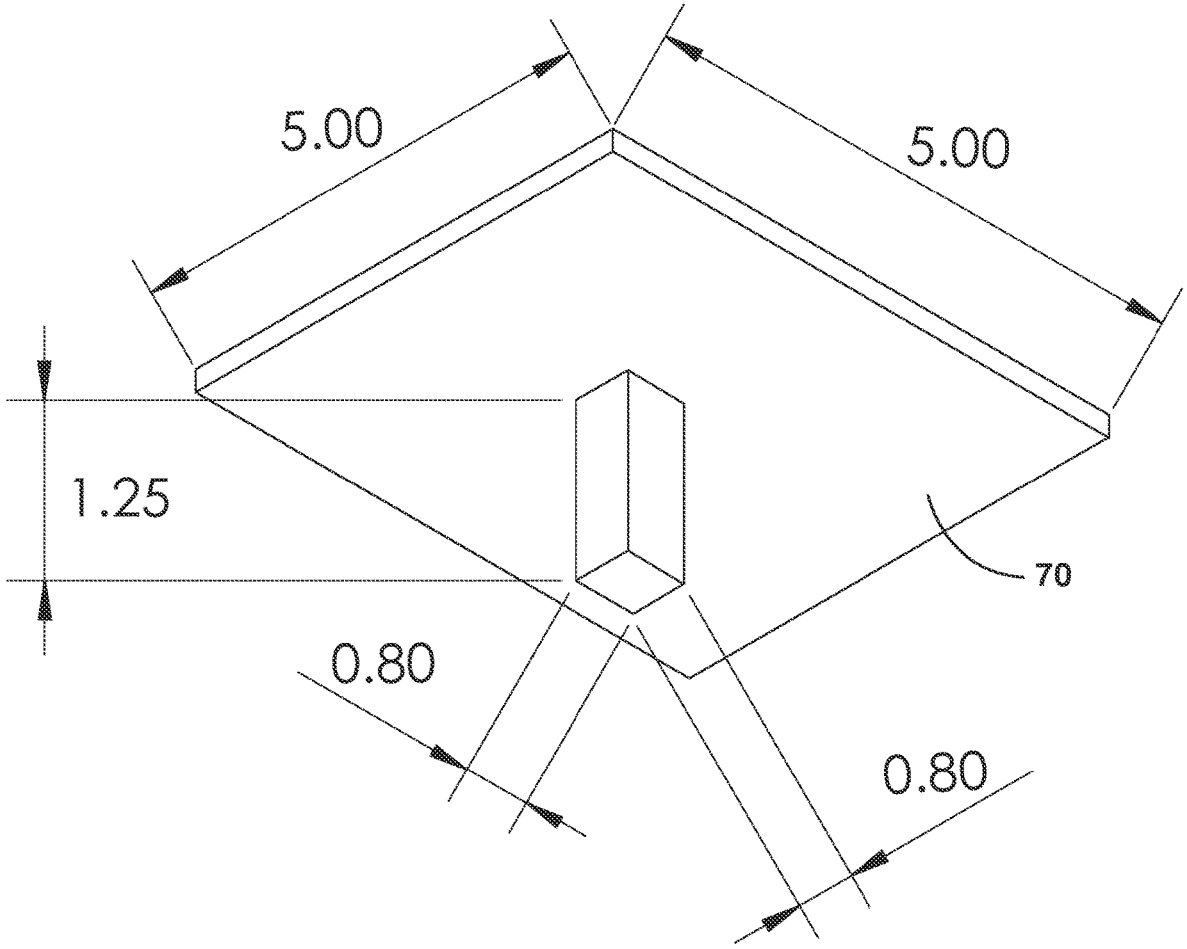
FIG. 22 is a bottom isometric view of the accessory shelf.

The accessory holder may alternatively be configured as an art/document/tablet holder 69 as illustrated in FIGS. 20 and 21, which can be manufactured from material such as wood, steel, aluminum, stone, glass, acrylic, plastic or other solid, structurally suitable, material. An art/document/tablet holder 69 measures about 8 inches wide by about 12 inches tall by about 5 inches in depth overall. The lower portion of the art/document/holder 69 is configured in a "H" configuration measuring about 1.4 inches across the base and about 1.97 inches in height with a material thickness of about 0.125 inches. The inside of its lower opening may or may not be wrapped with the liner 72 affixed with an adhesive or by other means. A liner 72 is made from neoprene rubber measuring about 0.125 in thickness or other flexible type of material suitable for cushioning between component parts. One or more of the fastening means 71 may or may not be present to affix a art/document/holder 69 to a base 57 by a mechanical screw type and threaded means or other method suitable for securing components in their respective place. Art, a digital tablet, phone, book, or other item (generally referred to herein as a document) can be placed on an art/document/holder 69 for viewing by a user. A protrusion measuring about 0.125 inches by about 0.125 inches may or may not be present positioned about 0.6 inches from the inside of the front member, or about 0.44 inches from the back member, to hold a digital tablet, phone, book, or other item in place. Other types of holders, such as page holders, can be implemented in various ways as well. The rear of the art/document/holder 69 measures about 8 inches wide by about 11 inches tall by about 0.125 inches thick, is inclined rearward, and is joined with its lower portion, at the back, at about a 110 degree angle to horizontal.

The accessory shelf 70 as particularly illustrated on FIG. 22 can be manufactured from material such as wood, steel, aluminum, plastic or other solid, structurally suitable, material. The horizontal portion of the accessory shelf 70 measures about 5 inches wide by about 5 inches deep by about 0.125 inches thick and is joined with its lower vertical portion at its center, in at least one embodiment. The lower portion measures about 0.8 inches wide by about 0.8 inches deep by about 1.25 inches in height and is attached to the horizontal portion at one of its sides of smallest surface area. The purpose of the vertical portion is to serve as an insert connection to the accessory holder 67. An accessory shelf 70 can also be connected to a base 57 by means such as a re-positional adhesive, of chemical or tape nature, or other means such as welding. Accessory shelf 70 can be of other forms and sizes to fit the needs of the user and may be removably attached to the frame rails with an "H" configuration interface as discussed herein at each lateral end. Additionally, the accessory 70 may be removably attached to the accessory holder 67, which holder 67 may be fixed or removably attached to the frame rail 100, as shown and discussed herein. In this regard, it is clear that the accessories are infinitely interchangeable.

The accoutrement 74 as shown and particularly illustrated in FIG. 25 through FIG. 36 may or may not be present with a prayer and meditation stand 50. An accoutrement 74 can be manufactured from materials such as wood, steel, aluminum, stone, glass, acrylic, plastic, or other solid, structurally suitable, material, and electronic devices to serve as a way to contribute ornamental design and individuality to a prayer and meditation stand 50. An accoutrement 74 can be an external or internal means of illumination provided by the use of electronic devices or other means to illuminate a prayer and meditation stand 50. To name a few more examples. An accoutrement 74 can be a side panel as more particularly shown in FIG. 25 through FIG. 30 measuring about 22 inches wide by about 20 inches in height by about 0.25 inches in depth overall. An accoutrement 74 can be a modified ornamental design to the legs of a base 57, a kneeler 63 or a kneeler with seat 64 as more particularly shown in FIG. 31 through FIG. 33. An accoutrement 74 can be a front panel as more particularly shown in FIG. 34 through FIG. 36 measuring about 26 inches wide by about 17 inches in height, or shorter depending upon design considerations, by about 0.25 inches in depth overall. The examples presented in the drawings are not exhaustive of the decorative panels and ornamentation that could be added to a prayer and meditation stand 50. Clearly, these forms of alteration do not affect the functionality or purpose of the prayer and meditation stand 50 and are of an optional nature.

The meditation platform 87 as shown and particularly illustrated in FIGS. 37 through 44 and FIG. 60 may or may not be present with a prayer and meditation stand 50 and can be used in lieu of kneeler 63 and kneeler with seat 64. A meditation platform 87 provides a comfortable platform, raising one to the level of the prayer and meditation stand 50, where you may focus on a particular image, object, or symbol with a goal of relaxing your body and calming your mind. A user can have a better experience with candles and similar elements. For the aged, a meditation platform 87, allows one to assume the traditional meditative position without lowering oneself to the floor or ground. A meditation platform 87 can be manufactured from materials such as wood, steel, aluminum, stone, glass, acrylic, plastic or other solid, structurally suitable, material. A meditation platform 87 measures about 24 inches wide by about 23 inches long by about 18 inches in height. The human contact surfaces of a meditation platform 87 can be padded with foam and upholstery material or be of a hard surface material. In at least one embodiment 1.0 inch×2.0 inch material can be used. Members can be fastened together by any means of joining such as dovetailing, the use of fasteners, welding, or other suitable means of fastening as discussed herein. A meditation platform 87 may or may not serve as a stowage means to store a yoga matt 88 or other article and have a handle 90 or gripping feature to conveniently move it in and out of a stowage position below a prayer and meditation stand 50 as illustrated in FIG. 37, FIG. 39, FIG. 41, FIG. 43 and FIG. 63. Let it be noted the use of various types of material and padding can lead to various adjustments in overall height of a meditation platform 87.

The rest 82 can be manufactured from material such as wood, steel, aluminum, stone, glass, acrylic, plastic, or other solid, structurally suitable material. In lieu of rigid hard surface materials, the rest 82 can be manufactured from structurally sound members 83, pieced together in a picture frame configuration, to support an assembly comprised of the panel 84 supporting the padding 85 and wrapped with upholstery 86. As illustrated in FIG. 45 through FIG. 48. The assembly attachable to kneeler 63, and or a kneeler with seat 64 by screws, bolts welding or similar securing methods. Forming a more comfortable contact surface for a kneeler 63, and or a kneeler with seat 64 and or a meditation platform 87 and or a prayer and meditation rail 59. In a particular embodiment, members 83 can be eliminated where an assembly is self-supporting. Let it be noted the use of various types of material and padding can lead to various adjustments in overall height of a prayer and meditation stand 50.

Referring to FIG. 49 through FIG. 55 to elaborate more on the various combinations of optional electronic devices associated with a prayer and meditation stand 50. The power source 75 such as a main outlet or generator of electricity or other transmittable motive means such as light, to name one example. And the data source 76 such as a generator of information via electricity, light, or other transmission means are connected to the power in portal 77 and the data in portal 78 who's purposes are to receive wired or wireless communication of power or information for use by a prayer and meditation stand 50. A prayer and meditation stand 50 can be internally wired or wireless connected to the power out portal 79 and the data out portal 80 for relaying power and information to other connected external devices such as phones and computers, to name two examples. The lighting 81 can be of many forms, as illustrated, such as panel, tape, and rope. Technologies such as incandescent, fluorescent, quartz or light emitting diode LED can be implemented and can be mounted externally, internally above, below, on or about a prayer and meditation stand 50. Lighting 81 can also be internally mounted within or behind an accoutrement 74.

It should be noted that any of the dimensions cited could vary by plus or minus 50 percent in other embodiments. The present invention is described in the previous examples, which are set forth to aid in the understanding of the invention and should not be construed to limit in any way the scope of the invention as defined in the claims which follow thereafter.

While the foregoing invention has been described in some detail for purposes of clarity and understanding, it will be appreciated by one skilled in the art, from a reading of the disclosure, that various changes in form and detail can be made without departing from the true scope of the invention.

What is claimed is:

1. A prayer and meditation stand comprising:

a base forming a general cabinet structure having a top, front and back, and a left side and a right side, and a cavity therein;

a prayer and meditation rail at an upper front of the base spanning between the left side and right side of the base;

at least one of each of a votive candle holder and an accessory holder, each extending upward from the top of the base between the front and back of the base;

at least one of a kneeler or meditation platform located at the front of the base; and an accessory holder frame rail extending laterally across the top of the base, wherein the top of the base has an open structure and wherein the prayer and meditation rail and the votive candle holder define a first opening and the votive candle holder and the accessory holder frame rail define a second opening in the top of the base.

2. The prayer and meditation stand of claim 1, comprising a plurality of votive candle holders each extending upward from the top of the base between the front and back of the base, wherein the accessory holder is located on the top of the base distally relative to the plurality of votive candle holders.

3. The prayer and meditation stand of claim 2, wherein the plurality of votive candle holders vary in height.

4. The prayer and meditation stand of claim 1, wherein at least one of the votive candle holder and the accessory holder is fixedly attached to the top of the base.

5. The prayer and meditation stand of claim 1, comprising a kneeler detached from the base.

6. The prayer and meditation stand of claim 1, wherein the accessory holder has an open socket attached to the accessory holder frame rail.

7. The prayer and meditation stand of claim 1, comprising an accessory holder frame rail extending laterally across the top of the base, wherein the accessory holder is formed as an integral part of the accessory holder frame rail.

8. The prayer and meditation stand of claim 1, comprising an accessory holder frame rail extending laterally across the top of the base, wherein the accessory holder is removably attached to the accessory holder frame rail.

9. The prayer and meditation stand of claim 1, comprising an accessory holder frame rail extending laterally across the top of the base, wherein the accessory holder comprises a channel configured to fit over the accessory holder frame rail.

10. The prayer and meditation stand of claim 1, wherein the base is made from a plurality of tubes interconnected such that the cabinet structure has openings therein in at least the front, and the left and right sides of the base.

11. The prayer and meditation stand of claim 1, comprising decorative panels on at least one of the left and right sides of the base.

12. The prayer and meditation stand of claim 1, comprising a fixed-in-place kneeler.

13. The prayer and meditation stand of claim 1, having a kneeler and wherein the kneeler is pivotally coupled to the base, such that the kneeler can be pivoted into the base so that the kneeler may be contained within the cavity of the base completely and pivoted out of the base for use.

14. The prayer and meditation stand of claim 1, comprising an accessory holder frame rail extending laterally across the top of the base, wherein the accessory holder is in the form of an art/document/tablet holder removably and, or slidingly coupled to the accessory holder frame rail.

15. The prayer and meditation stand of claim 1, comprising an accessory holder frame rail extending laterally across the top of the base, wherein the accessory holder has an H-shaped cross section slidingly attached to the accessory holder frame rail.

16. The prayer and meditation stand of claim 1, comprising a plurality of accessory holders interchangeably attachable to the prayer and meditation stand.

17. The prayer and meditation stand of claim 1, comprising a meditation platform configured to be slid into the cavity of the base.

18. The prayer and meditation stand of claim 1, having a kneeler and wherein the kneeler is slidingly coupled to the base, such that the kneeler can be slid into the base so that the kneeler may be contained within the cavity of the base completely and slid out of the base for use.

19. The prayer and meditation stand of claim 18, comprising a kneeler and a seat integrally coupled to the kneeler.

20. The prayer and meditation stand of claim 19, wherein the seat and kneeler have planer planar upper surfaces that are other than parallel to the ground.

21. A prayer and meditation stand comprising:

a base forming a general cabinet structure having a top, front and back, and a left side and a right side, and a cavity therein;

a prayer and meditation rail at an upper front of the base spanning between the left side and right side of the base;

at least one of each of a votive candle holder and an accessory holder, each extending upward from the top of the base between the front and back of the base;

at least one of a kneeler or meditation platform located at the front of the base; and an accessory holder frame rail extending laterally across the top of the base and a shelf between the top and a bottom of the base, wherein the top of the base has an open structure and wherein the prayer and meditation rail and the votive candle holder define a first opening and the votive candle holder and the accessory holder frame rail define a second opening in the top of the base, the first and second openings located directly above the shelf.

* * * * *